US010798514B2

(12) United States Patent
Reijniers et al.

(10) Patent No.: US 10,798,514 B2
(45) Date of Patent: Oct. 6, 2020

(54) METHOD OF DETERMINING A PERSONALIZED HEAD-RELATED TRANSFER FUNCTION AND INTERAURAL TIME DIFFERENCE FUNCTION, AND COMPUTER PROGRAM PRODUCT FOR PERFORMING SAME

(71) Applicant: UNIVERSITEIT ANTWERPEN, Antwerp (BE)

(72) Inventors: Jonas Reijniers, Borgerhout (BE); Herbert Peremans, Ghent (BE); Bart Wilfried M Partoens, Mortsel (BE)

(73) Assignee: UNIVERSITEIT ANTWERPEN, Antwerp (BE)

( * ) Notice: Subject to any disclaimer, the term of this patent is extended or adjusted under 35 U.S.C. 154(b) by 0 days.

(21) Appl. No.: 16/329,498

(22) PCT Filed: Sep. 1, 2016

(86) PCT No.: PCT/EP2016/070673

§ 371 (c)(1),
(2) Date: Feb. 28, 2019

(87) PCT Pub. No.: WO2018/041359

PCT Pub. Date: Mar. 8, 2018

(65) Prior Publication Data

US 2019/0208348 A1 Jul. 4, 2019

(51) Int. Cl.
*H04S 7/00* (2006.01)
*H04R 3/04* (2006.01)
(Continued)

(52) U.S. Cl.
CPC ..... *H04S 7/303* (2013.01); *H04R 3/04* (2013.01); *H04R 5/02* (2013.01); *H04R 5/027* (2013.01);
(Continued)

(58) Field of Classification Search
CPC ..... H04S 7/303; H04S 7/304; H04S 2400/15; H04S 2420/01; H04R 3/04; H04R 5/02;
(Continued)

(56) References Cited

U.S. PATENT DOCUMENTS 5,729,612 A 3/1998 Abel et al.
6,259,795 B1 * 7/2001 McGrath ..... H04S 7/304 381/18
(Continued)

FOREIGN PATENT DOCUMENTS

CN 101938686 A 1/2011
CN 102804814 11/2012
(Continued)

OTHER PUBLICATIONS

International Search Report from PCT Application No. PCT/EP2016/070673, dated Feb. 20, 2017.
(Continued)

*Primary Examiner* — Disler Paul
(74) *Attorney, Agent, or Firm* — Workman Nydegger

(57) ABSTRACT

A method of estimating an individualized head-related transfer function and an individualized interaural time difference function of a particular person, comprises the steps of: a) obtaining a plurality of data sets comprising a left and a right audio sample from in-ear microphones, and orientation information from an orientation unit, measured in a test-arrangement where an acoustic test signal is rendered via a loudspeaker and the person is moving the head; b) extracting interaural time difference values and/or spectral values, and corresponding orientation values; c) estimating a direction of the loudspeaker relative to the head using a predefined quality criterion; d) estimating an orientation of the orientation unit relative to the head; e) estimating the individualized ITDF and the individualized HRTF. A computer
(Continued)

program product may be provided for performing the method, and a data carrier may contain the computer program.

20 Claims, 29 Drawing Sheets

(51) Int. Cl.
*H04R 5/02* (2006.01)
*H04R 5/027* (2006.01)
*H04R 5/033* (2006.01)
*H04R 5/04* (2006.01)

(52) U.S. Cl.
CPC ..... *H04R 5/033* (2013.01); *H04R 5/04* (2013.01); *H04R 2430/20* (2013.01); *H04S 7/304* (2013.01); *H04S 2400/15* (2013.01); *H04S 2420/01* (2013.01)

(58) Field of Classification Search
CPC ..... H04R 5/027; H04R 5/033; H04R 5/04; H04R 2430/20; H04R 5/00
USPC ..... 381/26, 303, 92
See application file for complete search history.

(56) References Cited

U.S. PATENT DOCUMENTS

| | | | | |
|---|---|---|---|---|
| 6,996,244 | B1 * | 2/2006 | Slaney | H04S 1/002 381/303 |
| 7,116,789 | B2 * | 10/2006 | Layton | H04R 27/00 381/17 |
| 7,720,229 | B2 * | 5/2010 | Duraiswami | H04S 1/002 381/17 |
| 7,936,887 | B2 * | 5/2011 | Smyth | H04S 7/304 381/309 |
| 9,414,171 | B2 | 8/2016 | Pontoppidan | |
| 9,565,502 | B2 | 2/2017 | Pontoppidan | |
| 9,674,629 | B2 | 6/2017 | Hegarty et al. | |
| 9,918,178 | B2 * | 3/2018 | Norris | H04M 3/568 |
| 10,104,491 | B2 * | 10/2018 | Jain | A61B 5/121 |
| 10,257,630 | B2 * | 4/2019 | Reijniers | H04S 7/304 |
| 2003/0202665 | A1 | 10/2003 | Lin et al. | |
| 2006/0045294 | A1 | 3/2006 | Smyth | |
| 2009/0052703 | A1 | 2/2009 | Hammershoi | |
| 2011/0293129 | A1 | 12/2011 | Dillen et al. | |
| 2012/0093320 | A1 | 4/2012 | Flaks et al. | |
| 2013/0010970 | A1 | 1/2013 | Hegarty et al. | |
| 2015/0124975 | A1 | 5/2015 | Pontoppidan | |
| 2016/0323678 | A1 | 11/2016 | Pontoppidan | |

FOREIGN PATENT DOCUMENTS

| | | | |
|---|---|---|---|
| CN | 103731796 | A | 4/2014 |
| CN | 104618843 | | 5/2015 |
| WO | 2016134982 | A1 | 9/2016 |

OTHER PUBLICATIONS

Zotkin et al., "Regularized HRTF Fitting Using Spherical Harmonics," IEEE Workshop on Applications of Signal Processing to Audio and Acoustics, Oct. 18, 2009, pp. 257-260.

Office Action from corresponding CN Application No. 201680088932.3, dated Jul. 2, 2020.

* cited by examiner

*[to 1306, 1402, and 1403]*

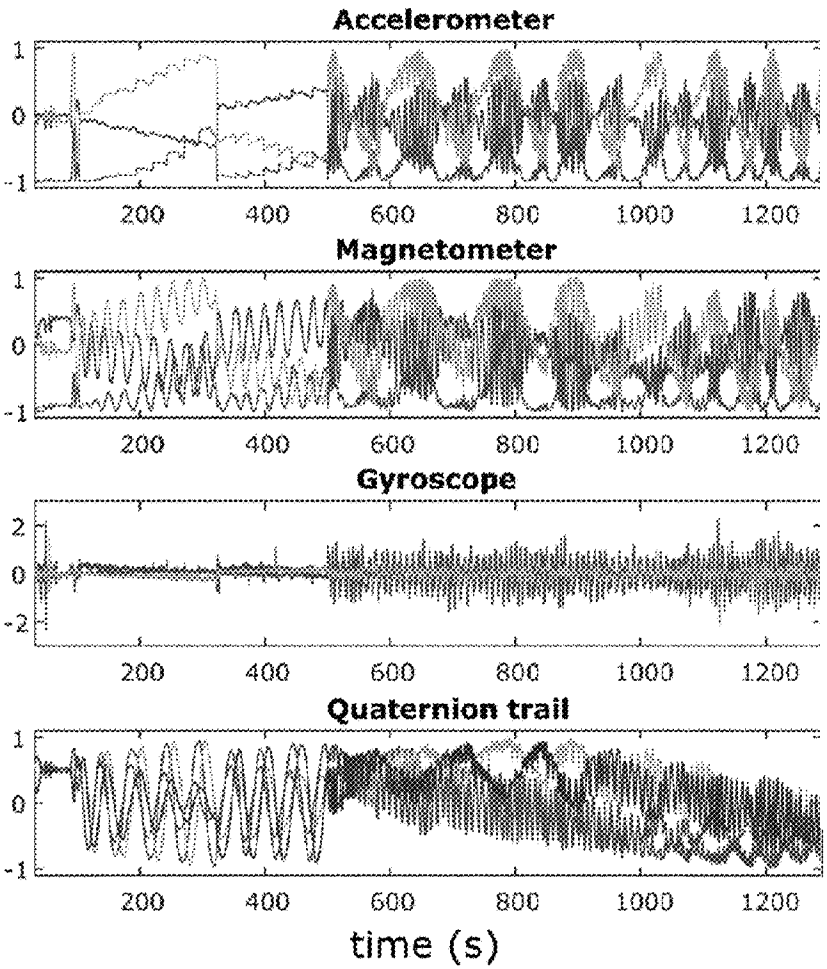
FIG. 18(a)
FIG. 18(b)
FIG. 18(c)
FIG. 18(d)
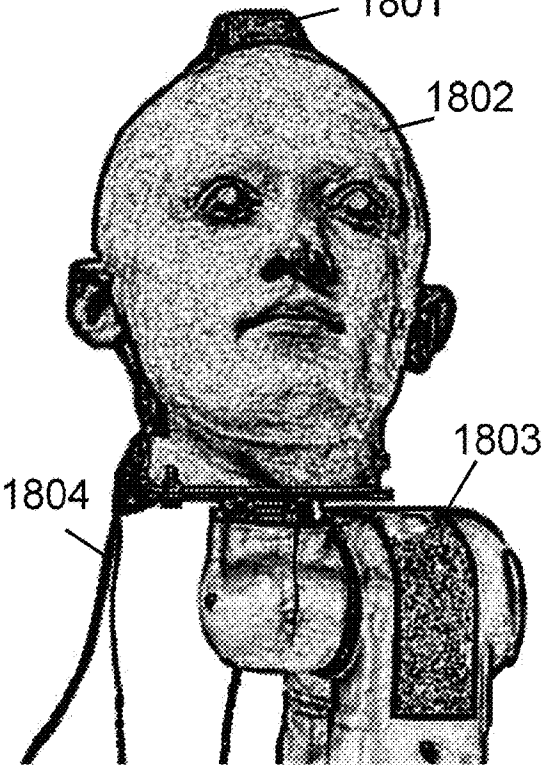
FIG. 18(e)
FIG 18

FIG. 23(a)left ear spectra

FIG. 23(b)right ear spectra

FIG. 23(c)Interaural time difference

FIG. 24(c) interaural time difference

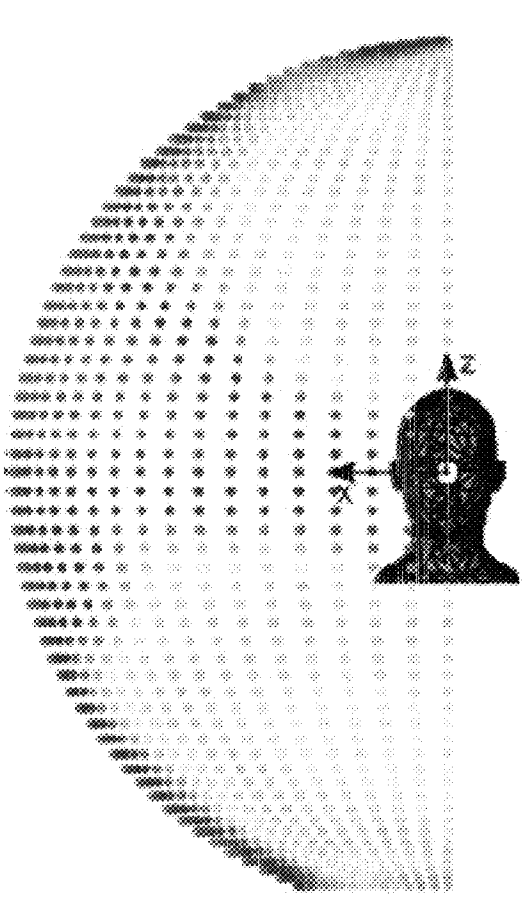
FIG. 35(a)
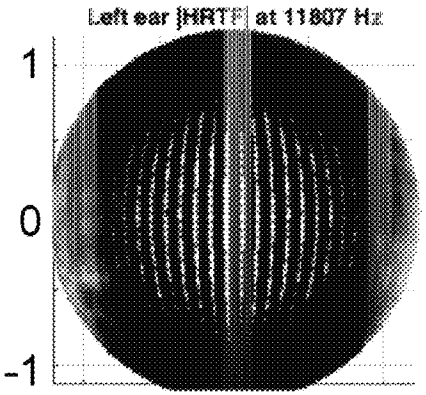
FIG. 35(b)
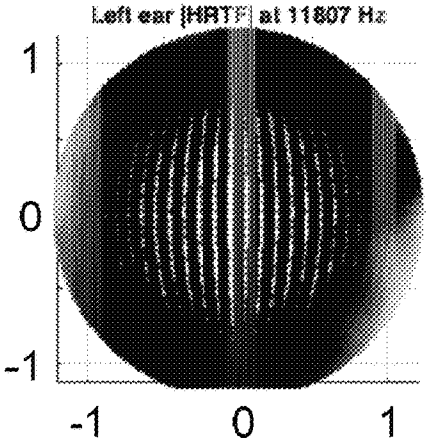
FIG. 35(c)
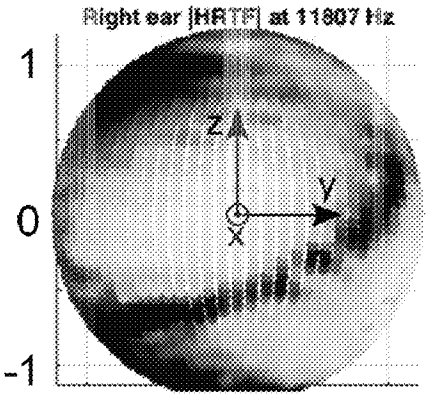
FIG. 35(d)
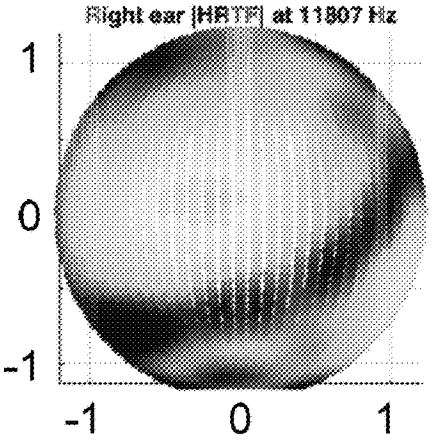
FIG. 35(e)
FIG. 35

METHOD OF DETERMINING A PERSONALIZED HEAD-RELATED TRANSFER FUNCTION AND INTERAURAL TIME DIFFERENCE FUNCTION, AND COMPUTER PROGRAM PRODUCT FOR PERFORMING SAME

FIELD OF THE INVENTION

The present invention relates to the field of 3D sound technology. More particularly, the present invention relates to a computer-implemented method of estimating an individualized head-related transfer function (HRTF) and an individualized interaural time difference function (ITDF) of a particular person. The present invention also relates to a computer-program product and a data carrier comprising such computer program product, and to a kit of parts comprising such data carrier.

BACKGROUND OF THE INVENTION

Over the past decades there has been great progress in the field of virtual reality technology, in particular with regards to visual virtual reality. 3D TV screens have found their way to the general public, and especially the home theaters and video games take advantage hereof. But 3D sound technology still lags behind. Yet, it is—at least in theory—quite easy to create a virtual 3D acoustic environment, called Virtual Auditory Space (VAS). When humans localize sound in 3D space, they use two audio signals picked up by the left and right ear. An important cue hereby is the so called "interaural time difference" (ITD): depending on the direction of the sound (w.r.t. the persons head), the sound will first reach the left or the right ear, and this time difference contains information about the lateral angle θ (see FIG. 1). The interaural time difference function (ITDF) describes how the ITD varies with the direction of the sound source (e.g. loudspeaker), see FIG. 3 for an example.

Other cues are contained in the spectral content of the sound as it is registered by the inner ear. After all, before the sound waves coming from a certain direction reach the tympanic membrane, they interfere with the body, the head and the pinna. And by this interference some frequencies are more easily transmitted than others; consequently, there occurs a spectral filtering which is dependent on the direction from where the sound is coming. This filtering is described by the so-called "Head-Related Transfer Function" (HRTF), (see example in FIG. 4) which for each direction of the sound source describes the proportion of each frequency that is transmitted or filtered out. The spectral content of the signals received in both ears thus contains additional information (called: spectral cues) about the location of the sound source, and especially about the elevation φ) (see FIG. 2), the height at which the sound-source is located relative to the head, but also whether the sound source is located in front of, or behind the person.

To create a realistic 3D acoustic virtual reality (e.g. by an audio rendering system), it is therefore paramount to know the ITDF and HRTF of a particular person. When these are known, suitable time delays and spectral filtering can be added artificially for any specific direction, and in this way, the listener is given the necessary cues (time cues and spectral cues) to reconstruct the 3D world.

Currently, there are already a lot of applications on the market that use the HRTF to create a virtual 3D impression, but so far they are not widely used. After all, they make use of a single, generalized ITDF and HRTF set, which is supposed to work for a wide audience. Just as with 3D-vision systems where it is assumed that the distance between the eyes is the same for everyone, these systems make use of the average ITDF and HRTFs. While this does not pose significant problems for vision, it does for 3D-audio. When for an individual, the distance between the eyes is significantly different from the average distance, it may occur that the users depth perception is not optimal, causing the feeling that "something is wrong", but the problems related to 3D-audio are much more severe. Small differences may cause large errors. Equipped with virtual "average ears", the user experiences effectively a spatial effect—the sound is no longer inside the head-, but somewhere outside the head, but there is often much confusion about the direction where the sound is coming from. Most mistakes are made in the perception of the elevation, but also, and this is much more disturbing: front and rear are often interchanged. Sound that should actually come from the front, is perceived as coming from behind, significantly lowering the usefulness of this technology.

Hence, despite the fact that the HRTF and ITDF of different people are similar, even small differences between a person's true HRTF and ITDF and the general HRTF and ITDF cause errors which, in contrast to 3D-vision, are detrimental to the spatial experience. This is probably one of the reasons why VAS through stereo headphones hasn't realized its full potential yet. Hence, to make optimal use of the technology, it is necessary to use a personalized HRTF and ITDF. But how to achieve this on a large scale, so that this technology can be made available to the general public?

The HRTF and ITDF of a person are traditionally recorded using specialized infrastructure: in an anechoic chamber, in which sound sources are positioned around the subject, and for each sampled direction the corresponding signal arriving at the left and right ear is recorded by means of microphones which are arranged in the left and right ear of the subject, just at the entrance of the ear canal. Although in recent years progress has been made and new methods have been developed to simplify this procedure, such measurements remain very cumbersome and expensive. It is therefore not possible to measure the HRTF and ITDF of all potential users in this way. Therefore, there is a need to look for other ways to individualize the HRTF and ITDF.

U.S. Pat. No. 5,729,612A describes a method and apparatus for measuring a head-related transfer function, outside of an anechoic chamber. In this document it is proposed to measure the HRTF using a sound wave output by a loudspeaker mounted on a special support. A left and right audio signal is captured by two in-ear microphones worn by a subject whose head movements are tracked by a position sensor and/or who is sitting on a chair which can be oriented in particular (known) directions. The data will be processed in a remote computer. The document is silent about how exactly the ITDF and HRTF are calculated from the measured audio signals and position signals. However, a calibration step is used to determine a transfer characteristic of the loudspeaker and microphones, and the method also relies heavily on the fact that the relative position of the person and the loudspeaker are exactly known.

There is still room for improvement or alternatives.

SUMMARY OF THE INVENTION

It is an object of embodiments of the present invention to provide a good method and a good computer program product for determining or estimating a personalized interaural time difference function (ITDF) and a personalized head-related transfer function (HRTF).

It is an object of embodiments of the present invention to provide a method and a computer program product for determining or estimating a personalized ITDF and a personalized HRTF, based on data captured by the end user himself, in a relatively simple test-arrangement without requiring specific skills or professional equipment.

It is an object of embodiments of the present invention to provide a method and a computer program product for performing that method in nearly any room at home, and basically only requires a suitable computing device, in-ear microphones, a loudspeaker and a "low-end" orientation unit as is typically found in smartphones (anno 2016). With "low end" is meant that the orientation information need not be highly accurate (e.g. an angular position of +/−5° is acceptable), and some of the orientation information may be incorrect, and where the orientation unit can be fixedly mounted in any arbitrary position and orientation to the head, and the person can be positioned at an arbitrary distance in the far field from the loudspeaker, and the person does not need to perform accurate movements.

It is an object of embodiments of the present invention to provide a robust (e.g. "foolproof") method and a robust computer program product that is capable of determining or estimating a personalized interaural time difference function (ITDF) and a personalized head-related transfer function (HRTF) using audio stimuli emitted by at least one loudspeakers, based on left and right audio samples captured by in-ear microphones and based on orientation information originating from an orientation unit that is fixedly mounted to the head of the person, but wherein the position and/or distance and/or orientation of the head relative to the one or more loudspeakers is not precisely known at the time of capturing said audio samples.

It is an object of particular embodiments of the present invention to provide a method and a computer program product that allows to estimate said personalized ITDF and HRTF using an orientation unit that measures the earth magnetic field and/or acceleration and/or the angular velocity (as can be found e.g. in suitable smart-phones anno 2016), and using in-ear microphones and a loudspeaker, optionally but not necessarily in combination with another computer (such as e.g. a laptop or desktop computer).

These and other objectives are accomplished by embodiments of the present invention.

In a first aspect, the present invention relates to a method of estimating an individualized head-related transfer function and an individualized interaural time difference function of a particular person in a computing device, the method comprising the steps of: a) obtaining or retrieving a plurality of data sets, each data set comprising a left audio sample originating from a left in-ear microphone and a right audio sample originating from a right in-ear microphone and orientation information originating from an orientation unit, the left audio sample and the right audio sample and the orientation information of each data set being substantially simultaneously captured in an arrangement wherein: the left in-ear microphone being inserted in a left ear of the person, and the right in-ear microphone being inserted in a right ear of the person, and the person being located at a distance from a loudspeaker, and the orientation unit being fixedly mounted to the head of the person, and the loudspeaker being arranged for rendering an acoustic test signal comprising a plurality of audio test-fragments, and the person moving his or her head in a plurality of different orientations during the rendering of the acoustic test signal; b) extracting or calculating a plurality of interaural time difference values and/or a plurality of spectral values, and corresponding orientation values of the orientation unit from the data sets; c) estimating a direction of the loudspeaker relative to an average position of the center of the head of the person and expressed in the world reference frame, comprising the steps of: 1) assuming a candidate source direction; 2) assigning a direction to each member of at least a subset of the plurality of interaural time difference values and/or each member of at least a subset of the plurality of spectral values, corresponding with the assumed source direction expressed in a reference frame of the orientation unit, thereby obtaining a mapped dataset; 3) calculating a quality value of the mapped dataset based on a predefined quality criterion; 4) repeating steps 1) to 3) at least once for a second and/or further candidate source direction different from previous candidate source directions; 5) choosing the candidate source direction resulting in the highest quality value as the direction of the loudspeaker relative to the average position of the center of the head of the person; d) estimating an orientation of the orientation unit relative to the head; e) estimating the individualized ITDF and the individualized HRTF of the person, based on the plurality of data sets and based on the estimated direction of the loudspeaker relative to the average position of the center of the head estimated in step c) and based on the estimated orientation of the orientation unit relative to the head estimated in step d); wherein the steps a) to step e) are performed by at least one computing device.

With the last sentence "wherein the steps a) to step e) are performed by at least one computing device" is meant that each of the individual steps a) to e) is performed by one and the same computing device or that some of the steps are performed by a first computing device, and some other steps are performed by a second or even further computing device.

The "assigning of a direction" of step c) 2) may comprise assigning two coordinates, for example two spherical coordinates, or other suitable coordinates, preferably in such a way that they define a unique direction. An advantage of using spherical coordinates is that in that case spherical functions can be used in the determination of the quality value, and that the results can be visualized and can be interpreted more easily.

The mapping of step c) 2) may comprise mapping the dataset ITD S to a sphere.

It is an advantage of this method that the estimation of the source direction in step c) can be based solely on the captured left and right audio samples and the orientation information originating from the orientation unit, without having to use a general ITDF or HRTF.

It is an advantage of this method that the ITDF and HRTF can be performed on a standard computer (e.g. a laptop or desktop computer) within a reasonable time (in the order of about 30 minutes).

It is an advantage of the method of the present invention that the algorithm is capable of correctly and accurately extracting ITDF and HRTF from the captured data, even if the position of the person relative to the loudspeaker is not set, or is not precisely known when capturing the data. Or stated in other words, it is an advantage that the position of the head of the person relative to the loudspeaker need not be known a-priori, and need not be calibrated.

It is an advantage that the orientation unit may have an a-priori unknown orientation relative to the head, i.e. it can be mounted to the head in any arbitrary orientation (e.g. oriented or turned to the front of the head, or turned to the back or to the left side).

It is an advantage of embodiments according to the present invention that the estimation of the orientation of the sound source relative to the head can be based solely on ITD data (see FIG. 27), or can be based solely on spectral data of the left audio samples at one particular frequency (e.g. at 8100 Hz), or can be based solely on spectral data of the right audio samples at one particular frequency (e.g. at 8100 Hz), or can be based on spectral data of at least two different frequencies (e.g. by addition of the quality value for each frequency), or can be based on spectral data of the left and/or right audio samples in a predefined frequency range (e.g. from about 4 kHz to about 20 kHz, see e.g. FIG. 28 to FIG. 30), or any combination hereof.

It is an advantage of embodiments of the present invention that it provides an individualized ITDF and HRTF for an individual, whose ITDF and HRTF need to be estimated only once, and can subsequently be used in a variety of applications, such as in 3D games or in telephone conference applications to create a spatial experience.

It is an advantage of embodiments of the present invention that the algorithm for estimating the ITDF and the HRTF need not be tuned to a particular environment or arrangement, especially at the time of capturing the audio samples and orientation data.

It is a particular advantage that the method does not impose strict movements when capturing the data, and can be performed by most individuals at his/her home, without requiring expensive equipment. In particular, apart from a pair of in-ear microphones, other equipment required for performing the capturing part is widely available (for example: device for rendering audio on a loudspeaker, a smartphone, a computer).

It is an advantage that the spectral filter characteristic of the loudspeaker need not be known a priori.

It is an advantage of embodiments of the present invention that the algorithm for estimating the ITDF and the HRTF enables to estimate the relative orientation of the head with respect to the loudspeaker at the time of the data acquisition, without knowledge of the (exact) orientation or position of the orientation unit on the head and without precise knowledge of the (exact) position of the loudspeaker and/or the person in the room, and without requiring a calibration to determine the relative position and/or orientation of the head with respect to the loudspeaker.

It is an advantage of embodiments of the present invention that the algorithm for estimating the ITDF and the HRTF can be performed on the same device, or on another device than the device which was used for capturing the audio and orientation data. For example, the data may be captured by a smartphone and transmitted to a remote computer or stored on a memory-card in a first step, which data can then be obtained (e.g. received via a cable or wireless) or retrieved from the memory card by the remote computer for actually estimating the ITDF and HRTF.

It is an advantage of embodiments of the present invention that the algorithm for estimating the ITDF and the HRTF does not necessarily require very precise orientation information from the orientation unit (for example a tolerance margin of about +/−10° may be acceptable), because the algorithm may, but need not solely rely on the orientation data for determining the relative position, but may also rely on the audio data.

Although the ITDF and HRTF provided by the present invention will not be as accurate as the ITDF and HRTF measured in an anechoic room, it is an advantage that the personalized ITDF and HRTF as can be obtained by the present invention, when used in an 3D-VAS system, are expected to give far better results than the use of that same 3D-VAS system with an "average" or "general" ITDF and HRTF, especially in terms of front/back misperceptions.

It is an advantage of embodiments of the present invention that the algorithm may contain one or more iterations for deriving the ITDF and HRTF, while the data capturing step only needs to be performed once. Multiple iterations will give a better approximation of the true ITDF and HRTF, at the expense of processing time.

It is an advantage of embodiments of the present invention that it is based on the insight that multiple unknowns (such as e.g. the unknown orientation between the person's head and the loudspeaker, and/or the unknown transfer characteristic of the microphones and/or that of the loudspeaker, and/or the unknown ITDF and HRTF) can be calculated "together" by using stepwise approximations, whereby in each approximation an improved version of the unknown variables can be used. The number of iterations can be selected (and thus set to a predefined value) by the skilled person, based on the required accuracy, or may be dynamically determined during the measurement.

It is an advantage of embodiments of the present invention that it does not require special equipment (e.g. an anechoic chamber with a plurality of microphones arranged in a sphere or an arc), but can be conducted by the user himself/herself at his/her home in a very simple set-up.

In an embodiment, step b) comprises: locating a plurality of left audio fragments and right audio fragments in the plurality of data sets, each left and right audio fragment corresponding with an audio test fragment rendered by the loudspeaker; calculating an interaural time difference value for at least a subset of the pairs of corresponding left and right audio fragments; estimating a momentary orientation of the orientation unit for each pair of corresponding left and right audio fragments.

It is an advantage of this embodiment that the estimation of the orientation of the sound source can be based solely on ITD data, if so desired, as illustrated in FIG. 27.

In an embodiment, step b) comprises or further comprises: locating a plurality of left audio fragments and/or right audio fragments in the plurality of data sets, each left and/or right audio fragment corresponding with an audio test fragment rendered by the loudspeaker; calculating a set of left spectral values for each left audio fragment and/or calculating a set of right spectral value for each right audio fragment, each set of spectral values containing at least one spectral value corresponding to one spectral frequency; estimating a momentary orientation of the orientation unit for at least a subset of the left audio fragments and/or right audio fragments.

It is an advantage of this embodiment that the estimation of the orientation of the sound source can be based on spectral data. This is especially useful if the audio test samples have a varying frequency, e.g. if the audio test samples are "chirps".

In an embodiment, the predefined quality criterion is a spatial smoothness criterion of the mapped data.

The inventors surprisingly found that the estimation of the orientation of the sound source relative to the head can be found by searching the direction for which the mapped data is the "smoothest", in contrast to their original expectation that an incorrect estimate of the source direction would result in a mere rotation of the mapped data on the sphere. In contrast, experiments have shown that an incorrect estimate of the source direction results in a severe distortion of the mapped data and of the resulting ITDF and HRTF data. As far as the inventors are aware, this insight is not known in the prior art. In fact, as far as the inventors are aware, there is no prior art where the sound source is located at an unknown position/orientation relative to the subject.

In an embodiment, the predefined quality criterion is based on a deviation or distance between the mapped data and a reference surface, where the reference surface is calculated as a low-pass variant of said mapped data.

It is an advantage of this embodiment that the reference surface used to define "smoothness" can be derived from the mapped data itself, thus for example need not be extracted from a database containing IDTF or HRTF functions using statistical analysis. This simplifies implementation of the algorithm, yet is very flexible and provides highly accurate results.

It is noted that many "smooth" surfaces can be used as reference surface, which offers opportunities to further improve the algorithm, e.g. in terms of computational complexity and/or speed.

In an embodiment, the predefined quality criterion is based on a deviation or distance between the mapped data and a reference surface, where the reference surface is based on an approximation of the mapped data, defined by the weighted sum of a limited number of basis functions.

It is an advantage of using a limited set of basis functions, in particular a set of orthogonal basis functions having an "order" lower than a predefined value (for example a value in the range from 5 to 15), in that they are very suitable for approximating most relatively smooth surfaces, and that they can be calculated in known manners, and can be represented by a relatively small set of parameters.

In an embodiment, the basis functions are spherical harmonic functions.

Although the invention will also work with other functions, spherical harmonic functions are highly convenient basis functions for this application. They offer the same advantages as Fourier Series in other applications.

In an embodiment, real spherical harmonics are used.

In another embodiment, complex spherical harmonics are used.

In an embodiment, the predefined quality criterion is a criterion expressing a degree of the mirror anti-symmetry of the mapped $ITD_i$ data.

With mirror anti-symmetry is meant symmetric except for the sign.

Several general properties of ITDF and/or HRTF can be used to define the quality criterion. The $ITD_i$ will be most cylindrically symmetrical around an axis (in fact the ear-ear axis) in case the correct real direction of the source is assumed. Similarly, the $ITD_i$ will show most mirror symmetry about a plane through the centre of the sphere in case the correct real direction of the source is assumed. In the last case, this allows to determine the direction of the source except for the sign.

In an embodiment, the predefined quality criterion is a criterion expressing a degree of cylindrical symmetry of the mapped $ITD_i$ data.

In an embodiment, the method further comprises: f) estimating model parameters of a mechanical model related to the head movements that were made by the person at the time of capturing the audio samples and the orientation information of step a); g) estimating a plurality of head positions using the mechanical model and the estimated model parameters; and wherein step c) comprises using the estimated head positions of step g).

It is an advantage of using a mechanical model for estimating the position of the center of the head, as opposed to assuming that the head position is fixed. The model allows to better estimate the relative position and/or distance of/between the head and the loudspeaker. This allows to improve the accuracy of the ITDF and HRTF.

In an embodiment, the mechanical model is adapted for modeling at least rotation of the head around a center of the head, and at least one of the following movements: rotation of the person around a stationary vertical axis, when sitting on a rotatable chair; moving of the neck of the person relative to the torso of the person.

It is an advantage of using such a model, especially a model having both features, that it allows to better estimate the relative position of the head versus the loudspeaker, resulting in an improvement of the accuracy of the ITDF and HRTF.

It is an advantage that this model allows the data to be captured in step a) in a much more convenient way for the user, who does not have to try to keep the center of his/her head in a single point in space, without decreasing the accuracy of the ITDF and HRTF.

In an embodiment, step b) comprises: estimating a trajectory of the head movements over a plurality of audio fragments; taking the estimated trajectory into account when estimating the head position and/or head orientation.

In an embodiment, more than one loudspeaker may be used (for example two loudspeakers), located at different directions with respect to the user, in which case more than one acoustic test signal would be used (for example two), and in which case in step c) the direction of the loudspeaker that generated each specific acoustic stimulus, would be estimated.

It is an advantage of using two loudspeakers, for example positioned so as to form an angle of 45° or 90° as seen from the users position (e.g. at any particular moment in time during the data capturing), that it results in improved estimates of the loudspeakers' directions, because there are two points of reference that do not change positions. Also, the user would not have to turn his/her head as far as compared to a setup with only a single loudspeaker, and yet cover a larger part of the sampling sphere.

In particular embodiments, individual acoustic test stimuli may be emitted by the two loudspeakers alternatingly.

In an embodiment, step e) further comprises estimating a combined filter characteristic of the loudspeaker and the microphones, or comprises adjusting the estimated ITDF such that the energy per frequency band corresponds to that of a general ITDF and comprises adjusting the estimated HRTF such that the energy per frequency band corresponds to that of a general HRTF.

It is an advantage of embodiments of the present invention that the algorithm for estimating the ITDF and HRTF does not need to know the spectral filter characteristic of the loudspeaker and of the in-ear microphones beforehand, but that it can estimate the combined spectral filter characteristic of the loudspeaker and the microphone as part of the algorithm, or can compensate such that the resulting ITDF and HRTF have about the same energy density or energy content as the general ITDF and HRTF.

This offers the advantage that the user can (in principle) use any set of (reasonable quality) in-ear microphones and any (reasonable quality) loudspeaker. This offers the advantage that no particular type of loudspeaker and of in-ear microphones needs to be used during the data capturing, and also that a specific calibration step may be omitted. But of course, it is also possible to use a loudspeaker and in-ear microphones with a known spectral filter characteristic, in which case the algorithm may use the known spectral filter characteristic, and the estimation of the combined spectral filter characteristics of the loudspeaker and in-ear microphones can be omitted.

The estimation of a combined spectral filter characteristic of the loudspeaker and the microphones may be based on the assumption or approximation that this combined spectral filter characteristic is a spectral function in only a single parameter, namely frequency, but is independent of orientation. This approximation is valid because of the small size of the in-ear-microphones and the relatively large distance between the person and the loudspeaker, preferably at least 1.5 m, more preferably at least 2.0 m.

In an embodiment, estimating the combined spectral filter characteristic of the loudspeaker and the microphones comprises: making use of a priori information about a spectral filter characteristic of the loudspeaker, and/or making use of a priori information about a spectral filter characteristic of the microphones.

Embodiments of the present invention may make use of statistical information about typical in-ear microphones and about typical loudspeakers. This may for example comprise the use of an "average" spectral filter characteristic and a "covariance"-function, which can be used in the algorithm to calculate a "distance"-measure or deviation measure or a likelihood of candidate functions.

In an embodiment, step b) estimates the orientation of the orientation unit by also taking into account spatial information extracted from the Left and Right audio samples, using at least one transfer function that relates acoustic cues to spatial information, In this embodiment, use is made of at least one transfer function, such as for example an ITDF and/or an HRTF of humans, for example a general ITDF and/or a general HRTF of humans, to enable extraction of spatial information (e.g. orientation information) from the left and right audio samples.

It is an advantage of the algorithm, that taking into account at least one transfer function, allows to extract spatial information from the audio data, which, in combination with the orientation sensor data, enables to better estimate and/or to improve the accuracy of the relative orientation of the head during the data acquisition, without knowledge of the (exact) position/orientation of the orientation unit on the head and without knowledge of the (exact) position of the loudspeaker. This is especially useful when the accuracy of the orientation unit itself is rather low.

It is an advantage of some embodiments of the present invention that it is able to extract spatial information from audio data, necessary to estimate the ITDF and the HRTF, although the exact ITDF and/or HRTF are not yet known, for example by solving the problem iteratively. In a first iteration, a general transfer function may be used to extract spatial information from the audio data. This information may then be used to estimate the HRTF and/or ITDF, which, in a next iteration, can then be used to update the at least one transfer function, ultimately converging to an improved estimate of the ITDF and HRTF.

It is noted that in case more than one loudspeaker is used (for example two loudspeakers) located at different directions as seen from the users position, it is an advantage that the spatial information is extracted from two different sound sources, located at different directions. Generally, the transfer function which relates acoustic cues to spatial information is not spatially homogeneous, i.e., not all spatial directions are equally well represented in terms of acoustic cues, and consequently, sounds coming from some directions are easier to localize based on their acoustic content, than those originating from other directions. By using more than one loudspeaker (for example two), one can cope with these 'blind spots' in the transfer function, because the two loudspeakers sample different directions of the transfer function, and if one loudspeaker produces a sound that is difficult to localize, the sound originating from the other loudspeaker may still contain the necessary directional information to make inferences on the orientation of the head.

In an embodiment, the at least one predefined transfer function that relates acoustic cues to spatial information is a predefined interaural time difference function (ITDF).

It is an advantage of embodiments wherein the transfer function is a predefined ITDF that the orientation of the head with respect to the loudspeaker during the capturing of each data set is calculated solely from an (average or estimated) ITDF, and not of the HRTF.

In an embodiment, the at least one transfer function that relates acoustic cues to spatial information are two transfer functions including a predefined interaural time difference function and a predefined head-related transfer function.

It is an advantage of embodiments wherein the orientation of the head with respect to the loudspeaker during the capturing of each data set is calculated both from an (average or estimate of an) ITDF, and from an (average or estimate of a) HRTF, because this allows an improved estimate of the orientation of the head with respect to the loudspeaker during the data acquisition, which, in turn, enables to improve the estimates of the ITDF and HRTF.

In an embodiment, the method comprises performing steps b) to e) at least twice, wherein step b) of the first iteration does not take into account said spatial information, and wherein step b) of the second and any further iteration takes into account said spatial information, using the interaural time different function and/or the head related transfer function estimated in step e) of the first or further iteration.

It is an advantage of embodiments wherein the orientation of the head with respect to the loudspeaker can be calculated by taking into account an IDTF and HRTF, but not in the first iteration, but as of the second iteration. In this way the use a general ITDF and/or general HRTF can be avoided, if so desired.

In an embodiment, step d) of estimating the ITDF function comprises making use of a priori information about the personalized ITDF based on statistical analysis of a database containing a plurality of ITDFs of different persons.

Embodiments of the present invention may make use of statistical information about typical ITDFs as contained in a database. This may for example comprise the use of an "average" ITDF and a "covariance"-function, which can be used in the algorithm to calculate a "distance"-measure or deviation measure or a likelihood of candidate functions.

It is an advantage of embodiments of the present invention that information from such databases (some of which are publically available) is taken into account, because it increases the accuracy of the estimated individualized ITDF and estimated individualized HRTF.

It is an advantage of particular embodiments of the present invention wherein only a subset of such databases is taken into account, for example, based on age or gender of the particular person.

In an embodiment, step e) of estimating the HRTF comprises making use of a priori information about the personalized HRTF based on statistical analysis of a database containing a plurality of HRTFs of different persons.

The same advantages as mentioned above when using a priori information about the ITDF, also apply for the HRTF.

In an embodiment, the orientation unit comprises at least one orientation sensor adapted for providing orientation information relative to the earth gravity field and at least one orientation sensor adapted for providing orientation information relative to the earth magnetic field.

It is an advantage of embodiments of the present invention that an orientation unit is used which can provide orientation information relative to a coordinate system that is fixed to the earth (also referred to herein as "to the world"), in contrast to a positioning unit requiring a sender unit and a receiver unit, because it requires only a single unit.

In an embodiment, the method further comprises the step of: fixedly mounting the orientation unit to the head of the person.

The method of the present invention takes into account that the relative orientation of the orientation unit and the head is fixed for all audio samples/fragments. No specific orientation is required, any arbitrary orientation is fine, as long as the relative orientation between the head and the orientation unit is constant.

In an embodiment, the orientation unit is comprised in a portable device, and wherein the method further comprises the step of: fixedly mounting the portable device comprising the orientation unit to the head of the person.

In an embodiment, the method further comprises the steps of: rendering the acoustic test signal via the loudspeaker; capturing said left and right audio signals originating from said left and said right in-ear microphone and capturing said orientation information from an orientation unit.

In an embodiment, the orientation unit is comprised in a portable device, the portable device being mountable to the head of the person; and the portable device further comprises a programmable processor and a memory, and interfacing means electrically connected to the left and right in-ear microphone, and means for storing and/or transmitting said captured data sets; and the portable device captures the plurality of left audio samples and right audio samples and orientation information, and the portable device stores the captured data sets on an exchangeable memory and/or transmits the captured data sets to the computing device, and the computing device reads said exchangeable memory or receives the transmitted captured data sets, and performs steps c) to e) while or after reading or receiving the captured data sets.

In such an embodiment the step of the actual data capturing is performed by the portable device, for example by a smartphone equipped with a plug-on device with a stereo audio input or the like, while the processing of the captured data can be performed off-line by another computer, e.g. in the cloud. Since the orientation unit is part of the smartphone itself, no extra cables are needed.

It is an advantage of such embodiment that the cables to the in-ear microphones can be (much) shorter (as compared to cables routed to a nearby computer), resulting in a higher freedom of movement. Moreover, the captured left and right audio signals may have a better SNR because of less movement of the cables and smaller loops formed by the cables, hence less pick-up of unwanted electromagnetic radiation. The portable device may comprise a sufficient amount of memory for storing said audio signals, e.g. may comprise 1 Gbyte of volatile memory (RAM) or non-volatile memory (FLASH), and the portable device may for example comprise a wireless transmitter, e.g. an RF transmitter (e.g. Bluetooth, WiFi, etc), for transmitting the data sets to an external device. Experiments have shown that a RAM size of about 100 to 200 Mbyte may be sufficient.

In such embodiment, the external computer would typically perform all the steps b) to e), except the data capturing step a), and the portable device, e.g. smartphone, would perform the data capturing.

Of course another split of the functionality is also possible, for example the first execution of step c), using an average ITDF and/or average HRTF may also be executed on the smartphone, while the other steps are performed by the computer. In an embodiment, the method further comprises the steps of: inserting the left in-ear microphone in the left ear of the person and inserting the right in-ear microphone in the right ear of said person; the computing device is electrically connected to the left and right in-ear microphone, and is operatively connected to the orientation unit; and the computing device captures the plurality of left audio samples and the right audio samples and retrieves or receives or reads or otherwise obtains the orientation information from said orientation unit directly or indirectly; and wherein the computing device stores said data in a memory.

In such an embodiment, all steps, including the actual data capturing, are performed by the computing device, which may for example be a desktop computer or a laptop computer equipped with a USB-device with a stereo audio input or the like. If an orientation unit of a smartphone is used in this embodiment, the computer would retrieve the orientation information from the smartphone, for example via a cable connection or via a wireless connection, and the only task of the smartphone would be to provide the orientation data.

In an embodiment, the computing device is a portable device that also includes the orientation unit.

In such an embodiment, all of the steps a) to e), including the actual data capturing, are performed on the portable device, for example by the smartphone. It is explicitly pointed out that this is already technically possible with many smartphones anno 2015, although the processing may take a relatively long time (e.g. in the order of 30 minutes for non-optimized code), but it is contemplated that this speed can be further improved in the near future.

In an embodiment, the portable device is a smartphone.

In an embodiment, the portable device further comprises a loudspeaker; and wherein the portable device is further adapted for analyzing the orientation information in order to verify whether a 3D space around the head is sufficiently sampled, according to a predefined criterium; and is further adapted for rendering a first respectively second predefined audio message via the loudspeaker of the portable device depending on the outcome of the analysis whether the 3D space is sufficiently sampled.

The predefined criterium for deciding whether the 3D space is sufficiently sampled can for example be based on a minimum predefined density on a predefined subspace. The subspace may for example be a space defined by a significant portion of a full sphere.

It is an advantage of such embodiment that some form of control and interaction is provided during or shortly after the data capturing, before the actual estimation of the ITDF and HRTF starts. In this way the accuracy of the estimated individualized ITDF and HRTF can be increased, and the risk of misperceptions during rendering of audio data in a 3D-VAS system, due to interpolation of ITDF and HRTF curves in a coarsely sampled 3D-space, may be reduced.

Although the orientation information may have insufficient accuracy for being used directly as direction information from where a sound is coming from when determining the HRTF, the accuracy is typically sufficient to enable verification of whether the 3D space around the person's head is sufficiently sampled. Of course there may be more than two predefined messages. Examples of such messages may for example contain the message that the "testis over", or that the "test needs to be repeated", or that "additional sampling is required when looking at the right and above", or any other message.

In an embodiment, the audio test signal comprises a plurality of acoustic stimuli, wherein each of the acoustic stimuli has a duration in the range from 25 to 50 ms; and/or wherein a time period between subsequent acoustic stimuli is a period in the range from 250 to 500 ms.

In an embodiment, the acoustic stimuli are broadband acoustic stimuli, in particular chirps.

It is noted that in an acoustic test signal with pure tones would probably also work, but it would take much longer to obtain the same IDTF and HRTF quality.

In an embodiment, the acoustic stimuli have an instantaneous frequency that linearly decreases with time.

It is an advantage of using broadband acoustic stimuli signals (rather than pure tone signals), because wide bandwidth signals allow extraction of the spectral information and hence estimation of the HRTF over the complete frequency range of interest for each orientation of the head, and also because the accuracy of the ITD estimation is higher for wide bandwidth signals.

It is an advantage of using test signals with acoustic stimuli having a duration less than 50 ms, because for such a short signal, it can reasonably be assumed that the head is (momentarily) standing still, even though in practice it may be (and typically will be) rotating, assuming that the person is gently turning his/her head at a relatively low angular speed (e.g. at less than 60° per second), and not abruptly.

It is also an advantage that such short duration signals avoid overlap between reception along the direct path and reception of the same signal along an indirect path containing at least one additional reflection on one of the boundaries of the room, or objects present inside the room. Hence, complex echo cancelling techniques can be avoided.

In an embodiment, the method further comprises the step of: selecting, dependent on an analysis of the captured data sets, a predefined audio-message from a group of predefined audio messages, and rendering said selected audio-message via the same loudspeaker as was used for the test-stimuli or via a second loudspeaker different from the first loudspeaker, for providing information or instructions to the person before and/or during and/or after the rendering of the audio test signal.

In an embodiment, the second loudspeaker may for example be the loudspeaker of a portable device.

Such embodiment may for example be useful in a (quasi) real-time processing of step c), whereby (accurate or approximate) position and/or orientation information is extracted from a subset of the captured samples, or ideally in the time between each successive audio samples, and whereby the algorithm further verifies whether the 3-dimensional space around the head is sampled with sufficient density, and whereby corresponding acoustical feedback is given to the user, after, or even before the acoustic test file is finished.

But other messages could of course also be given, for example a textual instruction for the user to keep his/her head still for over a certain number of acoustic stimuli (for example five or ten) for allowing averaging of the audio samples collected for that particular orientation, so that a higher signal to noise ratio (SNR) can be achieved.

Of course, the same functionality can also be provided by a non-real-time application, wherein for example the acoustic test signal is rendered a first time, and a first plurality of data sets is captured, which first plurality of data samples is then processed in step c), and whereby step c) further comprises a verification of whether the space around the head is sampled with sufficient density, and whereby a corresponding acoustic message is given to the user via the second loudspeaker, for example to inform him/her that the capturing is sufficient, or asking him/her to repeat the measurement, optionally thereby giving further instructions to orient the head in certain directions.

In this way the actual step of data capturing can be made quite interactive between the computer and the person, with the technical effect that the HRTF is estimated with at least a predefined density.

In this way the risk of insufficient spatial sampling, and hence the risk of having to interpolate between two or more ITDF curves, respectively HRTF curves for a direction that was not spatially sampled sufficiently dense, can be (further) reduced.

In a second aspect, the present invention relates to a method of rendering a virtual audio signal for a particular person, comprising: x) estimating an individualized head-related transfer function and an individualized interaural time difference function of said particular person using a method according to any of the previous claims; y) generating a virtual audio signal for the particular person, by making use of the individualized head-related transfer function and the individualized interaural time difference function estimated in step x); z) rendering the virtual audio signal generated in step y) using a stereo headphone and/or a set of in-ear loudspeakers.

In a third aspect, the present invention relates to a computer program product for estimating an individualized head-related transfer function and an interaural time difference function of a particular person, which computer program product, when being executed on at least one computing device comprising a programmable processor and a memory, is programmed for performing at least steps c) to e) of a method according to the first aspect or the second aspect.

The computer program product may comprise a software module executable on a first computer, e.g. a laptop or desktop computer, the first module being adapted for performing step a) related to capturing and storing the audio and orientation data, optionally including storing the data in a memory, and to steps c) to e) related to estimating or calculating a personalized IDTF and HRTF, when the first computer is suitably connected to the in-ear microphones (e.g. via electrical wires) and operatively connected (e.g. via Bluetooth) to the orientation unit.

The computer program product may comprise two software modules, one executable on a portable device comprising an orientation module, such as for example a smartphone, and a second module executable on a second computer, e.g. a laptop or desktop computer, the first module being adapted for performing at least step a) related to data capturing, preferably also including storing the data in a memory, the second module being adapted for performing at least the steps c) to e) related to estimating or calculating a personalized IDTF and HRTF. During the data capturing the portable device is suitably connected to the in-ear microphones (e.g. via electrical wires).

The computer program product may comprise further software modules for transferring the captured data from the portable device to the computer, for example via a wired or wireless connection (e.g. via Bluetooth or Wifi). Alternatively the data may be transferred from the portable device to the computer via a memory card or the like. Of course a mix of transfer mechanisms is also possible.

In a fourth aspect, the present invention relates to a data carrier comprising the computer program product according to the third aspect.

In an embodiment, the data carrier further comprising a digital representation of said acoustic test signal.

In a fifth aspect, the present invention also relates to the transmission of a computer program product according to the third aspect.

The transmission may also include the transmission of the computer program product in combination with a digital representation of said acoustic test signal.

In a sixth aspect, the present invention also relates to a kit of parts, comprising: a data carrier according to the fourth aspect, and a left in-ear microphone and a right in-ear microphone.

It is an advantage of such a kit of parts that it provides all the hardware a typical end user needs (on top of the computer and/or smartphone and audio equipment which he/she already has), to estimate his/her individualized ITDF and individualized HRTF. This kit of parts may be provided as a stand-alone package, or together with for example a 3D-game, or other software package. The acoustic test signal may for example be downloaded from a particular website on the internet, and burned on an audio-CD disk, or written on a memory-stick, or obtained in another way.

In an embodiment, the kit of parts further comprises: a second data carrier comprising a digital representation of said acoustic test signal.

The second data carrier may for example be an audio-CD disk playable on a standard stereo-set, or a DVD-disk playable on a DVD player or home theater device.

These and other aspects of the invention will be apparent from and elucidated with reference to the embodiment(s) described hereinafter.

BRIEF DESCRIPTION OF THE DRAWINGS

FIG. 18 illustrates capturing of the orientation information from an orientation unit fixedly mounted to the head.

FIG. 18(*a*) to FIG. 18(*d*) show an example of sensor data as can be obtained from an orientation unit fixedly mounted to a head.

FIG. 18(*e*) shows a robotic test platform as was used during evaluation.

FIG. 22(*a*) shows the spectrogram of an audio signal captured by the left in-ear microphone, for an audio test signal comprising four consecutive chirps, each having a duration of about 25 ms with inter-chirp interval of 275 ms.

FIG. 22(*b*) shows the 'rectified' spectrogram, i.e. when compensated for the known frequency-dependent timing delays in the chirps.

FIG. 22(*c*) shows the summed intensity of the 'rectified' spectrogram of an audio signal captured by the left in-ear microphone, based on which the arrival times of the chirps can be determined.

(FIG. 23*a*: left ear spectra) and extracted from the right audio signal (FIG. 23*b*: right ear spectra), and the interaural time difference (FIG. 23*c*) for an exemplary audio test-signal comprising four thousand chirps.

FIG. 25(*b*) shows a mapping of the ITD data of the four thousand chirps of FIG. 23 onto a spherical surface, using the correct source direction, resulting in a function with a high degree of regularities or high smoothness.

FIG. 25(*a,b*) show the detrimental effect of a wrongly assumed source direction on the smoothness of the projected surface of ITD-measurements.

FIG. 25(*c,d*) show the same effect for spectral data.

FIG. 26(*b*) shows a technique to quantify smoothness of a function defined on the sphere, e.g. ITDF, which can be used as a smoothness metric.

FIG. 35 shows a comparison of two HRTFs of the same person: one was measured in a professional facility (in Aachen), the other HRTF was obtained using a method according to the present invention, measured at home. As can be seen, there is very good correspondence between the graphical representation of the HRTF measured in the professional facility and the HRTF measured at home.

Figure 1:
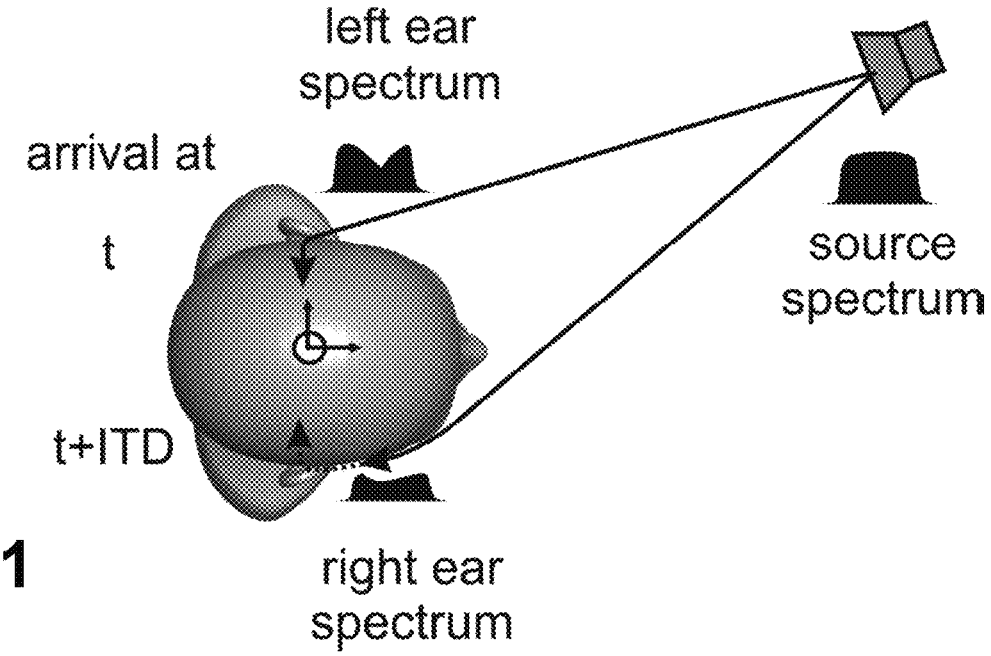
FIG. 1 illustrates how sound from a particular direction arrives at different times at the left and right ear of a person, and how a different spectral filtering is imposed by both ears.

The drawings are only schematic and are non-limiting. In the drawings, the size of some of the elements may be exaggerated and not drawn on scale for illustrative purposes.

Any reference signs in the claims shall not be construed as limiting the scope.

In the different drawings, the same reference signs refer to the same or analogous elements.

DETAILED DESCRIPTION OF ILLUSTRATIVE EMBODIMENTS

The present invention will be described with respect to particular embodiments and with reference to certain drawings but the invention is not limited thereto but only by the claims. The drawings described are only schematic and are non-limiting. In the drawings, the size of some of the elements may be exaggerated and not drawn to scale for illustrative purposes. The dimensions and the relative dimensions do not correspond to actual reductions to practice of the invention.

Furthermore, the terms first, second and the like in the description and in the claims, are used for distinguishing between similar elements and not necessarily for describing a sequence, either temporally, spatially, in ranking or in any other manner. It is to be understood that the terms so used are interchangeable under appropriate circumstances and that the embodiments of the invention described herein are capable of operation in other sequences than described or illustrated herein.

Moreover, the terms top, under and the like in the description and the claims are used for descriptive purposes and not necessarily for describing relative positions. It is to be understood that the terms so used are interchangeable under appropriate circumstances and that the embodiments of the invention described herein are capable of operation in other orientations than described or illustrated herein.

It is to be noticed that the term "comprising", used in the claims, should not be interpreted as being restricted to the means listed thereafter; it does not exclude other elements or steps. It is thus to be interpreted as specifying the presence of the stated features, integers, steps or components as referred to, but does not preclude the presence or addition of one or more other features, integers, steps or components, or groups thereof. Thus, the scope of the expression "a device comprising means A and B" should not be limited to devices consisting only of components A and B. It means that with respect to the present invention, the only relevant components of the device are A and B.

Reference throughout this specification to "one embodiment" or "an embodiment" means that a particular feature, structure or characteristic described in connection with the embodiment is included in at least one embodiment of the present invention. Thus, appearances of the phrases "in one embodiment" or "in an embodiment" in various places throughout this specification are not necessarily all referring to the same embodiment, but may. Furthermore, the particular features, structures or characteristics may be combined in any suitable manner, as would be apparent to one of ordinary skill in the art from this disclosure, in one or more embodiments.

Similarly it should be appreciated that in the description of exemplary embodiments of the invention, various features of the invention are sometimes grouped together in a single embodiment, figure, or description thereof for the purpose of streamlining the disclosure and aiding in the understanding of one or more of the various inventive aspects. This method of disclosure, however, is not to be interpreted as reflecting an intention that the claimed invention requires more features than are expressly recited in each claim. Rather, as the following claims reflect, inventive aspects lie in less than all features of a single foregoing disclosed embodiment. Thus, the claims following the detailed description are hereby expressly incorporated into this detailed description, with each claim standing on its own as a separate embodiment of this invention.

Furthermore, while some embodiments described herein include some but not other features included in other embodiments, combinations of features of different embodiments are meant to be within the scope of the invention, and form different embodiments, as would be understood by those in the art. For example, in the following claims, any of the claimed embodiments can be used in any combination.

In the description provided herein, numerous specific details are set forth. However, it is understood that embodiments of the invention may be practiced without these specific details. In other instances, well-known methods, structures and techniques have not been shown in detail in order not to obscure an understanding of this description.

Figure 3:
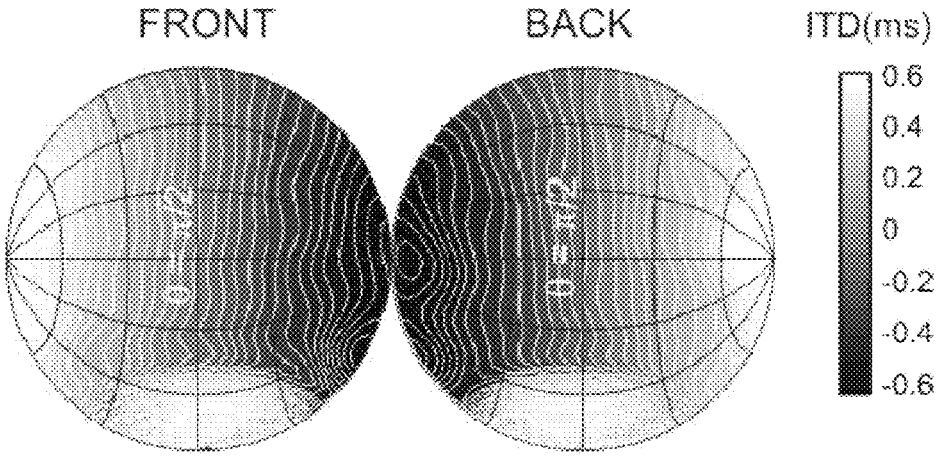
FIG. 3 shows an example of an interaural time difference function (ITDF) of a particular person, whereby different intensity (grayscale) is used to indicate different values of the interaural time difference (ITD), depending on the direction from where sound is coming. Iso-ITD contours are shown in white curved lines.

In the context of the present invention, with "interaural time difference" or "ITD" is meant a time difference, which can be represented by a value (e.g. in milliseconds), but this value is different depending on the direction where the sound is coming from (relative to the head). The representation of ITD values for different directions is referred to herein as the "interaural time difference function" or "ITDF", and an example of such a function is shown in FIG. 3.

Figure 4:
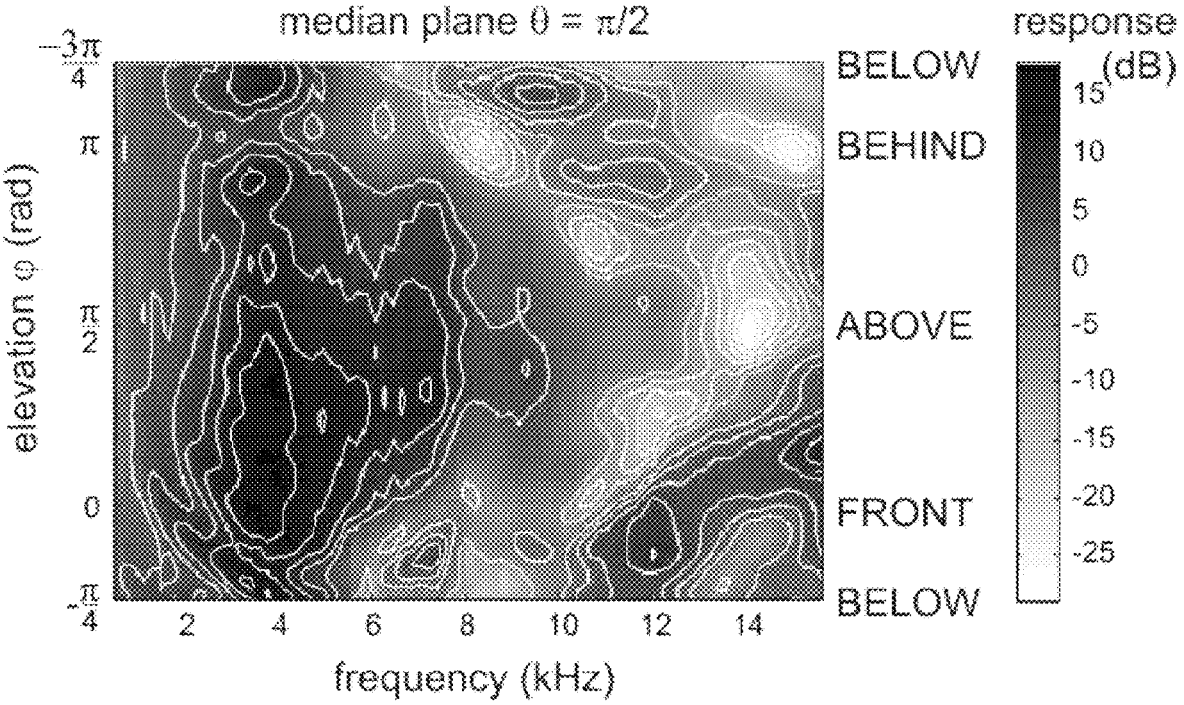
FIG. 4 shows an example of a monaural (left ear) head-related transfer function (HRTF) of a particular person along the median plane, whereby different intensity (grayscale) is used to indicate different values. Iso-response contours are shown in white curved lines.

In the context of the present invention, with "head-related transfer function" or "HRTF" is meant the ensemble of binaural spectral functions (as shown in FIG. 4 for the left ear only, for the median plane), each spectral function S(f) (the values corresponding with each horizontal line in FIG. 4) representing the spectral filtering characteristics imposed by the body, the head, and the left/right ear on sound coming from a particular direction (relative to the head).

Where in the present invention reference is made to "world reference frame", what is meant is a 3D reference frame fixed to the world (or "earth") at the mean value of the center of the subject's head, which can be defined by choosing a Z-axis along the gravitation axis pointing away from the center of the earth, a X-axis lying in the horizontal plane and pointing in the direction of magnetic north and a Y-axis that also lies in the horizontal plane and forms a right handed orthogonal 3D coordinate system with the other two axes.

Where in the present invention reference is made to "position of an object", what is meant is a particular location in a 3D-space, as can for example be indicated by specific X,Y,Z coordinates with respect to the world frame of reference, but other coordinates may also be used.

Where in the present invention reference is made to "orientation of an object", what is meant is the orientation of a 3D reference frame fixed to the object which orientation can be expressed for example by 3 Euler angles with respect to the world frame of reference, but other coordinates may also be used.

Where in the present invention reference is made to "direction of the sound source with respect to the head", what is meant is a particular direction with respect to the head reference frame as used in standard HRTF and ITDF measurements. This direction is typically expressed by two angles: a lateral angle $\theta$ and an elevation angle $\varphi$ as shown for example in FIG. 2, whereby the lateral angle $\theta$ is a value in the range of 0 to $\pi$, and the elevation angle $\varphi$ is a value in the range from $-\pi$ to $+\pi$.

When reference is made to "direction up to sign" this refers to both the direction characterized by the two angles $(\theta,\varphi)$ and the direction characterized by the two angles $(\pi-\theta, \pi+\varphi))$.

Where in the present invention reference is made to "direction of the sound source with respect to the world", what is meant is a particular direction with respect to the world reference frame.

In the present invention reference is made to the "orientation sensor" or "orientation unit" instead of a (6D) position sensor, because we are mainly interested in the orientation of the head, and the (X, Y, Z) position information is not required to estimate the HRTF and ITDF. Nevertheless, if available, the (X,Y,Z) position information may also be used by the algorithm to estimate the position of the center of the head defined as the point halfway between the left and the right ear positions.

In this document, the terms "average HRTF" and "generalized HRTF" are used as synonyms, and refer to a kind of averaged or common HRTF of a group of persons.

In this document, the terms "average ITDF" and "generalized ITDF" are used as synonyms, and refer to a kind of averaged or common ITDF of a group of persons.

In this document, the terms "personalized HRTF" and "individualized HRTF" are used as synonyms, and refer to the HRTF of a particular person.

Figure 2:
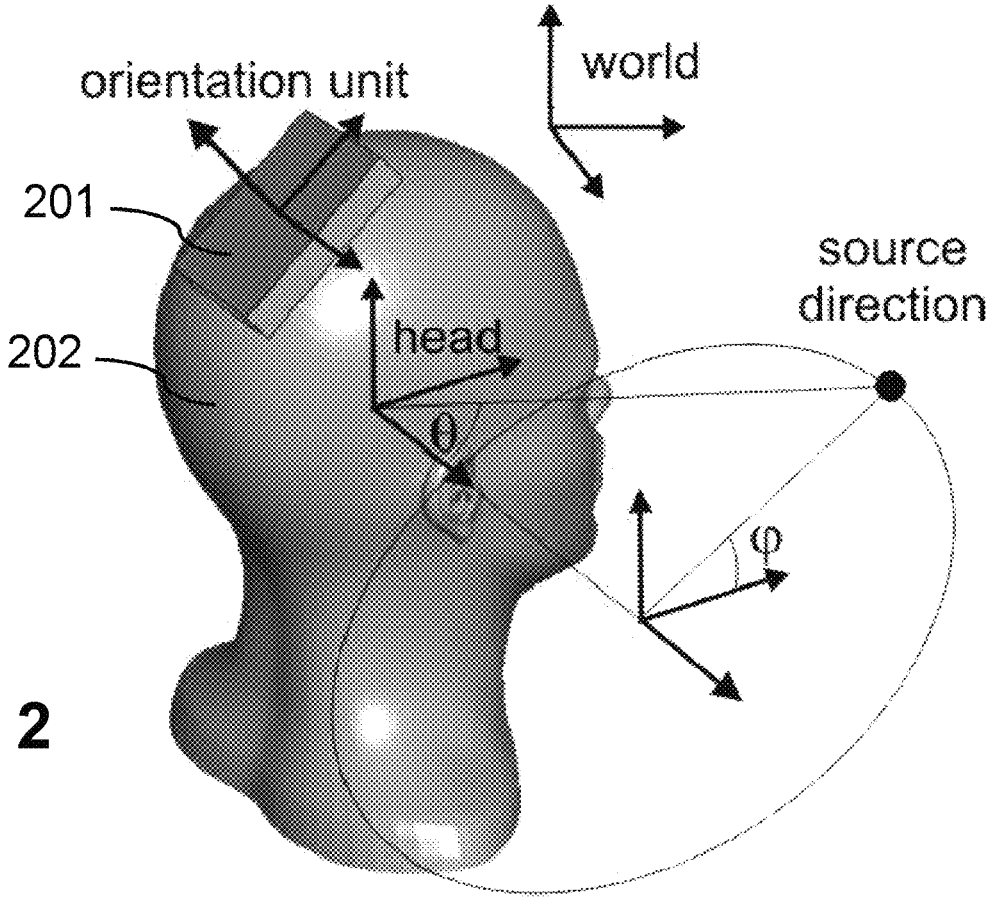
FIG. 2 is a schematic representation of different frames of reference as may be used in embodiments of the present invention: a reference frame fixed to the orientation unit mounted on or to the head, a world reference frame, which is any frame fixed to the world (or "earth") as used by the orientation unit, and a reference frame fixed to the head, which is defined as the "head reference frame" used in standard HRTF and ITDF measurements (see also FIG. 3 and FIG. 4). The "source directions relative to the head" (i.e. the direction of the one or more loudspeakers relative to the head reference frame fixed at a point halfway between the two ears) is defined by a lateral angle θ and an elevation φ. The lateral angle is the angle between the "source direction" and the ear-ear axis, and the elevation is the angle between the "source direction" and the nose-ear-ear plane. The source direction is the virtual line from the loudspeaker to the average position of the center of the head during the test.

In this document, the terms "personalized ITDF" and "individualized ITDF" are used as synonyms, and refer to the ITDF of a particular person.

Where in the present invention the expression "the source direction relative to the head" is used, what is meant is actually the momentary source direction relative to "the reference frame of the head" as shown in FIG. 2, at a particular moment in time, e.g. when capturing a particular left and right audio fragment. Since the person is moving his/her head, the source direction will change during the test, even though the source remains stationary.

In this document the terms "orientation information" and "orientation data" are sometimes used as synonyms, or sometimes a distinction is made between the "raw data" obtainable from an orientation sensor, e.g. a gyroscope, and the converted data, e.g. angles θ and ϕ, in which case the raw data is referred to as orientation information, and the processed data In this document, the abbreviation "re. world" means "relative to the world", which is equivalent to "in world coordinates" also abbreviated as "in w.c."

Where in the present invention, the term "estimate(d)" is used, this should be interpreted broadly. Depending on the context, it can mean for example "measure", or "measure and correct" or "measure and calculate" or "calculate" or "approximate", etc.

In this document the terms "binaural audio data" can refer to the "left and right audio samples" if individual samples are meant, or to "left and right audio fragments" if a sequence of left respectively right samples is meant, corresponding to a chirp.

In this document, the term "source" and "loudspeaker" are used as synonyms, unless explicitly stated otherwise.

Unless explicitly mentioned otherwise, "mechanical model" or "kinematic model" are used as synonyms.

The inventors were confronted with the problem of finding a way to personalize the HRTF and ITDF in a simple way (for the user), and at a reduced cost (for the user).

The proposed method tries to combine two (contradictory) requirements:

(1) the need for a sufficient collection of informative data so that the ITDF and HRTF can be sufficiently accurately estimated (or in other words: so that the true ITDF and HRTF of each individual can be sufficiently accurately approximated), and (2) the limitation that the procedure (or more precisely: the part where the data is captured) can be performed at home and is not too difficult for an average user.

The inventors came up with a method that has two major steps:

1) a first step of data capturing, which is simple to perform, and uses hardware which is commonly available at home: a sound reproducing device (e.g. any mono or stereo chain or MP3-player or the like, connectable to a loudspeaker) and an orientation sensor (as is nowadays available for example in smartphones). The user only needs to buy a set of in-ear microphones, 2) a second step of data processing, which can be performed for example on the same smartphone, or on another computing device such as a desktop computer or a laptop computer, or even in the cloud. In the second step an algorithm is executed that is tuned to the particulars of the data capturing step, and which takes into account that the spectral characteristics of the loudspeaker and of the microphones may not be known, and that the position of the person relative to the loudspeaker may not be known, and that the position/orientation of the orientation unit on the person's head may not be known (exactly) and optionally also that the accuracy of the orientation data provided by the orientation unit may not be very accurate (for example has a tolerance of +/−5°).

The ITDF and HRTF resulting from this compromise may not be perfect, but are sufficiently accurate for allowing the user to (approximately) locate a sound source in 3D-space, in particular in terms of discerning front from back, thus creating a spatial sensation with an added value to the user. Furthermore, the end-user is mainly confronted with the advantages of the first step (of data capturing), and is not confronted with the complexity of the data processing step.

In the rest of this document, first a prior art solution will be discussed with reference to FIG. 5. Then the data capturing step of the present invention will be explained in more detail with reference to FIG. 6 to FIG. 8. Finally the data processing step of the present invention will be explained in more detail with reference to FIG. 9 to FIG. 29.

Reference is also made to a co-pending international application PCT/EP2016/053020 from the same inventors, further referred to herein as "the previous application", which not yet published, hence prior art under Art 54(3) in Europe, which has some communalities with the present invention, but also important differences, as will be explained further.

I. Known Solution

Figure 5:
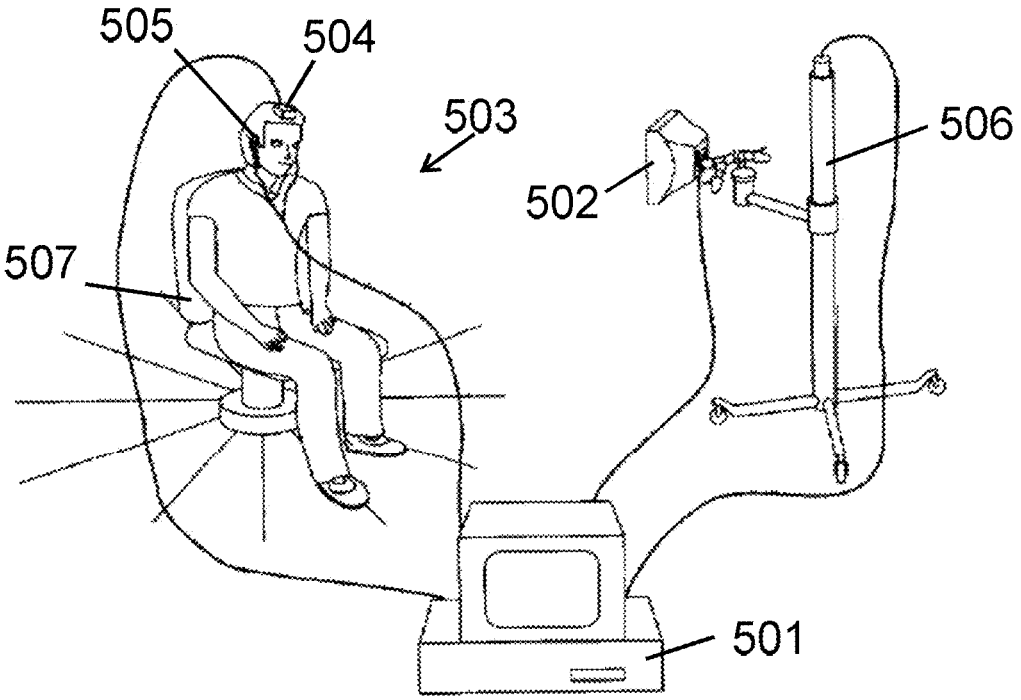
FIG 5 (prior art)
FIG. 5 shows an arrangement for measuring a HRTF outside of an anechoic chamber, known in the prior art.

FIG. 5 is a copy of FIG. 1 of U.S. Pat. No. 5,729,612A, and illustrates an embodiment of a known test-setup, outside of an anechoic room, whereby a person 503 is sitting on a chair, at a known distance from a loudspeaker 502, which is mounted on a special support 506 for allowing the loudspeaker to be moved in height direction. A left and right audio signal is captured by two in-ear microphones 505 worn by the person. Head movements of the person are tracked by a position sensor 504 mounted on top of the head of the person who is sitting on a chair 507 which can be oriented in particular directions (as indicated by lines on the floor). The microphones 505 and the position sensor 504 are electrically connected to a computer 501 via cables. The computer 501 sends an acoustic test signal to the loudspeaker 502, and controls the vertical position of the loudspeaker 502 using the special support 506.

The data will be processed in the computer 501, but the document is silent about how exactly the ITDF and HRTF are calculated from the measured audio signals and position signals. The document does mention a calibration step to determine a transfer characteristic of the loudspeaker 502 and microphones 505, and the method also relies heavily on the fact that the relative position of the person 503 and the loudspeaker 502 are exactly known.

Figure 6:
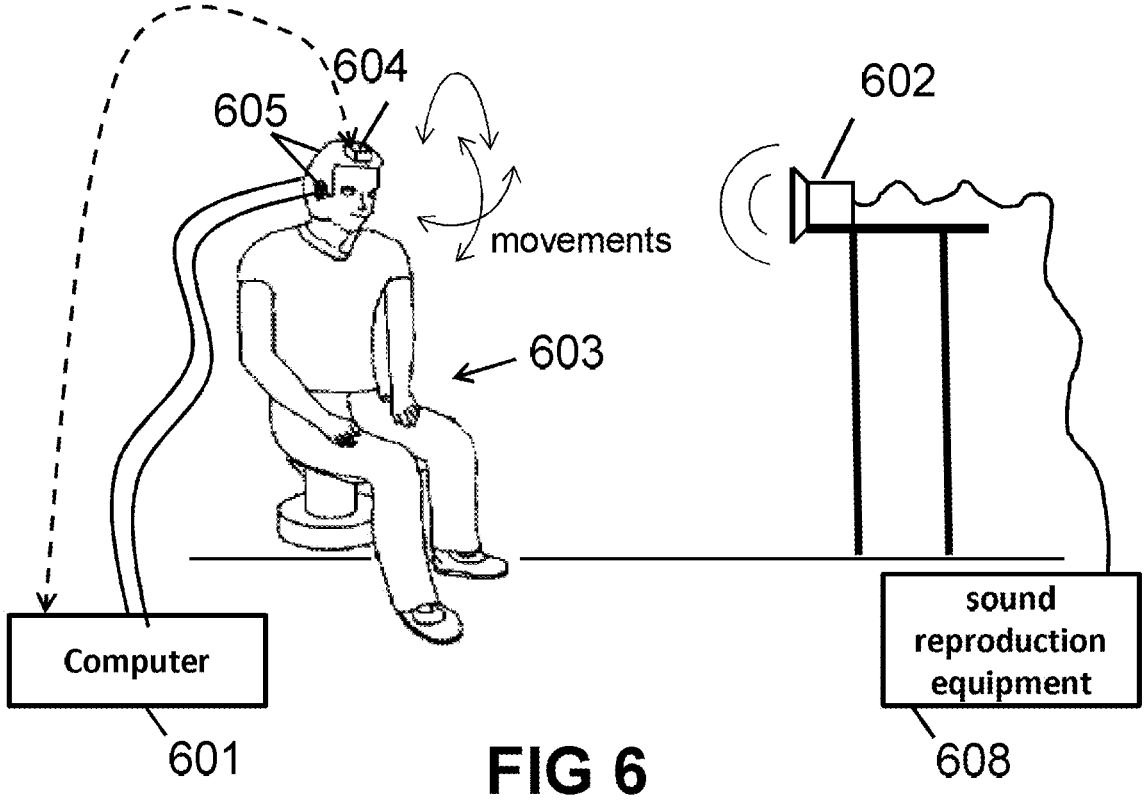
FIG. 6 shows a first example of a possible hardware configuration for performing one or more steps of a method according to the present invention, whereby data capturing is performed by a computer electrically connected to in-ear microphones, and whereby orientation data is obtained from a sensor unit present in a smartphone fixedly mounted in an arbitrary position on or to the head of the person.
Figure 7:
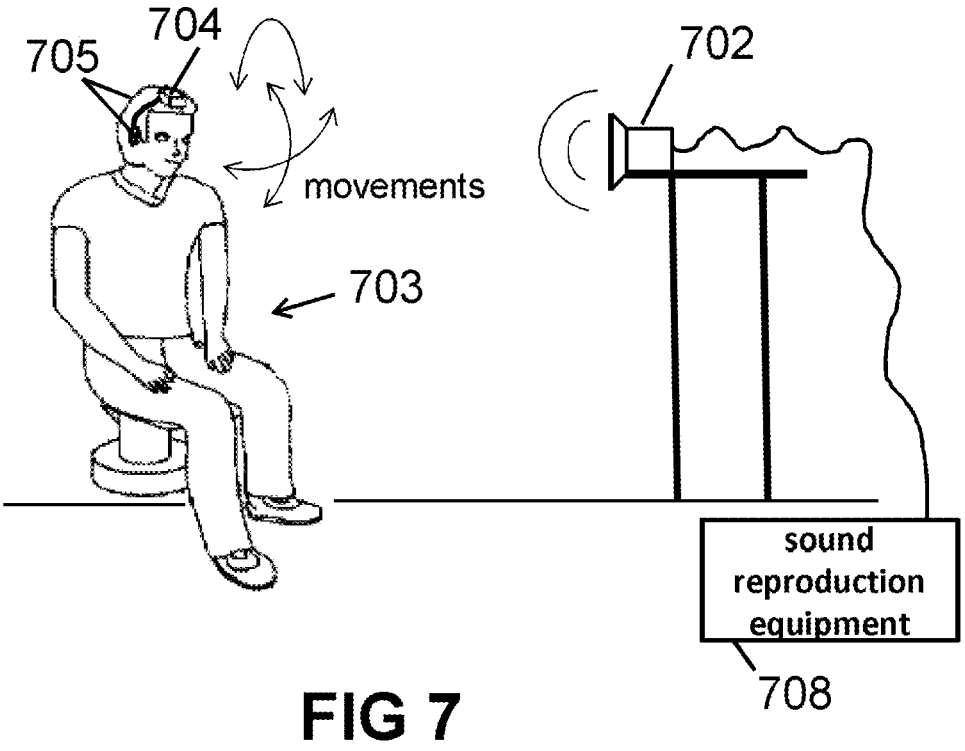
FIG. 7 shows a second example of a possible hardware configuration for performing one or more steps of a method according to the present invention, whereby data capturing is performed by a smartphone electrically connected to in-ear microphones, and whereby orientation data is obtained from a sensor unit present in the smartphone, and whereby the data processing is also performed by the smartphone.
Figure 8:
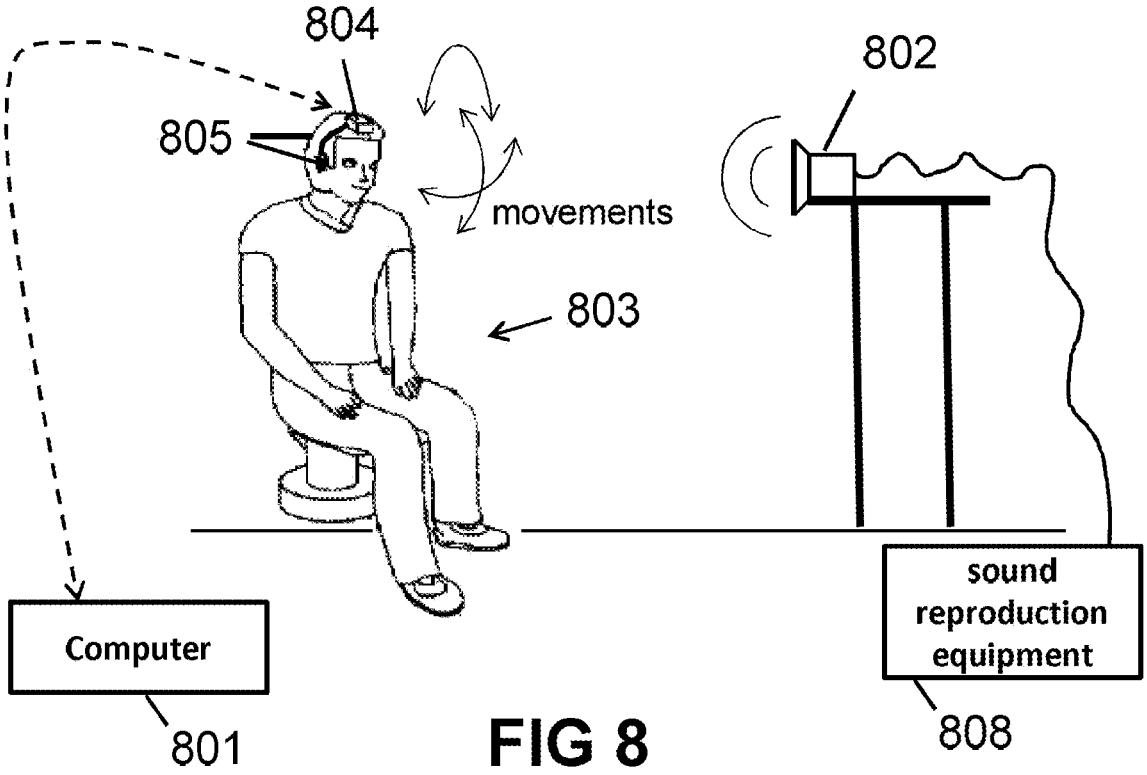
FIG. 8 shows a third example of a possible hardware configuration for performing one or more steps of a method according to the present invention, whereby data capturing is performed by a smartphone electrically connected to in-ear microphones, and whereby orientation data is obtained from a sensor unit present in the smartphone, and whereby the data processing is off-loaded to a computer or to "the cloud".

II. Data Capturing:

FIG. 6 to FIG. 8 show three examples of possible test-arrangements which can be used for capturing data according to the present invention, the present invention not being limited thereto.

In the configurations shown, a sound source 602, 702, 802, for example a loudspeaker is positioned at an unknown distance from the person 604, 704, 804, but approximately at the same height as the person's head. The loudspeaker may for example be placed on the edge of a table, and need not be moved. The person 603, 703, 803 can sit on a chair or the like. The chair may be a rotatable chair, but that is not absolutely required, and no indications need to be made on the floor, and the user is not required to orient himself/herself in particular directions according to the lines on the floor.

The person is wearing a left in-ear microphone in his/her left ear, and a right in-ear microphone in his/her right ear. An orientation unit 604, 704, 804 is fixedly mounted to the head of the person, preferably on top of the person's head, or on the back of the person's head, for example by means of a head strap (not shown) or belt or stretchable means or elastic means. The orientation unit 604, 704, 804 can be positioned in any arbitrary orientation relative to the head. The orientation unit may for example comprise an accelerometer and/or a gyroscope and/or a magnetometer, and preferably all of these, but any other suitable orientation sensor can also be used. In preferred embodiments, the orientation unit allows to determine the momentary orientation of the orientation unit relative to the earth gravitational field and earth magnetic field, and thus does not require a transmitter located for example in the vicinity of the loudspeaker. The orientation unit may be comprised in a portable device, such as for example a smartphone. It is a major advantage of embodiments of the present invention that the position and orientation of the orientation unit with respect to the head need not be known exactly, and that the orientation sensor need not be very accurate (for example a tolerance of +/−10° for individual may well be acceptable), as will be explained further.

During the data capturing step, an acoustic test signal, for example a prerecorded audio file present on a CD-audio-disk, is played on a sound reproduction equipment 608, 708, 808 and rendered via the (single) loudspeaker 602, 702, 802. Alternatively two or even more loudspeakers may be used. The acoustic test signal comprises a plurality of acoustic stimuli for example chirps having a predefined duration and predefined spectral content. In the context of this invention, for ease of explanation, the terms "chirp" and "stimulus" are used interchangeably and both refer to the acoustic stimulus. Preferably acoustic stimuli of a relatively short duration (e.g. in the range from 25 ms to 50 ms) and with a broadband spectrum (e.g. in the range from 1 kHz to 20 kHz) are used, but the invention is not limited thereto, and other signals, for example short pure tones may also be used.

While the acoustic test signal is being rendered via the loudspeaker, the person needs to turn his/her head gently in a plurality of different orientations (see FIG. 2).

The acoustic stimuli of interest, e.g. chirps are captured or recorded via the left and right in-ear microphones 605, 705, 805, and for each recorded stimulus, orientation data of the orientation unit, also indicative for the orientation of the head at the moment of the stimulus arriving at the ears (although this orientation is not known yet, because the orientation unit can be mounted at any arbitrary position and in any arbitrary orientation relative to the head), is also captured and/or recorded.

In the configuration of FIG. 6, the in-ear microphones 605 are electrically connected (via relatively long cables) to the computer 601 which captures the left and right audio data, and which also retrieves orientation information from the orientation sensor unit 604 (wired or wireless). The computer 601 can then store the captured information as data sets, each data set comprising a left audio sample (Li) originating from the left in-ear microphone and a right audio sample (Ri) originating from the right in-ear microphone and orientation information (Oi) originating from the orientation unit. It is noted that the audio is typically sampled at a frequency of at least 40 kHz, for example at about 44.1 kHz or at 48 kHz, but other frequencies may also be used. The data sets may be stored in any suitable manner, for example in an interleaved manner in a single file, or as separate files.

A disadvantage of the configuration of FIG. 6 is that the in-ear microphones and possibly also the orientation sensor, are connected to the computer 601 via relative long cables, which may hinder the movements of the person 603.

The orientation unit 604 may be comprised in a portable device such as for example a smartphone, or a remote controller of a game console, which may comprise a programmable processor configured with a computer program for reading orientation data from the one or more orientation sensors, and for transmitting that orientation data to the computer 601, which would be adapted with a computer program for receiving said orientation data. The orientation data can for example be transmitted via a wire or wireless (indicated by dotted line in FIG. 6). In the latter case a wire between the computer 601 and the sensor unit 604 can be omitted, which is more convenient for the user 603.

In a variant of this method, the orientation data is stored on an exchangeable memory, for example on a flash card during the data capturing, for example along with time-stamps, which flash-card can later be inserted in the computer 601 for processing.

The setup of FIG. 7 can be seen as a variant of the setup of FIG. 6, whereby the orientation unit 704 is part of a portable device, e.g. a smartphone, which has a programmable processor and memory, and which is further equipped with means, for example an add-on device which can be plugged in an external interface, and which has one or two input connectors for connection with the left and right in-ear microphones 705 for capturing audio samples arriving at the left and right ear, called left and right audio samples. Since the orientation sensor unit 704 is embedded, the processor can read or retrieve orientation data from the sensor 704, and store the captured left and right audio samples, and the corresponding, e.g. simultaneously captured orientation information as a plurality of data sets in the memory.

A further advantage of the embodiment of FIG. 7, is that the cables between the portable device and the in-ear microphones 705 can be much shorter, which is much more comfortable and convenient for the user 703, and allows more freedom of movement. The audio signals so captured typically also contain less noise, hence the SNR (signal to noise ratio) can be increased in this manner, resulting ultimately in a higher accuracy of the estimated ITDF and HRTF.

If the second step, namely the data processing is also performed by the portable device, e.g. the smartphone, then only a single software program product needs to be loaded on the smartphone, and no external computer is required.

FIG. 8 is a variant of the latter embodiment described in relation to FIG. 7, whereby the second step, namely the data processing of the captured data, is performed by an external computer 801, but the first step of data capturing is still performed by the portable device. The captured data may be transmitted from the portable device to the computer, for example via a wire or wireless, or in any other manner. For example, the portable device may store the captured data on an non-volatile memory card or the like, and the user can remove the memory card from the portable device after the capturing is finished, and insert it in a corresponding slot of the computer 801. The latter two examples both offer the advantage that the user 803 has much freedom to move, and is not hindered by cables. The wireless variant has the additional advantage that no memory card needs to be exchanged. In all embodiments of FIG. 8, a first software module is required for the portable device to capture the data, and to store or transmit the captured data, and a second module is required for the computer 801 to obtain, e.g. receive or retrieve or read the captured data, and to process the captured data in order to estimate a personalized ITDF and a personalized HRTF.

The following sections A to G are applicable to all the hardware arrangements for capturing the data sets comprising left audio, right audio and orientation information, in particular, but not limited to the arrangements shown in FIG. 6 to FIG. 8, unless specifically stated otherwise.

In these sections, reference will be made to "chirps" as an example of the audio stimuli of interest, for ease of explanation, but the invention is not limited thereto, and other signals, for example short pure tones may also be used, as described above.

In these sections, reference will be made to "smartphone" as an example of a portable device wherein the orientation sensor unit is embedded, but the invention is not limited thereto, and in some embodiments (such as shown in FIG. 6), a stand-alone orientation sensor unit 604 may also work, while in other embodiments (such as shown in FIG. 8) the portable device needs to have at least audio capturing means and memory, while in yet other embodiments (such as shown in FIG. 7) the portable device further needs to have processing means.

A. Simultaneous Capturing of Audio and Orientation

It is important that the left and right audio samples, i.e. the recorded stimuli, and the orientation information are corresponding. Ideally, the left and right audio signals are "simultaneously sampled" (within the tolerance margin of a clock signal), but there is some tolerance of when exactly the orientation data is measured. What is important for the present invention is that the orientation data obtained from the orientation unit is representative for the 3D orientation of the orientation unit, and indirectly also for the 3D-orientation of the head (if the relative orientation of the orientation unit and the head would be known) at about the same moment as when the audio samples are captured. As an example, assuming that the head is being turned gently during the capturing step, (for example at an angular speed of less than 60° per second), and that the acoustic stimuli have a relatively short duration (for example about 25 ms), it does not really matter whether the orientation data is retrieved from the sensor at the start or at the end of the acoustic stimulus, or during the stimulus, as it would result in an angular orientation error of less than 60°/40, which is about 1.5°, which is well acceptable.

B. The Hardware Setup

During the data capturing, a distance between the loudspeaker 602, 702, 802 and the person 603, 703, 803 is preferably a distance in the range of 1.0 to 2.0 m, e.g. in the range of 1.3 to 1.7 m, e.g. about 1.5 m, but the exact distance need not be known. The loudspeaker should be positioned approximately at about half the height of the room. The head of the person should be positioned at approximately the same height as the loudspeaker. The loudspeaker is directed to the head. Assuming a head width of approx. 20 cm, a source positioned at 1.5 m distance, the ears would be arctan(0.1/1.5)rad=3.8° off-axis.

Assuming that the person's head is mostly rotated (about a center point of the head) and not or only minimally displaced, the main lobe is broad enough to contain the head fully at the frequencies of interest, for the intensity difference to be limited. But methods of the present invention will also work very well if the center of the head is not kept in exactly the same position, as will be explained further (see FIG. 27).

In the examples described below, use is made of a single loudspeaker, but of course the invention is not limited thereto, and multiple loudspeakers positioned at different points in space, may also be used. For example, the sound reproduction system may be a stereo system, sending acoustic stimuli alternatingly to the left and right speaker.

C. POSSIBLE PROCEDURE FOR THE END-USER

The procedure is preferably executed in a relatively quiet room (or space). The person may be provided with an audio-CD containing an acoustic test signal as well as written or auditory instructions. The user may perform one or more of the following steps, in the order mentioned, or in any other order:

1. Placing the loudspeaker on an edge of a table (but other suitable places could also be used). Configuring the sound-reproduction device (e.g. stereo-chain) so that only one of the loudspeakers is producing sound, (or both are producing sound, but not at the same time), 2. Listening to the instructions on the audio-CD, which may e.g. comprise instructions of how often and/or how fast and/or when the user has to change his/her head orientation, 3. Plug the left in-ear microphone in the left ear, and the right in-ear microphone in the right ear, and connect the microphones to the smartphone (in FIG. 6: to the external computer 601), 4. Download a suitable software application (typically referred to as "app") on the smartphone, and run the app, (this step is not applicable to FIG. 6)

5. Place the smartphone (or sensor in FIG. 6) on top of the head, and fix its position e.g. using the specially designed head strap or another fastening means, for allowing the smartphone to capture and/or stream and/or record any head orientations and/or movements and/or positions. It is noted that the smartphone can be mounted in any arbitrary position and in any arbitrary orientation relative to the head, 6. Position yourself (e.g. sit or stand) at a distance of approximately 1.5+/−0.5 m from the loudspeaker. Make sure that the room is sufficiently large, and that no walls or objects are present within a radius of about 1.5 meters from the loudspeaker and from the person (to avoid reflections), 7. When the acoustic stimuli, e.g. chirp-sounds are heard, turn the head gently during a predefined period (e.g. 5 to 15 minutes, e.g. about 10 minutes) in all directions, e.g. left to right, top to bottom, etc.

In some embodiments (see FIG. 6), it is preferred that the position of the head (X, Y, Z) should remain unchanged, and only the orientation of the head (e.g. 3 Euler angles with respect to the world reference frame) is changed, see FIG. 2, to change the incident angle of the sound relative to the head). Between the series of acoustic stimuli (e.g. chirps-, guidelines may be given about how to move. For example, the instruction may be given at a certain moment to turn the head a quarter turn (90°), or a half turn (180°) so that the lateral hemisphere and sound coming from "behind" the user is also sampled.

In other embodiments (see FIG. 7), the user is allowed to sit on a rotatable chair, and does not need to keep the center of his/her head in fixed position, but is allowed to freely rotate the chair and freely bend his/her neck. It is clear that such embodiments are much more convenient for the user.

8. After the test is completed, the user will be asked to remove the smartphone from the head and to stop capturing or recording by the "app".

A personalized ITDF and a personalized HRTF is then calculated, e.g. on the smartphone itself (see FIG. 7), in which case the captured data need not be transferred to another computer, or is calculated on another computer, e.g. in the cloud, in which case the captured data needs to be transferred from the "app" to the computer or network.

The amount of data to be transmitted may for example be about 120 MBytes (for an acoustic test of about 11 minutes). At a wireless transmission speed of about 8 Mbits/s=1 MByte per second, such transfer only requires about 2 minutes.

The IDTF and HRTF are then calculated using a particular algorithm (as will be explained below), and the resulting IDTF and HRTF are then made available, and are ready for personal use, for example in a 3D-game environment, or a teleconferencing environment, or any other 3D-Virtual Audio System application.

Many variants of the procedure described here above are possible, for example:

the transmission of the captured data may already start before all measurements are taken, part of the calculations may already start before all captured data is received, rather than merely capturing the data, the smartphone may also analyze the data, for example the orientation data, to verify whether all directions have been measured, and could render for example an appropriate message on its own loudspeaker with corresponding instructions, e.g. to turn the head in particular directions, etc.

D. The Room and the Acoustic Test Signal

Different test stimuli may be used for the determination of the ITDF and HRTF. In one embodiment, it is proposed to use broadband stimuli (referred to herein as "chirps"), whereby the frequency varies at least from 1 kHz to 20 kHz, the invention not being limited thereto. One could opt for a more narrow frequency band, e.g. from 4 kHz to 12 kHz, because in this part of the audible frequency spectrum, the HRTF varies the most (see examples in FIG. 4).

Traditionally HRTF measurements are performed using fairly long signals (e.g. about 2 to 5 seconds). Traditionally HRTF measurements are performed in a (semi-) anechoic chamber, where the walls are covered with sound-absorbing material, so that the secondary reflections on the walls and other objects are reduced to a minimum. Since the method of the present invention is to be performed at home, these reflections cannot be eliminated in this way. Instead, stimulus signals, e.g. chirps are used having either a sufficiently short duration to prevent that the direct sound and the reflected sound (against walls and/or objects in the room) overlap (for a typical room), or having a longer duration but a frequency sweep structure that allows to differentiate signal components coming via the "direct path" from signal components coming via indirect, e.g. reflected paths.

Suppose in an exemplary arrangement (see FIG. 20) the speaker is at a height $h_e$ of 1.40 m, and that the persons head is at a height $h_x$ of 1.40 m, and that the distance L between the person and the loudspeaker is d=1.4 m, and that the height of the room is at least 2.8 m, so that the reflection on the ground arrives before reflection on the ceiling, then the difference in traveled distance between the direct path and the first reflection (on the ground), is:

$$\Delta x=\sqrt{(h_x+h_e)^2+d^2}-\sqrt{(h_x-h_e)^2+d}=1.7m$$

and thus the reflected signal needs (1.7 m)/(344 m/s)=about 4.94 ms longer to reach the head.

Thus by taking a stimulus signal with a duration shorter than 4.94 ms, for example at most 4.80 ms, or at most 4.50 ms, or at most 4.25 ms, or at most 4.0 ms, or at most 3.5 ms, or at most 3.0 ms, or at most 2.5 ms, or at most 2.0 ms, or at most 1.5 ms, or at most 1 ms, the direct signal can be easily separated from the subsequent reflections by using a window mask (which is a technique known per se in the art).

Another strategy would be to make use of a frequency sweep. The stimulus duration can then be much longer, more than 10 ms, more than 20 ms, more than 30, more than 40, more than 50 ms, more than 60, more than 100, since the direct signal and the reflection may overlap in the time domain, because they can be 'separated' in the frequency-time domain (spectrogram), see FIG. 21 and FIG. 22.

In what follows, a stimulus duration of 25 ms will be assumed, although the present invention is not limited hereto, and other pulse durations shorter or longer than 25 ms, may also be used, depending on the room characteristics. It is also contemplated that more than one acoustic test signal may be present on the audio-CD, and that the user can select the most appropriate one, depending on the room characteristics.

After each stimulus, e.g. chirp, it is necessary to wait long enough so that all reflections in the environment (the reverberations) are sufficiently extinguished. This duration depends on the chamber and the objects therein. The so-called reverberation time, is defined as the time required to ensure that the echo signal intensity has dropped by 60 dB compared to the original signal. From tests in various rooms, it is determined that an inter-pulse time of about 300 ms suffices, but the invention is not limited hereto, and other inter-pulse times larger or smaller than 300 ms may also be used, for example an inter-pulse time of about 100 ms, e.g. about 200 ms, e.g. about 400 ms, e.g. about 500 ms, e.g. about 600 ms, e.g. about 800 ms, e.g. about 1000 ms. It is advantageous to keep the inter-chirp time as short as possible, to increase the number of chirps during the total test-time (e.g. about 15 minutes), or stated differently, to lower the total test time for a given number of chirps. If an audio-CD or DVD is provided, it may also be possible to provide multiple audio test signals (e.g. audio-tracks), with different pulse duration and/or different inter-pulse times and/or different total duration of the test, and the procedure may include a step of determining a suitable audio-test-file, e.g. depending on the room wherein the test is performed. One possible implementation on an audio-CD would be that the instructions are present on a first audio-track, where the user is informed about the different options, and whereby the user can select an appropriate test signal, depending on his/her room characteristics and/or desired accuracy (the less samples are taken, the faster the data capturing and processing can be, but the less accurate the resulting ITDF and HRTF are expected to be).

Subsequent stimuli need not be identical, but may vary in frequency content and/or duration. If subsequent stimuli were chosen such that they cover a different frequency band, which is clearly separable, then such a test signal design would allow one to reduce the inter-stimulus time, and hence to shorten the total data acquisition time.

In the embodiment where more than one loudspeakers is used, for example two in case of a stereo signal, each of the loudspeakers is positioned at a different point in space, and each of the loudspeakers renders a different acoustic test signal (using stereo input), comprising different stimuli (different frequency spectrum and/or the stimuli alternating (stimulus/no stimulus) between loudspeakers), in order to be able to separate the stimuli upon reception and to identify the loudspeaker from where it originated. It is an advantage that the present invention works for a large number of room settings, without the need for special chairs or special support for mounting the loudspeaker, etc, without requiring the loudspeaker to be repositioned during the data capturing, without knowing the exact position of the loudspeaker, and without knowing the filter characteristic of the loudspeaker.

E. Measuring the Head Orientation

In order to determine HRTF and ITDF, it is essential to know the direction where the sound is coming from relative to the head, or more exactly: relative to the reference frame of the head as shown in FIG. 2, where the center of the head is located in the middle between the two ears, one axis is coinciding with the ear-ear axis, one axis is oriented to "the front" of the head, and one axis is oriented to "above".

According to the present invention, the source (loudspeaker) direction relative to the head can be obtained by making use of an orientation unit 201 comprising one or more orientation sensors, e.g. an accelerometer (measuring mainly an orientation relative to the gravitational axis)), a gyroscope (measuring rotational movements), a magnetometer (measuring an angle relative to the Earth's magnetic field), but other orientation units or orientation sensors may also be used. In the view of the inventors, this solution is not trivial, because the orientation unit provides orientation information of the orientation unit, not of the head. According to principles of the present invention, the orientation unit 201 is fixedly mounted to the head during the data-capturing step, but the exact positioning and/or orientation of the orientation unit 201 with respect to the head reference frame need not be known beforehand, although if some prior knowledge about its orientation is known it can be used to determine the source direction relative to the head. It is an advantage of embodiments of the present invention that the method presented is capable of determining the source direction without the user having to perform a physical measurement, or a specific orientation test or the like.

It is an advantage of the present invention that potential inaccuracy of the orientation sensor unit may be addressed by not only relying on the orientation information obtained from the orientation sensor, but by also taking into account the audio signals when determining the head orientation, as will be explained in more detail further below, when describing the algorithm.

It is an advantage that the head movements are performed by the person himself, in a way which is much more free and convenient than in the prior art shown in FIG. 5. Moreover, in some embodiments of the invention, the person is not hindered by cables running from the in-ear microphones to the external computer.

An important difference between the present invention and the co-pending application PCT/EP2016/053020 from the same inventors is that, in the former application, the inventors were of the opinion that the orientation unit was not sufficiently accurate for providing reliable orientation data. It is true that the momentary orientation data provided by envisioned orientation sensors is sometimes inaccurate in the sense that hysteresis or "hick-ups" occur, and that the magnetic field sensing is not equally sensitive in all orientations and environments. An underlying idea of the former application was that spatial cues from the captured audio data could help improve the accuracy of the orientation data, which spatial cues can be extracted using a "general" ITDF and/or HRTF function, which in turn was a reason for iterating the algorithm once a "first version" of the personalized ITDF and personalized HRTF was found, because the calculations could then be repeated using the personalized ITDF and/or personalized HRTF yielding more accurate results.

The present invention partly relies on two insights:

(1) that the use of spatial cues to improve the accuracy of, or to correct the raw orientation data obtained from the orientation unit is not required, and thus also the use of a predefined ITDF (e.g. a general ITDF) and/or a predefined HTRF (e.g. a general HRTF) for extracting those spatial cues is not required; and (2) that the joint estimate of the source direction (re world) and the transformation mapping the smartphone reference frame to the head reference frame can be split into two simpler estimation problems performed consecutively. This allows reformulation of the search problem from one performed in a 5 dimensional search space (2 angles to specify source direction +3 angles to specify smartphone-head transformation) into two simpler problems, first solving a problem in a 2 dimensional search space (2 angles to specify source direction) and using those results subsequently solving a problem in a 3 dimensional search space (3 angles to specify smartphone-head transformation). This approach is made possible by the fact that the measured/calculated ITD and/or spectral information when assigned to an incorrect source direction, gives rise to a completely distorted "image" of the ITDF and HRTF when mapped on the sphere, with many high order components, very unlike the relatively continuous or relatively smooth drawings shown in FIG. 3 and FIG. 4. The present invention takes advantage of that insight, by using the "smoothness" of the mapped ITDF and/or HRTF as a quality criterion to first find the source direction relative to the world. The exact details of the algorithm will be described further, but the use of such a quality criterion is one of the underlying ideas of the present invention. Stated in simple terms, it boils down to finding the source direction for which the mapped ITDF and/or HRTF on a sphere "look smoother" than for all other possible source directions. It is noted that other quality criteria based on other specific properties of the ITDF and/or HRTF could also be used, e.g. symmetry (except for sign) of ITDF relative to sagittal plane, cylinder symmetry of ITDF around the ear-ear axis. Given the source direction (re world), finding the smartphone-head transformation then reduces to a search problem in a 3-dimensional search space. This 3-dimensional search can be subdivided further by first determining the ear-ear axis (re smartphone) and finally determining the rotation angle around the ear-ear axis.

An important advantage of this insight, namely that "smoothness of the mapped ITDF and/or mapped HRTF" can be used as a quality criterion to find the (most likely) source direction, is an important insight, inter alia because (1) it allows that the ITDF and HRTF of a particular person can be determined without using the ITDF and HRTF of other people (or a general ITDF and/or general HRTF), and (2) because it offers huge advantages in terms of computational complexity and computation time. To give an idea, using a method according to the present invention, the calculations required to determine the ITDF and HRTF on a standard laptop computer with e.g. a 2.6 GHz processor (anno 2016) using non-optimal code, only takes about 15 minutes, even without attempts to optimize the code.

It is contemplated that several ways of quantifying the "smoothness" of the mapped or plotted or rendered ITDF and/or HRTF data on the sphere can be found, two of which will be described herein with reference to FIG. 31. In one embodiment, we expand the measured HRTF data is expanded in real spherical harmonics (SH), which are basis functions similar to Fourier basis functions, but defined on the a sphere. Similar to Fourier basis functions, real SH basis functions $Y_{lm}(\theta,\varphi)$ have the property that lower l-values correspond to more slowly varying basis functions, see FIG. 26(*a*). Hence, this means that if the HRTF is expressed in a truncated basis containing only basis functions up to a chosen or predefined maximum order L (l<L), a low-pass filter is effectively applied that only allows for slow spatial variations.

$$S^{r}_{L/R}(f, r_i) \approx \sum_{l=0}^{L} \sum_{m=-l}^{l} C^{r,L/R}_{l,m}(f) Y_{lm}(r_i)$$

The higher the chosen L value, the more spatial 'detail' the basis expansion includes. Hence, in order to quantify 'smoothness', we first estimate the coefficients $$C_{l,m}^{r,R}(f) \text{ and } C_{l,m}^{r,L}(f),$$

which are coefficients of the HRTF expansion (corresponding respectively to the right and left ear HRTF at frequency f for the chosen direction r) in the SH basis truncated at some chosen L. Next, we calculate the squared difference between the measured data points and the obtained HRTF expansion (in which we a sum is calculated over all measured directions and all measured frequencies):

$$\varepsilon_{HRTF}^2(r) = \sum_f \sum_{r_i} \left\{ \begin{array}{l} \left[ S_L^r(f, r_i) - \sum_{l=0}^{L} \sum_{m=-l}^{l} C_{l,m}^{r,L}(f) Y_{lm}(r_i) \right]^2 + \\ \left[ S_R^r(f, r_i) - \sum_{l=0}^{L} \sum_{m=-l}^{l} C_{l,m}^{r,R}(f) Y_{lm}(r_i) \right]^2 \end{array} \right\}$$

This error now quantifies to what extent the basis of slowly varying basis functions is adequate in describing the spatial pattern present in the measured HRTF over the sphere. The smaller the error, the better the acoustic data was approximated using only slowly varying basis functions, and consequently, the smoother the HRTF pattern. Consequently, this error can be used as our a quality criterion.

Also other smoothness criteria can be defined. For example the following would also be chosen:

$$\varepsilon_{HRTF}^2(r) = \sum_f \left[ (C_{L,0}^{r,L}(f))^2 + (C_{L,0}^{r,R}(f))^2 \right]$$

or $$\varepsilon_{HRTF}^2(r) = \sum_f \sum_{r_i} \left\{ [\nabla^2 S_L^r(f, r_i)]^2 + [\nabla^2 S_R^r(f, r_i)]^2 \right\}$$

Also other norms than the Euclidean norm can be used such as a general p-norm or an absolute value norm.

F. Hardware

Referring back to FIG. 6 to FIG. 8. Although not all smartphones allow capturing or recording of stereo-audio signals via a stereo or two mono input connectors, there are extensions that allow stereo recording via a USB port, for example "TASCAM iM2 Channel Portable Digital Recorder", commercially available. Although this extension has microphones which cannot be inserted in an ear, this example demonstrates that the technology is at hand to make such a dedicated extension, for example by removing the microphones and by providing two audio connectors, wherein the in-ear microphones can be plugged. This is only one example of a possible portable device which can be used in the embodiments of FIG. 7 and FIG. 8.

Technology for determining orientation information of a portable device is also available. Consider for example the "Sensor Fusion App". This application shows that technology for retrieving orientation information from portable devices with embedded orientation sensors, such as for example accelerometers (for measuring mainly an orientation relative to the gravitational axis), a gyroscope (for measuring rotational movements) and/or a magnetometer (for measuring direction relative to Earth's magnetic field) is available.

G. Providing the Captured Data to the Computing Means

After capturing and/or recording and/or streaming the left and right audio signals from the microphones (also referred to as the binaural audio data), and the corresponding head orientations (from the orientation unit, although the exact relation between the orientation unit and the head is not known yet), the processing of the captured data may be performed by a processor in the portable device (e.g. smartphone) itself, or on a remote computer (e.g. in the cloud, or on a desktop or laptop or game console) to which the data is transmitted or streamed or provided in any other way (e.g. via an exchangeable memory card).

III. Data Processing:

The data processing step of the present invention will be explained in more detail with reference to FIG. 9 to FIG. 16.

Figure 9:
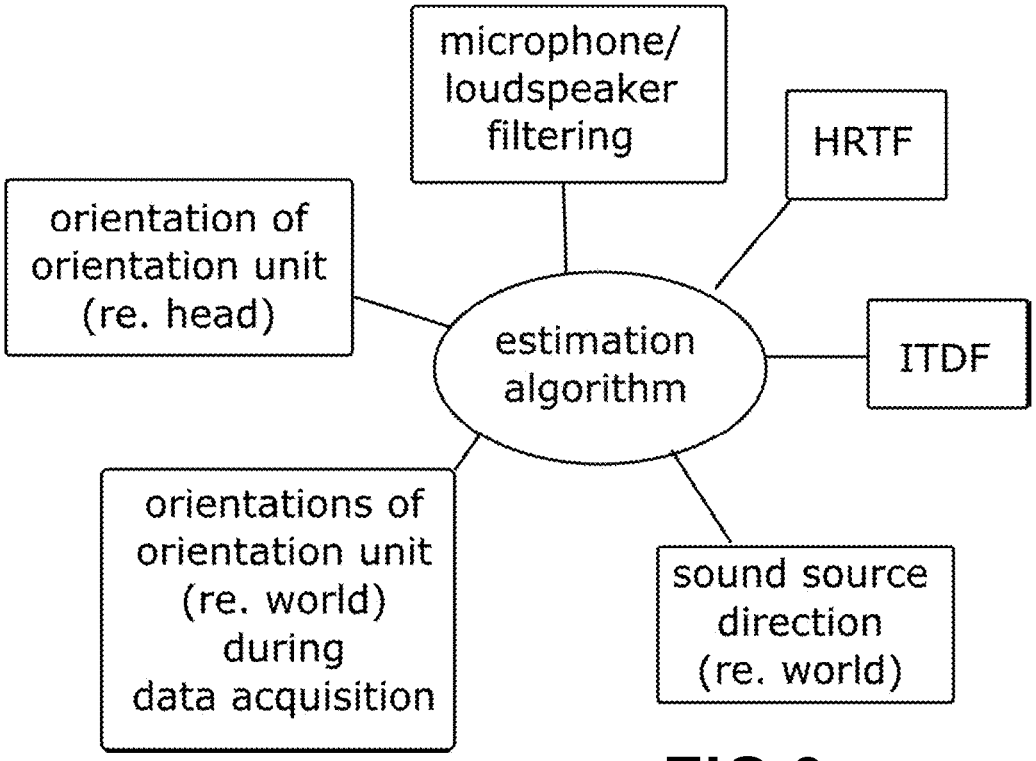
FIG. 9 illustrates the variables which are to be estimated in the method of the present invention, hence illustrates the problem to be solved by the data processing part of the algorithm used in embodiments of the present invention.

FIG. 9 is a schematic diagram illustrating the unknowns which are to be estimated. In other words, this figure illustrates the problem to be solved by the data processing part of the algorithm used in embodiments of the present invention. As can be seen from FIG. 9, the personal (or individualized) ITDF and the personal (or individualized) HRTF are not the only sets of variables to be determined. The head orientation during the data acquisition is unknown in the setups as shown in FIG. 6 to FIG. 8, because, even though the orientation of the orientation unit 201 itself is determined (mainly based on the orientation sensors) the orientation of the orientation unit 201 with respect to the head reference frame is not precisely known, and because the head orientation at the time of reception of each acoustic stimulus (e.g. at each chirp) is possibly not precisely known, based on the individual sensor information retrieved or obtained during each particular chirp alone, hence considered unknown. Also, the direction of the sound source (relative to the reference frame of the head) is unknown. In addition, the spectral characteristic of the loudspeaker and microphone combination may be unknown, since the user may use any available loudspeaker. The transfer characteristic of the in-ear microphones may be known beforehand, especially when the in-ear microphones are for example sold in a package along with a CD, but even then, the parameters of the loudspeaker are not known. In cases where the transfer characteristic of the loudspeaker and the microphones are known, the algorithm may use them, but that is not absolutely necessary.

It was found that this large number of unknowns cannot be estimated with sufficient accuracy unless all data is combined and estimated together (in the meaning of: "in dependence of each other"). This is another advantageous aspect of the present invention. For example, the individual raw orientation and movement data originating from the orientation sensor(s) (for example embedded in a smartphone) might not permit to determine the individual smartphone orientation and thus head orientation with sufficient accuracy, inter alia because the position/orientation of the smartphone with respect to the head is not fully known, and in addition, because it may be quite difficult to accurately estimate the head orientation, given the limited accuracy of individual measurements of the orientation sensor.

Main Difference:

Where the inventors proposed in "the previous application" to optionally extract orientation information contained in the left and right audio data, this principle is not relied upon in the present invention, at least for determining a first version of the personalized IDTF and the personalized HRTF, although this data could still be taken into account in a second or further iteration of certain steps of the algorithm. Instead, the key feature relied upon in the present invention is that the direction of the loudspeaker (relative to the world)

can be found by maximizing a predefined quality value, preferably related to a "smoothness metric".

And optionally, if the accuracy of the orientation information obtained from the orientation unit is insufficient, the accuracy and/or reliability of the orientation data can be further improved by relying on gentle movements of the head. This allows for example to generate or correct orientation information by interpolation between two orientations corresponding to chirps which are not "adjacent chirps", but for example 2 or 3 chirp-durations apart, hence incorrect raw orientation data due for example to "hick-ups" or due to hysteresis, or due to low sensitivity of the orientation unit in particular directions, can be improved.

Overall, it is believed that the most important advantages of the present invention are the following:

the method can be applied at home by almost any user (no special room required, so special skills required);

the user does not require special equipment other than a pair of in-ear microphones and an audio test-file and a strap for connecting a smartphone to the head (it is assumed that almost every user has a smartphone and/or a laptop);

the method is highly robust (the relative location of the loudspeaker relative to the head, and the relative orientation of the smartphone relative to the head need not be known or measured);

the user can move almost freely, and does not have to follow specific patterns (but the space should be sufficiently sampled);

(last but not least) a reduction of the computational complexity.

The unknowns shown in the FIG. 9 may be iteratively optimized, such that the thus obtained solution corresponds best with the captured data sets. This will be explained in more detail when discussing FIG. 11.

In case of multiple loudspeakers, for example two in the case of a stereo signal (or two synchronized non-overlapping mono-signals), the recorded stimuli can be identified as originating from one of the loudspeakers thanks to the choice of the applied acoustic test signal, and hence one obtains two separate data sets, each corresponding with one of the loudspeakers. These data sets can then be used together as input for the algorithm to estimate the direction of loudspeaker proper, and the other unknowns of the problem shown in FIG. 9. The fact that one has two "points of reference" that do not change positions, may improve the estimates of the head orientation, and consequently the estimates of the ITDF and HRTF.

Figure 10:
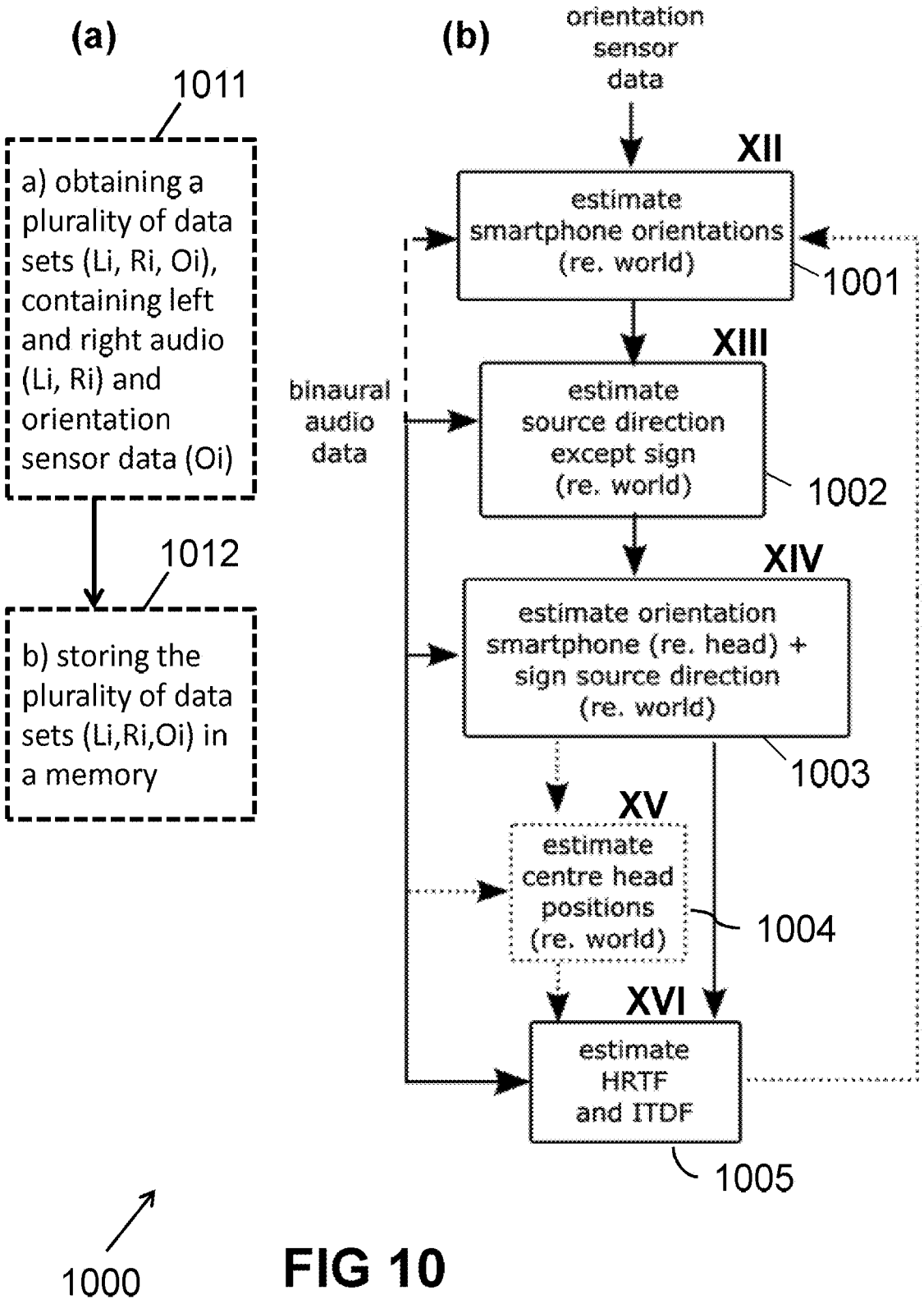
FIG. 10 is a flow-chart representation of a first embodiment of a method for determining a personalized ITDF and HRTF according to the present invention.

The Algorithm (High Level):

FIG. 10 shows the first two steps of the algorithm proposed by the present invention.

In a first step 1011, further also referred to as "step a", a plurality of data sets is obtained, each data set comprising a left and right audio sample, and corresponding orientation data.

With "left audio fragment" and "right audio fragment" is meant a portion of the audio waveform received by the left respectively right in-ear microphone, corresponding to a particular acoustic stimulus sent by the loudspeaker, e.g. "a chirp".

It is noted that the data sets can be "obtained" and/or "captured" and/or "stored" in memory in many different ways, for example as a single interleaved file or stream, or as three separate files or streams (e.g. a first containing the left audio samples, a second containing the right audio samples, and a third containing the orientation data, whereby each file may comprise synchronization information, for example in the form of time stamps), or as individual data packets, each data packet containing a left audio sample, and a right audio sample and orientation data with respect to a reference system fixed to the world, but other ways may also be possible, and the present invention is not limited to any of these ways.

Depending on which hardware device performs the capturing of the data, and which hardware device performs the calculations, (e.g. a stand-alone computer, or a network computer, or a smartphone, or any other computing means), "obtaining" can mean: "receiving" data captured by another device (e.g. by a smartphone, see e.g. FIG. 8), for example via a wired or wireless interface, or "retrieving" or "reading" data from an exchangeable memory card (on which the data was stored by the capturing device, and then connected to the computing device), or data transfer in any other way. But if the device that captured the data is the same as the device that will perform the calculations, "obtaining" may mean "capturing the data sets", either directly, or indirectly, and no transmission of the captured data to another device is necessary. It is thus clear that a method or computer program product directed to the processing of the data, need not necessarily also capture the data.

In a second step 1012, also referred to herein as "step b", the data sets are stored in a memory. The memory may be a non-volatile memory or a volatile memory, e.g. RAM or FLASH or a memory card, etc. Typically all the data sets will be stored in a memory, for example in RAM. It is contemplated that 100 MBytes to 150 MBytes, for example about 120 MBytes of memory are sufficient to store the captured data.

For ease of description, it is assumed that the orientation unit is present in the smartphone, and that there is only one loudspeaker, but the invention is not limited thereto, and other orientation units and more than one loudspeaker may also be used.

FIG. 10 is a flow-chart representation of a first embodiment of a method 1000 according to the present invention. For illustrative purposes, in order not to overload FIG. 10 and FIG. 11 with a large amount of arrows, this flow-chart should be interpreted as a sequence of steps 1001 to 1005, step 1004 being optional, with optional iterations or repetitions (right upwards arrow), but although not explicitly shown, the data provided to a "previous" step is also available to a subsequent step. For example the orientation sensor data is shown as input to block 1001, but is also available for block 1002, 1003, etc. Likewise, the output of block 1001 is not only available to block 1002, but also to block 1003, etc.

In step 1001 the smartphone orientation relative to the world (for example expressed in 3 Euler angles) is estimated for each audio fragment. An example of this step is shown in more detail in FIG. 13. This step may optionally take into account binaural audio data to improve the orientation estimate, but that is not absolutely required. Stated in simple terms, the main purpose of this step is to determine the unknown orientation of the smartphone for each audio fragment.

Then, in step 1002, the "direction of the source" relative to the world is determined, excluding the sign (or "sense" discussed above). An example of this step is shown in more detail in FIG. 14. Stated in simple terms, the main purpose of this step is to determine the unknown direction of the loudspeaker for each audio fragment (in world coordinates).

Then, in step 1003, the "orientation of the smartphone relative to the reference frame of the head (see FIG. 2) and the sign (or "sense" discussed above) of the "source direction" relative to the world, is determined. An example of this step is shown in more detail in FIG. 14. Stated in simple terms, the main purpose of this step is to determine the unknown orientation of the smartphone to the head.

Then, optionally, in step 1004, the centre of the head position relative to the world may be estimated. If it is assumed that the head centre does not move during the measurement, step 1004 can be skipped.

Then, in step 1005 a personalized ITDF and a personalized HRTF are estimated. Stated in simple terms, the main purpose of this step is to provide an IDTF function and an HRTF function capable of providing a value for each source direction relative to the head, also for source directions not explicitly measured during the test.

An example of this embodiment 1000 will be described in the Appendix.

The inventors are of the opinion that both the particular sequence of steps (for obtaining the sound direction relative to the head without actually imposing it or measuring it but in contrast using a smartphone which can moreover be oriented in any arbitrary orientation), as well as the specific solution proposed for step 1002 are not trivial.

Figure 11:
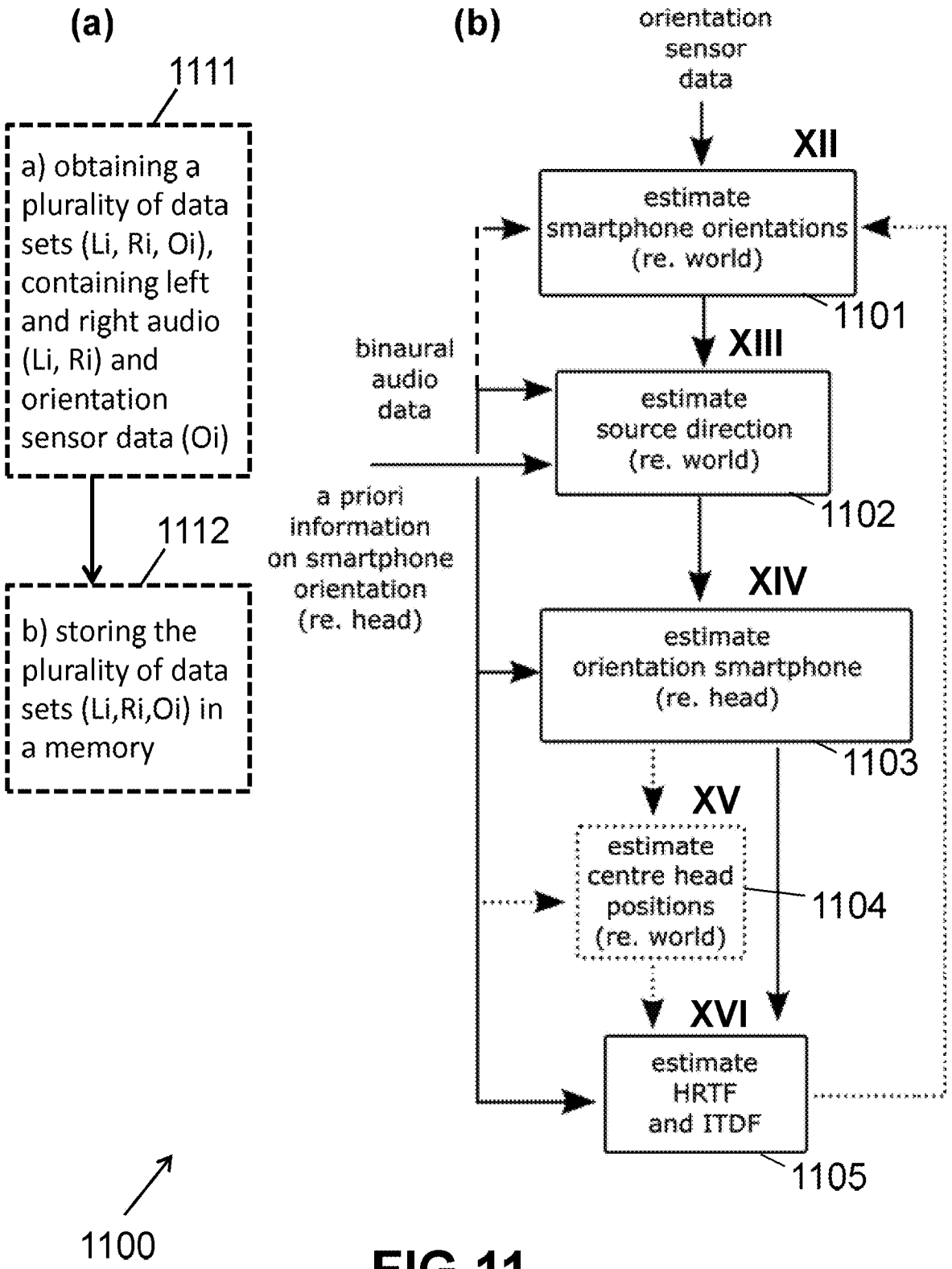
FIG. 11 is a flow-chart representation of a second embodiment of a method for determining a personalized ITDF and HRTF according to the present invention.

FIG. 11 is a variant of FIG. 10 and shows a second embodiment of a method 1100 according to the present invention. The main difference between the method 1100 of FIG. 11 and the method 1000 of FIG. 10 is that step 1102 may also take into account a priori information of the smartphone position/orientation, if that is known. This may allow to estimate the sign of the source already in step 1102.

Everything else which was mentioned in FIG. 10 is also applicable here.

Figure 12:
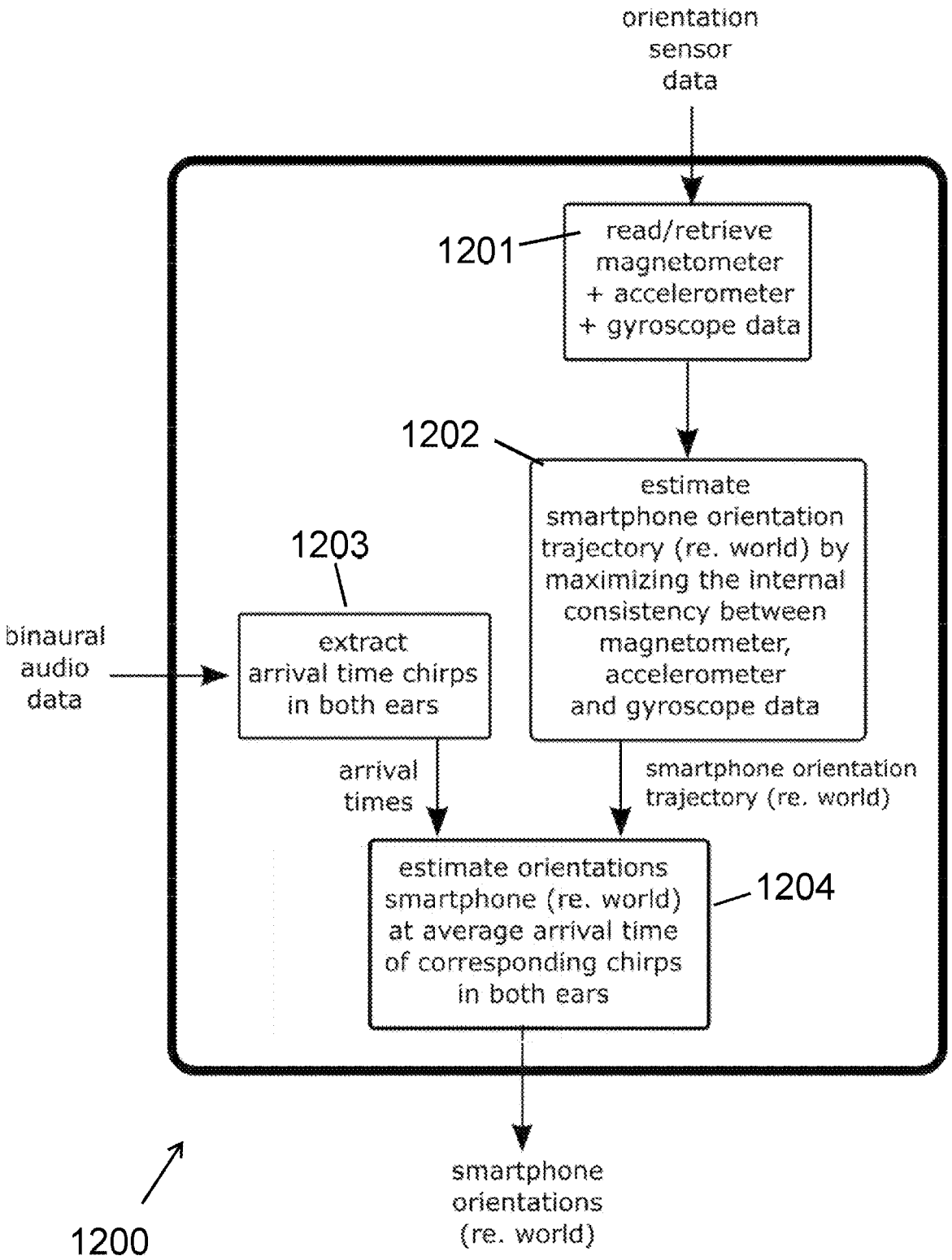
FIG. 12 shows a method for estimating smartphone orientations relative to the world, as can be used in block 1001 of FIG. 10 and block 1101 of FIG. 11.

FIG. 12 shows a method 1200 (i.e. a combination of steps) which can be used to estimate smartphone orientations relative to the world, based on orientation sensor data and binaural audio data, as can be used in step 1001 of the method of FIG. 10, and/or in step 1101 of the method of FIG. 11.

In step 1201 sensor data is obtained or readout or otherwise obtained from one or more sensors of the orientation unit, for example data from a magnetometer and/or data from an accelerometer and/or data from a gyroscope, and preferably all of these.

In step 1202 a trajectory of the smartphone orientation is determined over a given time interval, for example by maximizing the internal consistency between magnetometer data, accelerometer data and gyroscope data.

In step 1203 the arrival time of the audio fragments (e.g. chirps) in each of the ears is determined, e.g. extracted from the binaural audio data.

In step 1204 the orientation of the smartphone (re. word) is estimated at a moment equal to the average arrival time of corresponding chirps in both ears.

Figure 13:
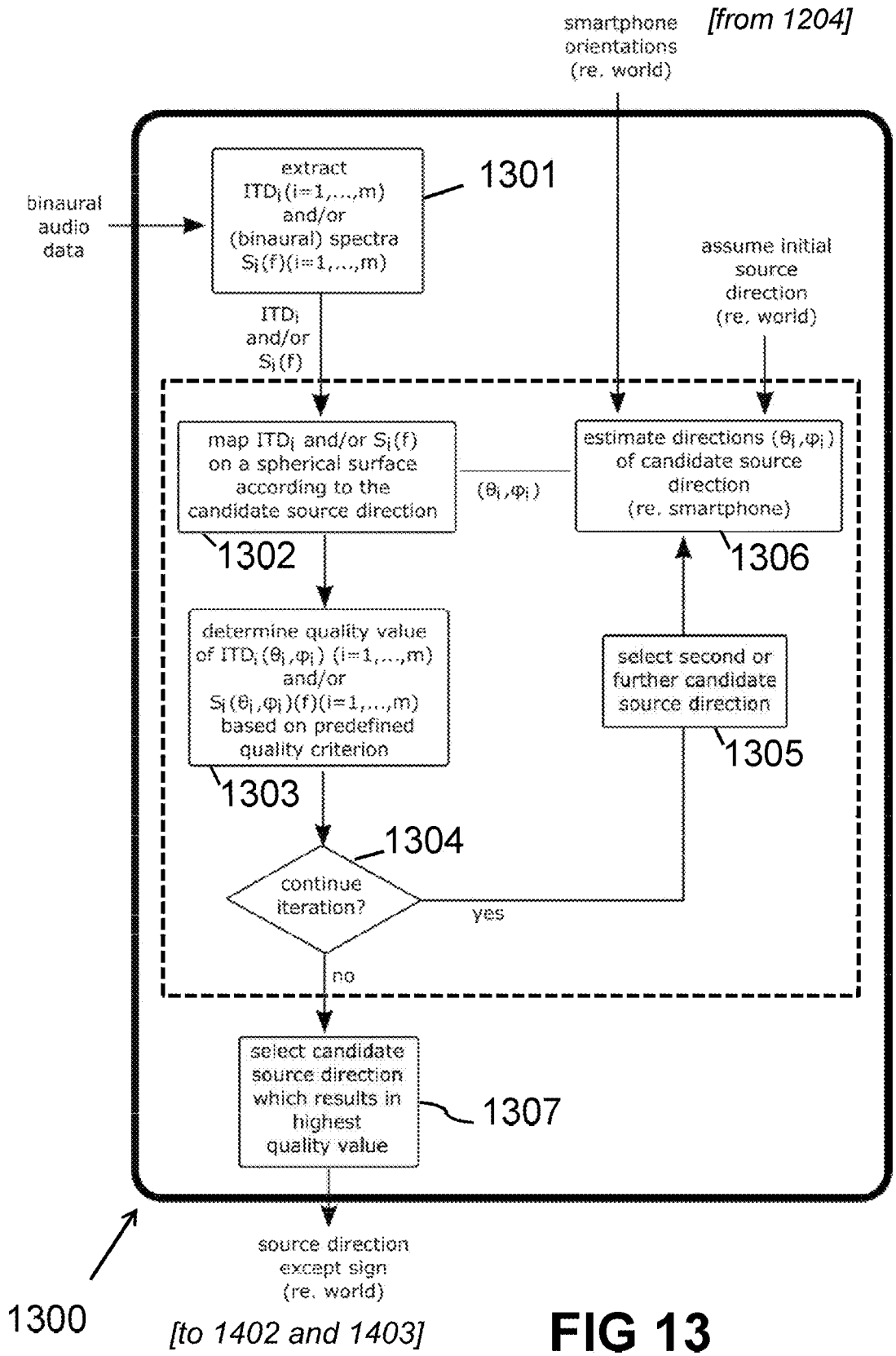
FIG. 13 shows a method for estimating source directions relative to the world, as can be used in block 1002 of FIG. 10 and block 1102 of FIG. 11.

FIG. 13 shows an exemplary method 1300 for estimating the source direction relative to the world, as can be used in step 1002 and/or step 1102 of FIG. 10 and FIG. 11. Or more specifically, what is estimated is the direction of a virtual line passing through the loudspeaker and through an "average position" of the centre of the head over all the measurements, but without a "sign" to point to either end of the line. In other words, a vector located on this virtual line, would either point from the average head centre position to the loudspeaker, or in the opposite direction.

In step 1301 ITD information is extracted from the binaural audio data, for example by calculating a time difference between the moment of arrival of the audio fragments (corresponding to the chirps emitted by the loudspeaker) at the left ear and at the right ear. The ITD data can be represented as an array of values $ITD_i$, for i=1 to m, where m is the number of chirps. m is also equal to the number of audio fragments captured by each ear. In step 1301 also binaural spectral data is extracted from the left and right audio samples. The spectral data Si(f), for i=1 to m, can for example be stored as a two-dimensional array of data, see for example FIG. 23(*a*) and FIG. 23(*b*) and FIG. 24(*a*) and FIG. 24(*b*) which are graphical representations of this data.

Steps 1302, 1303, 1304, 1305 and 1306 form a loop which is executed multiple times, each time for a different "candidate source direction". In each iteration of the loop, the "candidate source direction" is used for mapping the values of the ITD data (for all the chirps or a subset thereof) to a spherical surface, and/or for mapping the spectral values of one or more particular frequencies to one or more other spherical surfaces. And for each of these mappings, thus for each "candidate source direction", a quality value is calculated, based on a predefined quality criterion.

In preferred embodiments, the quality criterion is related to or indicative of a smoothness of the mapped data. This aspect will be described in more detail when discussing FIG. 26.

The loop is repeated several times, and the "candidate source direction" for which the highest quality value was obtained, is selected in step 1307 as "the source direction". Experiments have shown that the source direction thus found corresponds with the true source direction. As far as the inventors are aware this technique for finding the source direction is not known in the prior art, yet offers several important advantages, such as for example: (1) that the source direction need not be known beforehand, (2) that the source direction can be relatively accurately determined on the basis of the captured data, and (3) that the source direction can be found relatively fast, especially if a clever search strategy is used.

The following search strategy could be used, but the invention is not limited to this particular search strategy, and other search strategies may also be used:

a) in a first series of iterations, the quality factor is determined for a predefined set of for example 8 to 100, for example about 32 candidate source directions, in order to get a rough idea of finding a good starting point in the vicinity of the best candidate. The quality factor for this predefined number of candidates is calculated, and the location that provides the highest quality factor is chosen as starting point for a second series of iterations.

b) in a second series of iterations, the candidate source direction is adjusted in small steps, for example by testing eight nearby directions, having a slightly different elevation angle (for example current elevation angle −5°, +0°, or +5°) and/or a slightly different lateral angle (for example current lateral angle −5°, +0°, or +5°), resulting in eight new candidates, which are evaluated, and the best candidate is chosen.

c) repeating step b) until the quality factor no longer increases, d) repeating step b) with a smaller step-size, for example (−1°, +0° and +1°) until the quality factor no longer increases.

Tests have shown that the convergence can be relatively fast, for example require less than 1 minute on a standard laptop of about 2.6 GHz clock frequency.

Figure 14:
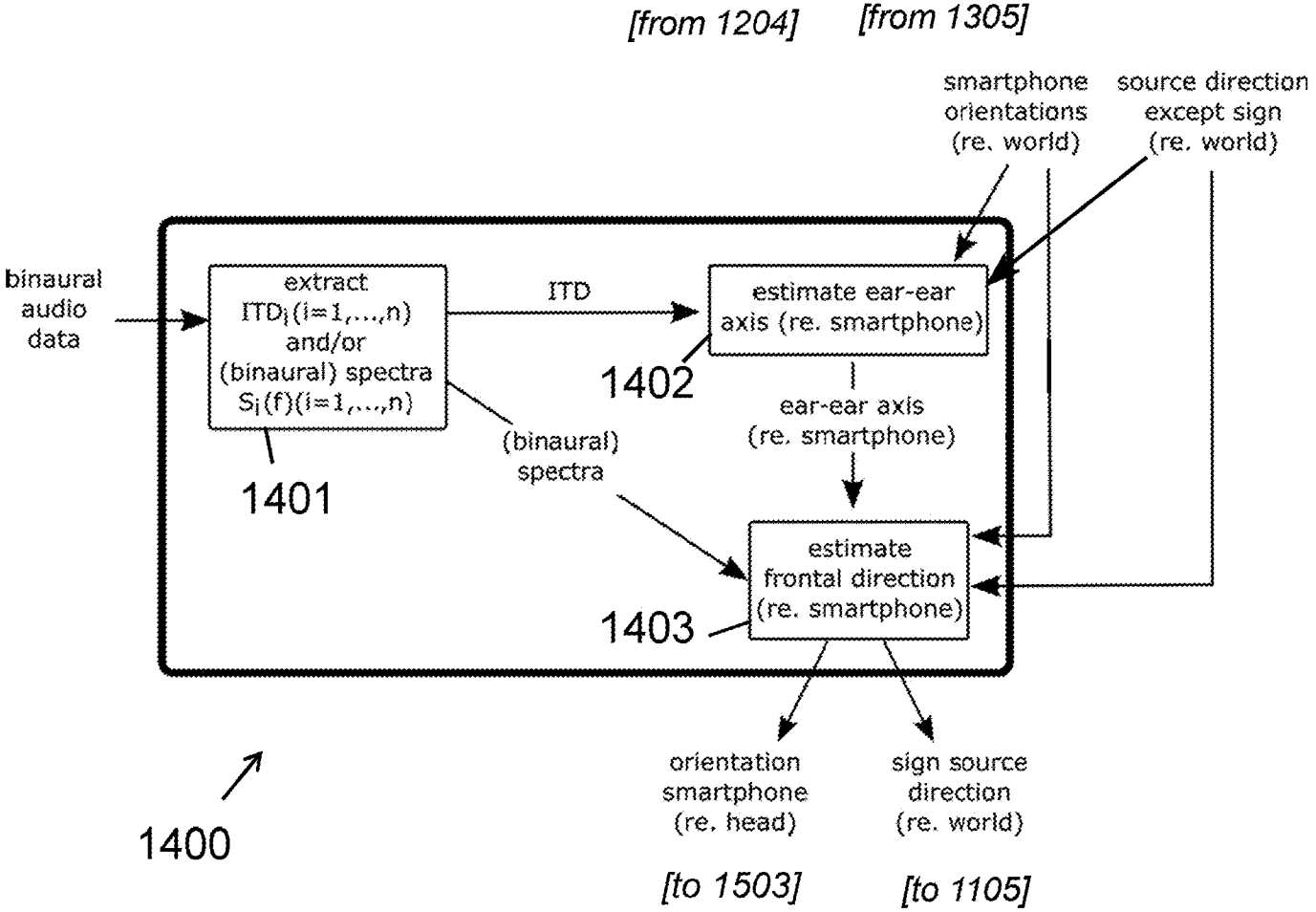
FIG. 14 shows a method for estimating orientations of the smartphone relative to the head, as can be used in block 1003 of FIG. 10 and block 1103 of FIG. 11.

FIG. 14 shows a method 1400 for determining the orientation of the smartphone relative to the reference frame of the head, as can be used in block 1003 of FIG. 10 and block 1103 of FIG. 11, but the invention is not limited thereto, and other methods may also be used.

Step 1401 is identical to step 1301, but is shown for illustrative purposes. Of course, since step 1301 is already executed before, it need not be executed again, but the data can be re-used.

In step 1402 the orientation of the ear-ear axis is estimated relative to the reference frame of the smartphone, on the basis of the smartphone orientation (re. world) and the source direction up to sign (re. world) and the ITD and/or spectral information. In the embodiment described in Appendix, only ITD data was used, but the invention is not limited hereto.

The orientation of the ear-ear axis (re. to the smartphone) can then be used in step 1403, together with monaural or binaural spectral information, supplemented with the smartphone orientations relative to the world, and the source direction except sign relative to the world, to estimate the frontal direction of the head relative to the reference frame of the smartphone, resulting in the orientation of the smartphone relative to the head, and in the "sign" of the source direction relative to the world.

Figure 15:
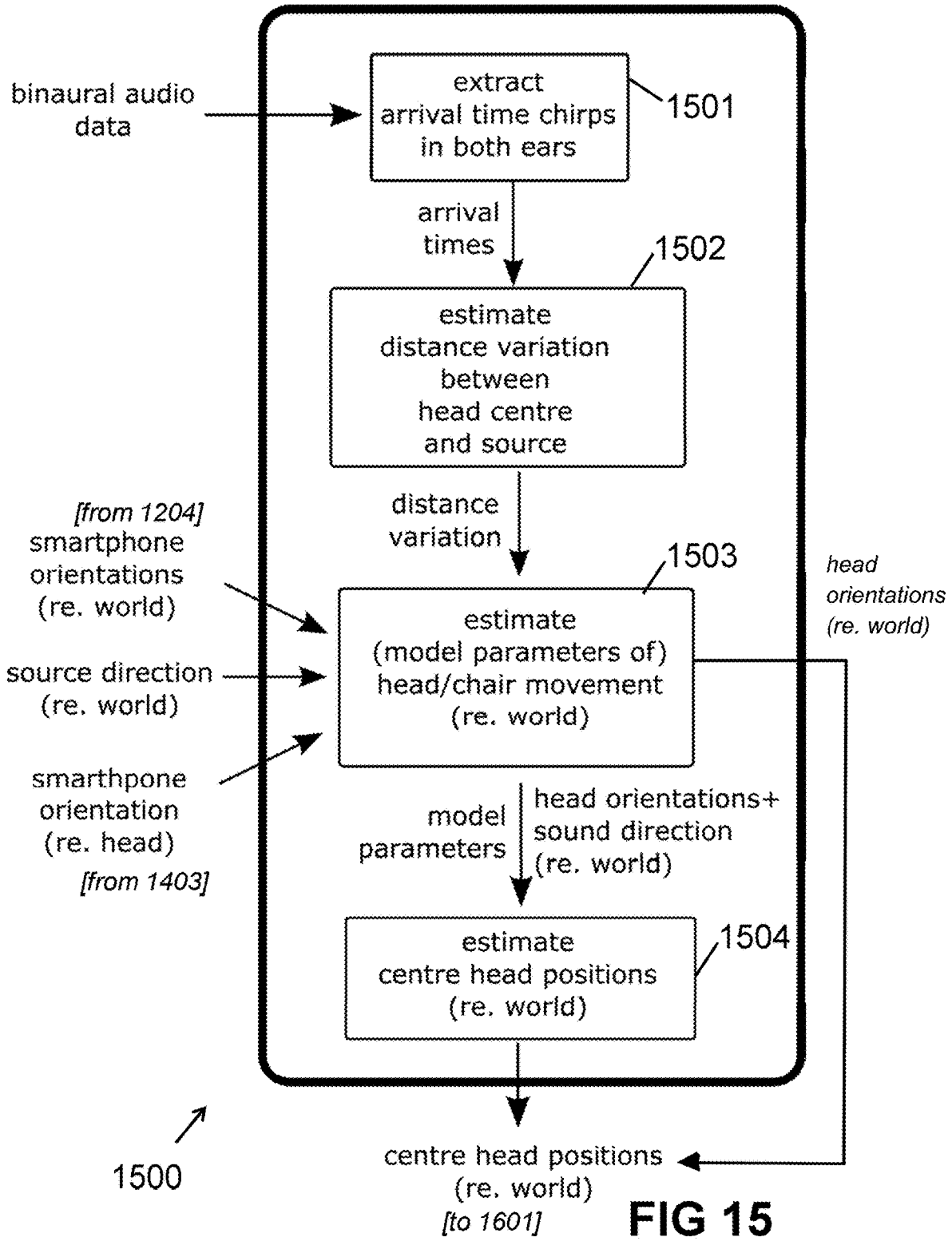
FIG. 15 shows a method for estimating the position of the center of the head relative to the world, as can be used in block 1004 of FIG. 10 and block 1104 of FIG. 11.

FIG. 15 shows a method 1500 for determining the position of the center of the head relative to the world, as can be used in optional block 1004 of FIG. 10 and block 1104 of FIG. 11, but the invention is not limited thereto, and other methods may also be used.

In step 1501, the arrival time of corresponding left and right audio fragments are extracted.

In step 1502 these arrival times are used to estimate a distance variation between the centre of the head and the source.

Figure 31:
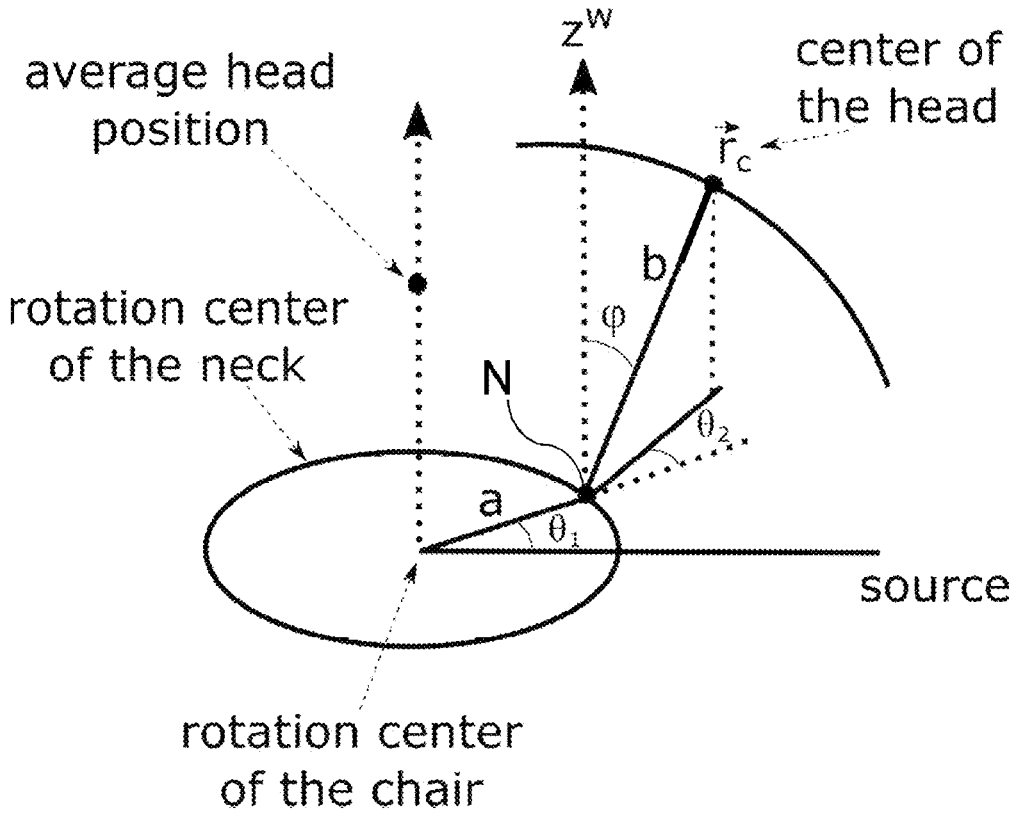
FIG. 31 Illustrates the model parameters of an a priori model of the head centre movement. When a person is seated on an office chair and is allowed to rotate his/her head freely in all directions, and to rotate freely along with the chair with the body fixed to the chair, then the movement of the head centre can be described using this simplified mechanical model.

In step 1503 this distance variation can be used to estimate model parameters of a head/chair moment, for example the parameters of the model shown in FIG. 31, if used. As mentioned above, this model is optional, but when used, can provide more accurate data.

In step 1504, the centre head positions can then be estimated, based on the mechanical model parameters, supplemented with the head orientations and the source direction relative to the world.

Figure 16:
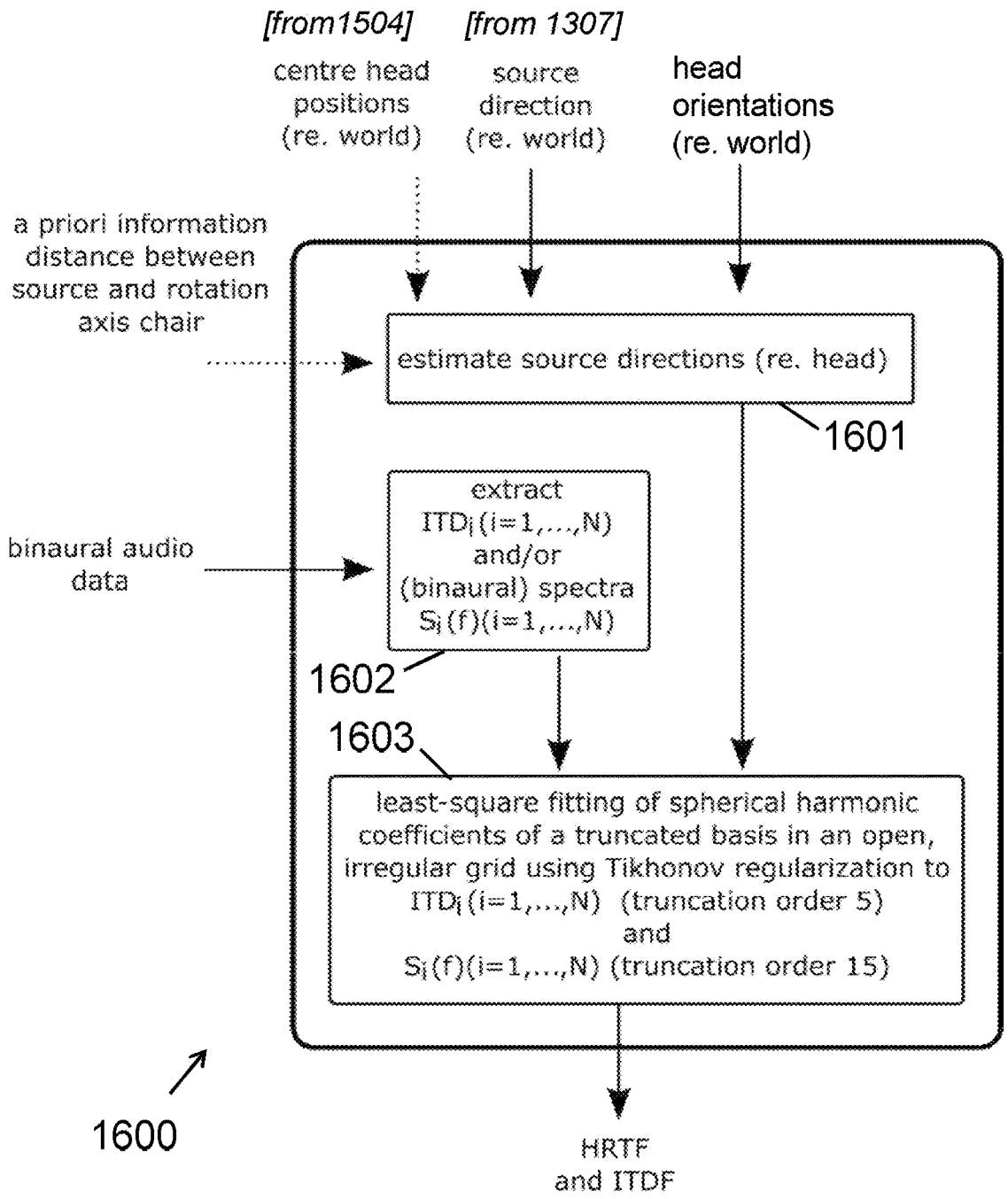
FIG. 16 shows a method for estimating the HRTF and IDTF, as can be used in block 1005 of FIG. 10 and block 1105 of FIG. 11.

FIG. 16 shows a method 1600 for determining the HRTF and/or ITDF, as can be used in block 1005 of FIG. 10 and block 1105 of FIG. 11, but the invention is limited thereto, and other methods may also be used.

In step 1601, the source directions with respect to the head are estimated, based on the source direction and the head orientations in the world, supplemented, if available, with the positions of the head and a priori information on the distance to the source.

Step 1602 is identical to step 1301, but is shown for illustrative purposes. Of course, since step 1301 is already executed before, it need not be executed again, but the data can be re-used.

In step 1603 the ITDF and HRTF are estimated by least-square fitting the spherical harmonic coefficients of a truncated basis to respectively the ITD-data and the spectral data (on a per frequency basis) projected on the sphere, according to the sound directions relative to the head.

Figure 17:
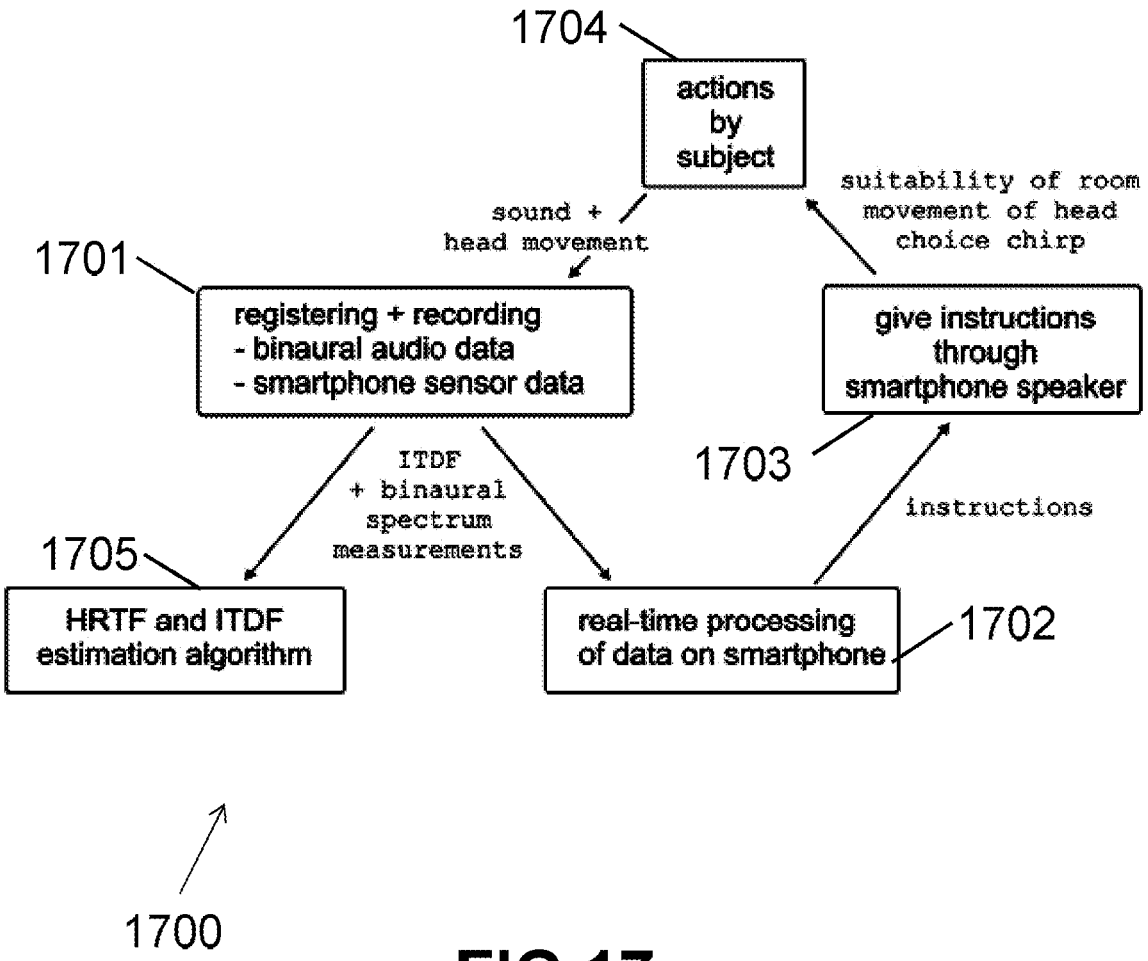
FIG. 17 shows a flow-chart of optional additional functionality as may be used in embodiments of the present invention.

FIG. 17 shows a flow-chart of optional additional functionality as may be used in embodiments of the present invention.

In the simplest setup, a sound file containing the acoustic test signal (a series of acoustic stimuli, e.g. chirps) is rendered on a loudspeaker, and the data is collected by the smartphone. It may be beneficial to include verbal instructions for the subject, to guide him or her through the experiment hence improving the data collection. These instructions may be fixed, e.g. predetermined, as part of the pre-recorded sound file to be rendered through the loudspeaker, or, another possibility may be to process the data collection to some extent in real-time on the computing device, e.g. smartphone and to give immediate or intermediate feedback to the user, for example in order to improve the data acquisition. This could be achieved by the process outlined in FIG. 17, which comprises the following steps.

In a first step 1701, the smartphone captures, stores and retrieves the orientation sensor data and the binaural audio data.

In a second step 1702, the measured data is (at least partly) processed in real-time on the smartphone. Timing information and/or spectral information from the left and right audio samples may be extracted for the plurality of data sets. Based on this information, the quality of the signal and the experimental setup (for example Signal to Noise ratio of the signals received, overlap with echoes, etc.) can be evaluated. Orientation information (accurate or approximate) may also be extracted for the subset of captured samples, whereby the algorithm further verifies whether the space around the head is sampled with sufficient density. Based on this information, problems can be identified and instructions (e.g. verbal instructions) to improve the data collection can be selected by the algorithm from a group of predefined audio messages, e.g. make sure the ceiling is high enough, make sure there are no reflecting objects within a radius of 1.5 m, increase/decrease the loudspeaker volume, use a different loudspeaker, move the head more slowly, turn a quarter to the left and move the head from left to right, etc.

In a third step 1703, these instructions are communicated in real-time through the speakers of the smartphone.

In a fourth step 1704, the person reacts to these instructions, whose actions are reflected in the subsequent recordings of the binaural audio data and the smartphone sensor data, as obtained in the first step 1701.

In a fifth step 1705, the collected data is used to estimate the HRTF and the ITDF according to the methods described earlier.

FIG. 18 illustrates capturing of the orientation information from an orientation unit fixedly mounted to the head. The orientation unit may be embedded in a smartphone, but the present invention is not limited thereto.

FIG. 18(*a*) to FIG. 18(*c*) show an example of raw measurement data as can be obtained from an orientation unit 1801 which was fixedly mounted to a robotic head 1802.

In the example shown, an Inertial Measurement Unit (IMU) "PhidgetSpatial Precision 3/3/3 High Resolution" commercially available from "Phidgets Inc." (Canada), was used as orientation unit, but the invention is not limited thereto, and other orientation units capable of providing orientation information from which a unique orientation in 3D space (e.g. in the form of angles relative to the earth magnetic field and the earth gravitational field) can be derived, can also be used. This IMU has several orientation sensors: an accelerometer, a magnetometer, and a gyroscope. Exemplary data waveforms provided by each of these sensors are shown in FIG. 18(*a*) to FIG. 18(*c*). This information was readout via cables 1804 by a computing device (not shown in FIG. 18). The sample period for the IMU measurement was set to 16 ms.

In the experiment data from all three sensors were used, because that provides the most accurate results. The estimated orientation of the IMU can be represented in the form of so called quaternions, see FIG. 18(*d*). The IMU orientation is estimate every 100 ms, using a batch-processing method which estimates the orientation of the IMU not making use of instantaneous data only.

FIG. 18(*e*) shows a robotic device 1803 which was used during evaluation. A dummy head 1802 having ears resembling those of a human being was mounted to the robotic device 1803 for simulating head movements. An orientation unit 1801 was fixedly mounted to the head, in the example on top of the head, but that is not absolutely required, and the invention will also work when the orientation unit is mounted to any other arbitrary position, as long as the position is fixed during the experiment. Also the orientation of the orientation unit need not be aligned with the front of the head, meaning for example that the "front side" of the orientation unit is allowed to point to the left ear, or to the right ear, or to the front of the head, or to the back, it doesn't matter. The attentive reader will remember that the method of FIG. 14 can calculate the orientation of the orientation unit 1801 relative to the head 1802.

In the experiment, the robotic device was programmed to move the head according to a predefined (known) pattern. The test results showed good agreement (<3°) between actual head movements and the measured orientation. Since similar orientation sensors are embedded nowadays in smartphones (and being used for example in orientation applications), it is contemplated that the sensors embedded in a smartphone can be used for obtaining such orientation information. Even if the orientation of each individual measurement would not be perfect, e.g. if hickups would occur in one of the sensors, this can easily be detected and/or corrected by using the other sensor information, and/or by interpolation (assuming gentle head movements), and/or by taking into account spatial information from the captured audio data. The latter possibility is purely optional: some embodiments of the present invention will only use orientation information obtained from the orientation unit (without using spatial information from the captured audio). Other embodiments of the present invention will use both orientation information from the orientation unit and spatial information extracted from the captured audio. The experiments have shown that the latter may not be needed.

Figures 19A, 19B, 19C, 19D:
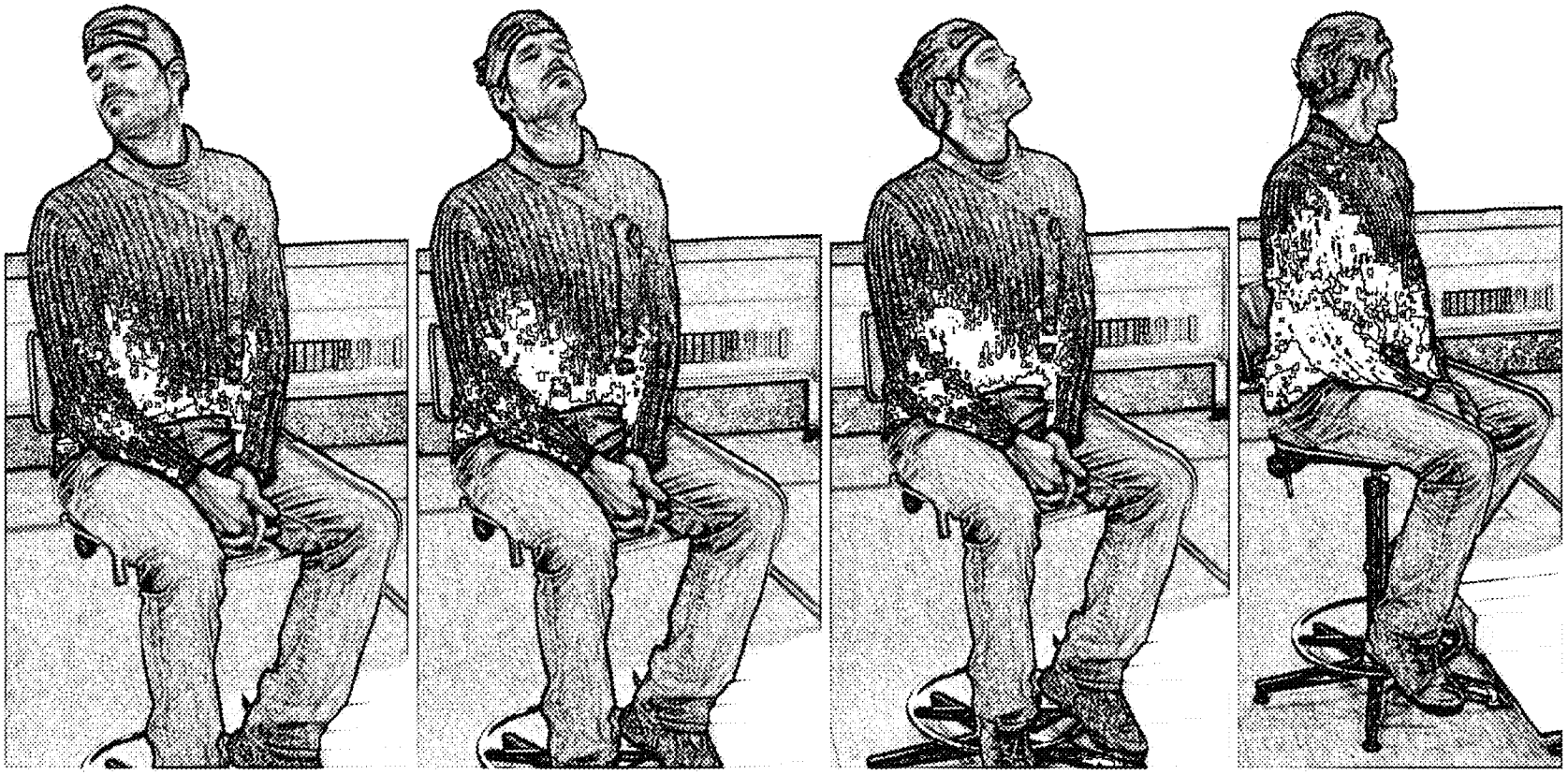
FIG. 19(*a*) to FIG. 19(*d*) are snapshots of a person making gentle head movements during the capturing of audio data and orientation sensor data for allowing determination of the ITDF and HRTF according to the present invention.

FIG. 19(*a*) to FIG. 19(*d*) are a few snapshots of a person making gentle head movements during the data acquisition step, meaning the capturing of audio data and orientation data.

In the example shown, the person is sitting on a rotatable chair and moves his/her head gently (i.e. not abrupt) in "many different directions" over a time period of about 10 minutes, while an acoustic signal is being emitted by a loudspeaker (not shown in FIG. 19), the acoustic signal comprising a plurality of acoustic test stimuli, for example beeps and/or chirps.

In the sequence of images shown in FIG. 19, a trajectory of a gentle head movement is shown, which took about 3 seconds.

Importantly, the person need not follow particular trajectories, but can freely move his/her head, which makes the data acquisition step highly convenient for the user. It is the intention that the head is turned substantially in "all possible directions" on the sphere, to allow to determine the ITDF and HRTF for sound coming from any point in a virtual sphere around the persons head (e.g. from the front, from the back, from the right, from the left, from above, from below, and all positions in between). Of course some areas of the sphere will not be sampled, because of the physical limitations of the human body.

In the examples shown in FIG. 19, the person is sitting on a rotatable chair, which is very convenient for the user. Embodiments of the present invention may take this into account, when determining the average head position, as will be described further in FIG. 31. However, the invention is not limited thereto, and the data can also be acquired when the user is sitting on a stationary chair, or is sitting on his/her knees or standing upright. In these cases, embodiments of the present invention assume that the centre of the head is located at a fixed (albeit unknown) position during the data capturing, but capable of rotating around the centre of the head.

Figure 20:
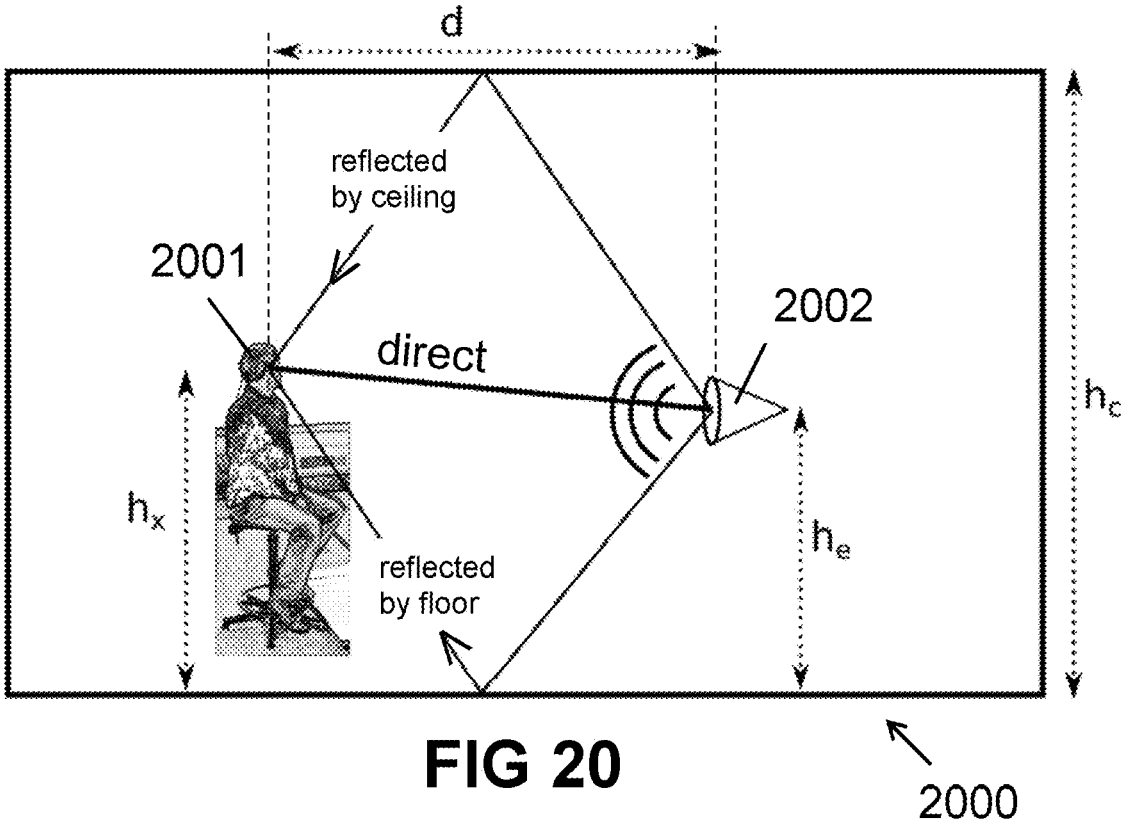
FIG. 20 is a sketch of a person sitting on a chair in a typical room of a house, at a typical distance from a loudspeaker.

FIG. 20 shows a typical arrangement of the person sitting on a chair in a typical room 2000 of a typical house during the data capturing step. The room 2000 has a ceiling located at a height "hc" above the floor, typically in the range from 2.0 to 2.8 m. A loudspeaker 2002 is located in the room at a height "he", for example equal to about 80 to 120 cm above the floor. The head 2001 of the person is located at a height "hx" above the floor, for example at about 120 to 160 cm, and at a distance "d" from the loudspeaker, typically about 1.0 to 2.0 m apart.

It is an advantage of the present invention that these values "he", "d", "hx" or any associated angles, in particular the relative orientation of the loudspeaker relative to the person's head, are not, and need not be known beforehand, and need not be "calibrated" using some kind of measurement, but that the algorithm can nevertheless determine or estimate the relevant "source direction", which is key for the ITDF and the HRTF, on the basis of binaural audio data, orientation information or data obtained from an orientation unit fixed mounted to the head, moreover in an arbitrary position and orientation.

Figure 21:
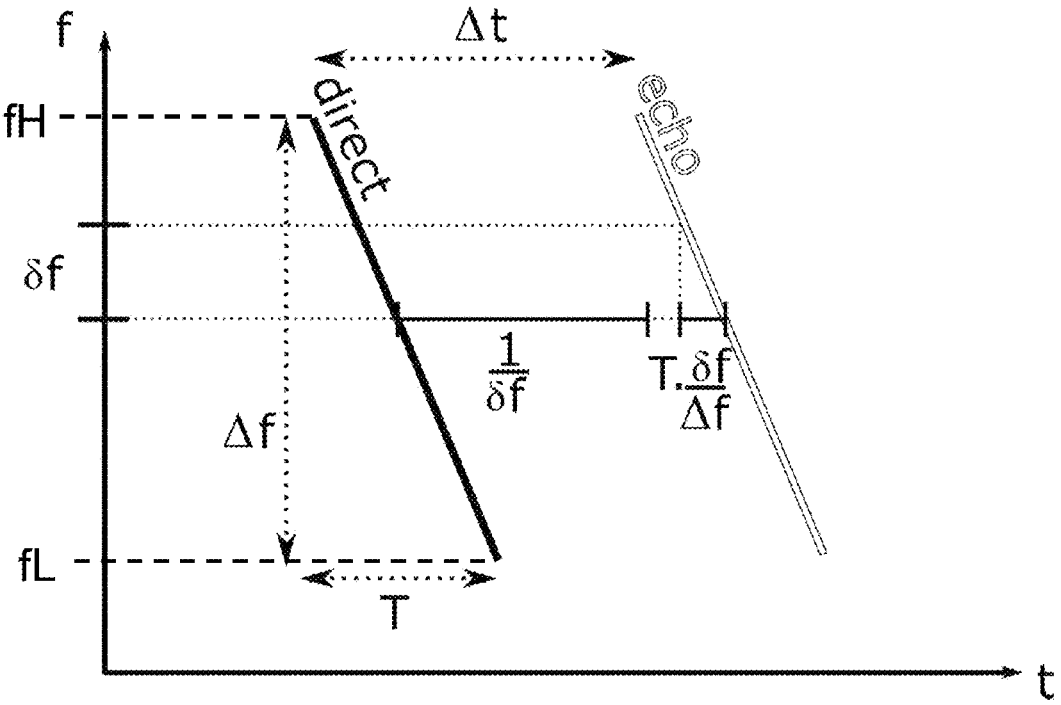
FIG. 21 illustrates characteristics of a so called "chirp" having a predefined time duration and a linear frequency sweep, which can be used as audio test stimuli in embodiments of the present invention.

FIG. 21 illustrates characteristics of a so called "chirp" as an exemplary acoustic stimulus for estimating the ITDF and HRTF, but the invention is not limited to this particular waveform, and other waveforms may also be used, for example a chirp with a linearly increasing frequency or a chirp with a non-linearly decreasing frequency, or a chirp having a frequency profile in the form of a staircase, or even a pure tone. The invention will be described for the chirp shown in FIG. 21.

In the Appendix at the end of the description are described some aspects of how a suitable chirp can be designed taking into account some characteristics of a typical room, and what a suitable time interval between two chirps is, but in order to understand the present invention, it suffices to know that each chirp has a predefined time duration "T" typically a value in the range from 25 to 50 ms. The chirp may comprise a linear frequency sweep from a first frequency fH to a second frequency fL, for example from 20 kHz to 1 kHz. As described in the Appendix, this allows to measure the IDTF and HRTF with a frequency resolution $\delta f$ equal to about 300 Hz.

Figure 22A:
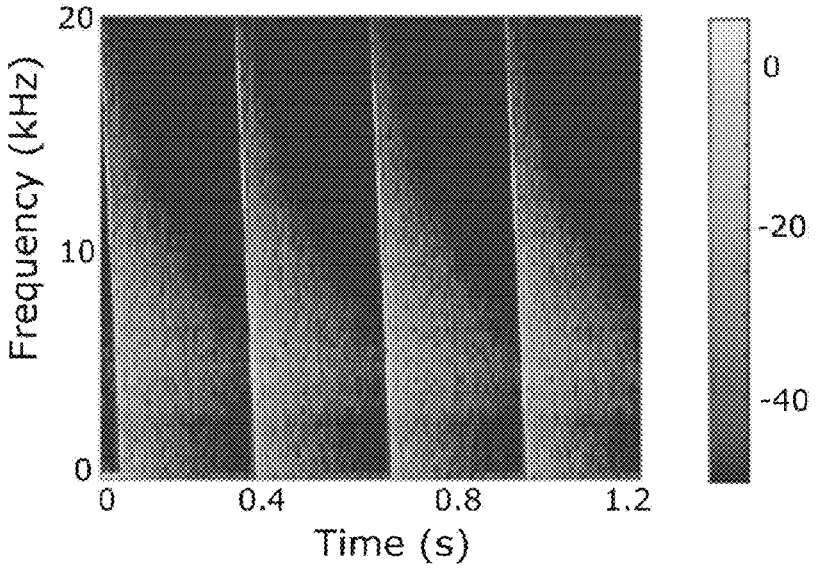
FIG. 22(*a*) to FIG. 22(*c*) illustrate possible steps for extracting the arrival time of chirps and for extracting spectral information from the chirps.
Figure 22B:
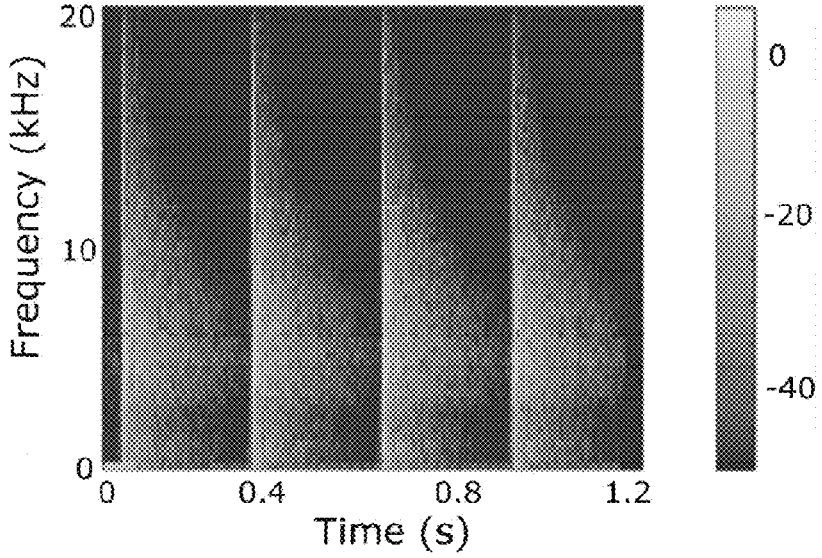
Figure 22C:
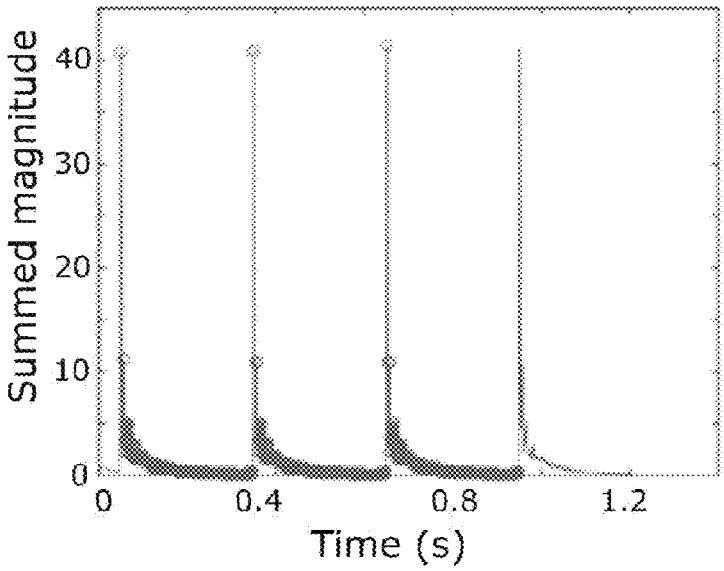

FIG. 22 illustrates the possible steps taken to extract the arrival times of the chirps and the spectral information.

FIG. 22(*a*) shows the spectrogram of an audio signal captured by the left in-ear microphone, for an audio test signal comprising four consecutive chirps, each having a duration of about 25 ms with inter-chirp interval of 275 ms. Such a spectrogram is obtained by applying a Fast-Fourier Transformation after suitable windowing of the left respectively right audio samples, in manners known per se in the art. FIG. 21 also shows the echo signals are a damped version of the emitted signal after one or more reflections against parts of the room (e.g. floor and ceiling) or against objects present in the room (reverberations). Methods of the present invention preferably only work with the "direct signal part".

FIG. 22(*b*) shows the 'rectified' spectrogram, i.e. when compensated for the known frequency-dependent timing delays in the chirps.

FIG. 22(*c*) shows the summed intensity of the left and right audio signal, based on which the arrival times of the chirps can be determined.

Figure 23:
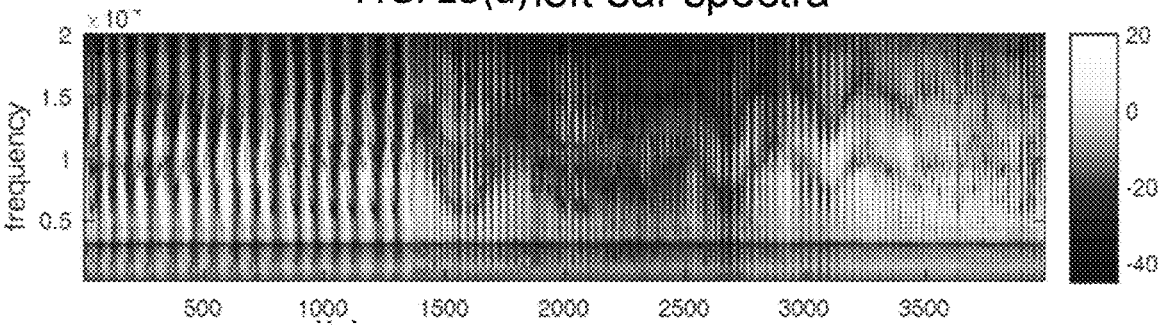
FIG. 23 shows an example of the spectra extracted from the left audio signal
Figure 23:
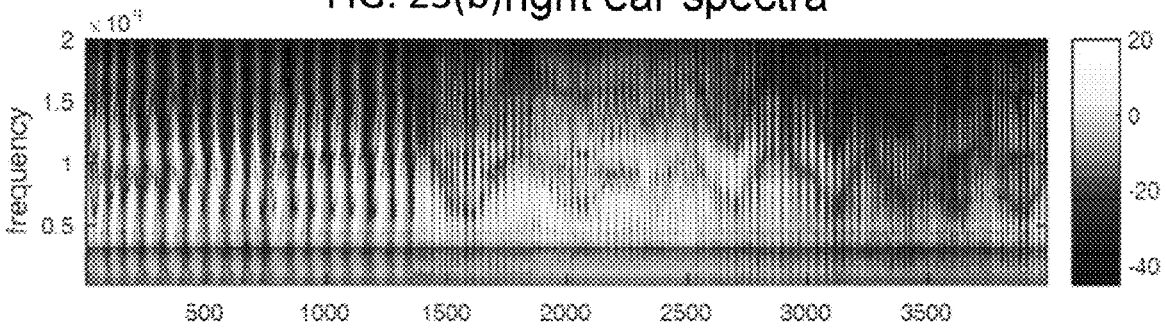
Figure 23:
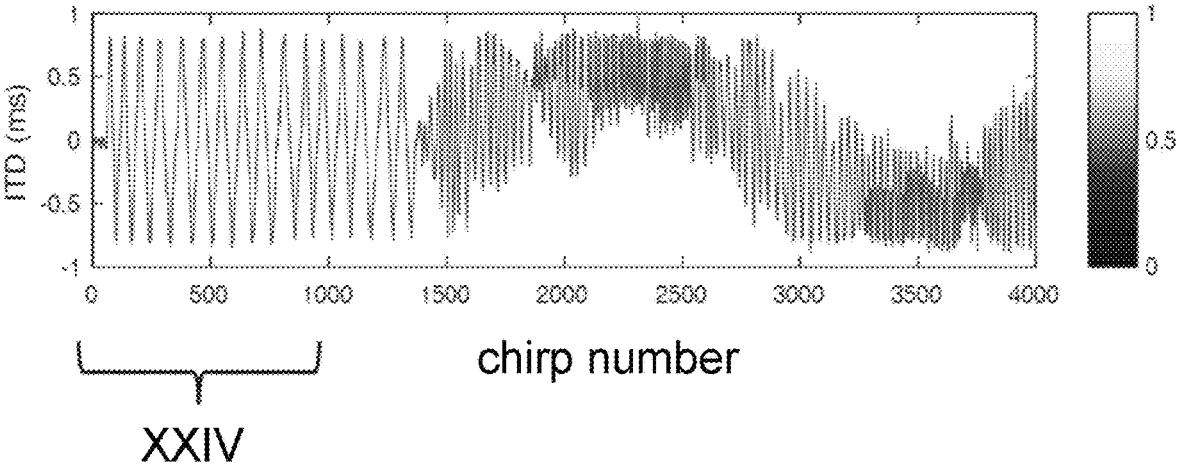

FIG. 23 shows an example of the spectra extracted from the left audio signal (FIG. 23*a*: left ear spectra) and extracted from the right audio signal (FIG. 23*b*: right ear spectra), and the interaural time difference (FIG. 23*c*) for an exemplary audio test-signal comprising four thousand chirps.

Figure 24:
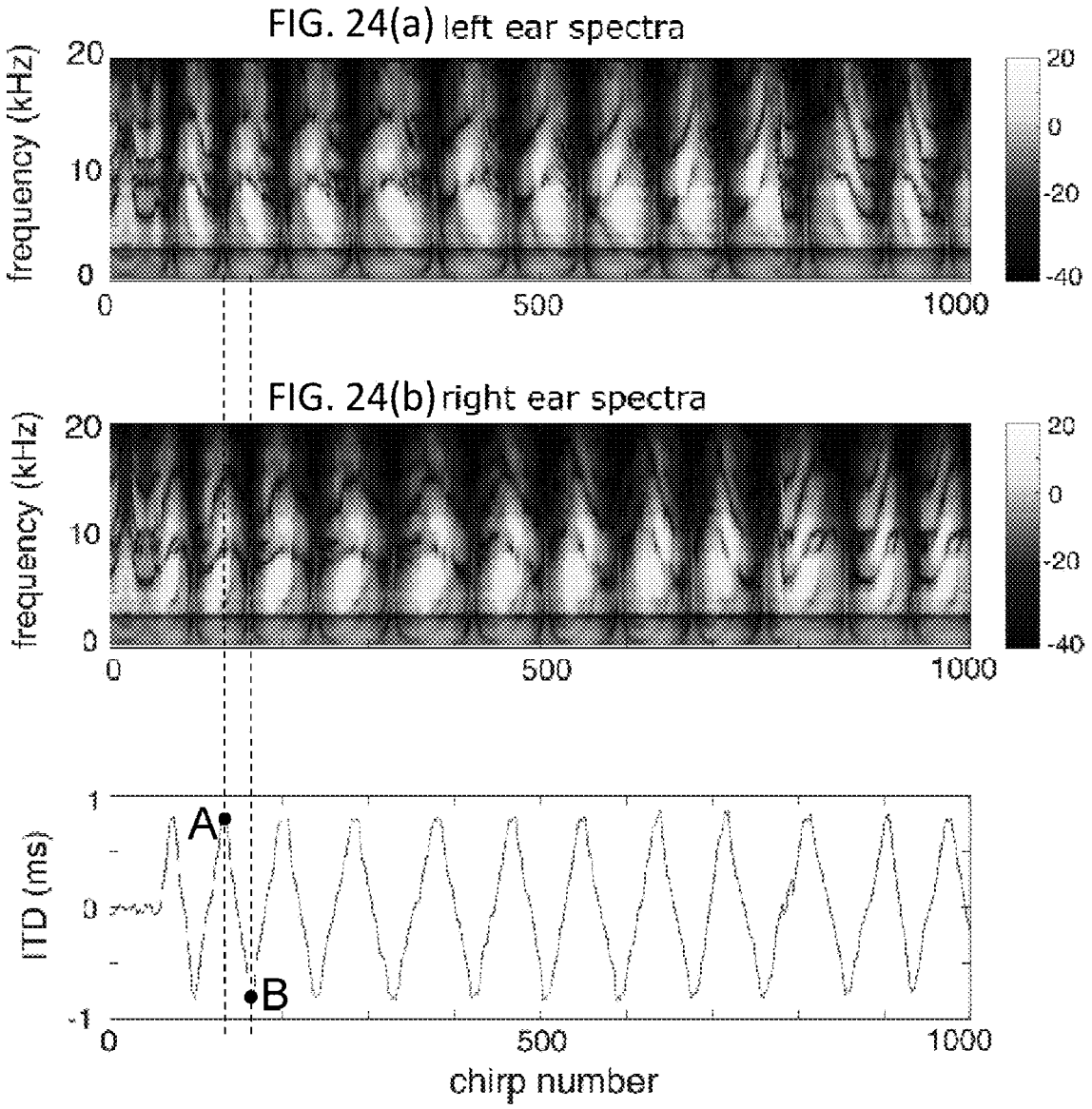
FIG. 24 shows part of the spectra and ITD data of FIG. 23 in more detail.

FIG. 24 shows part of the spectra and ITD data of FIG. 23 in more detail.

FIG. 25 to FIG. 30 are used to illustrate an important underlying principle of the present invention. They are related mainly to the method 1300 for estimating the source direction relative to the world, shown in FIG. 13, which can be found iteratively by maximizing a predefined quality value according to a predefined quality criterion.

In preferred embodiments, the quality criterion is related to a "smoothness metric", but other quality criteria may also be used, such as for example a likelihood function, where the likelihood of certain features or characteristics as can be extracted or derived from the binaural audio data after being mapped on a spherical surface, where the mapping is based on the assumed direction of the source (loudspeaker) re. the word, and where the audio data is associated with orientation information also re. the world.

Figures 25A, 25B, 25C, 25D:
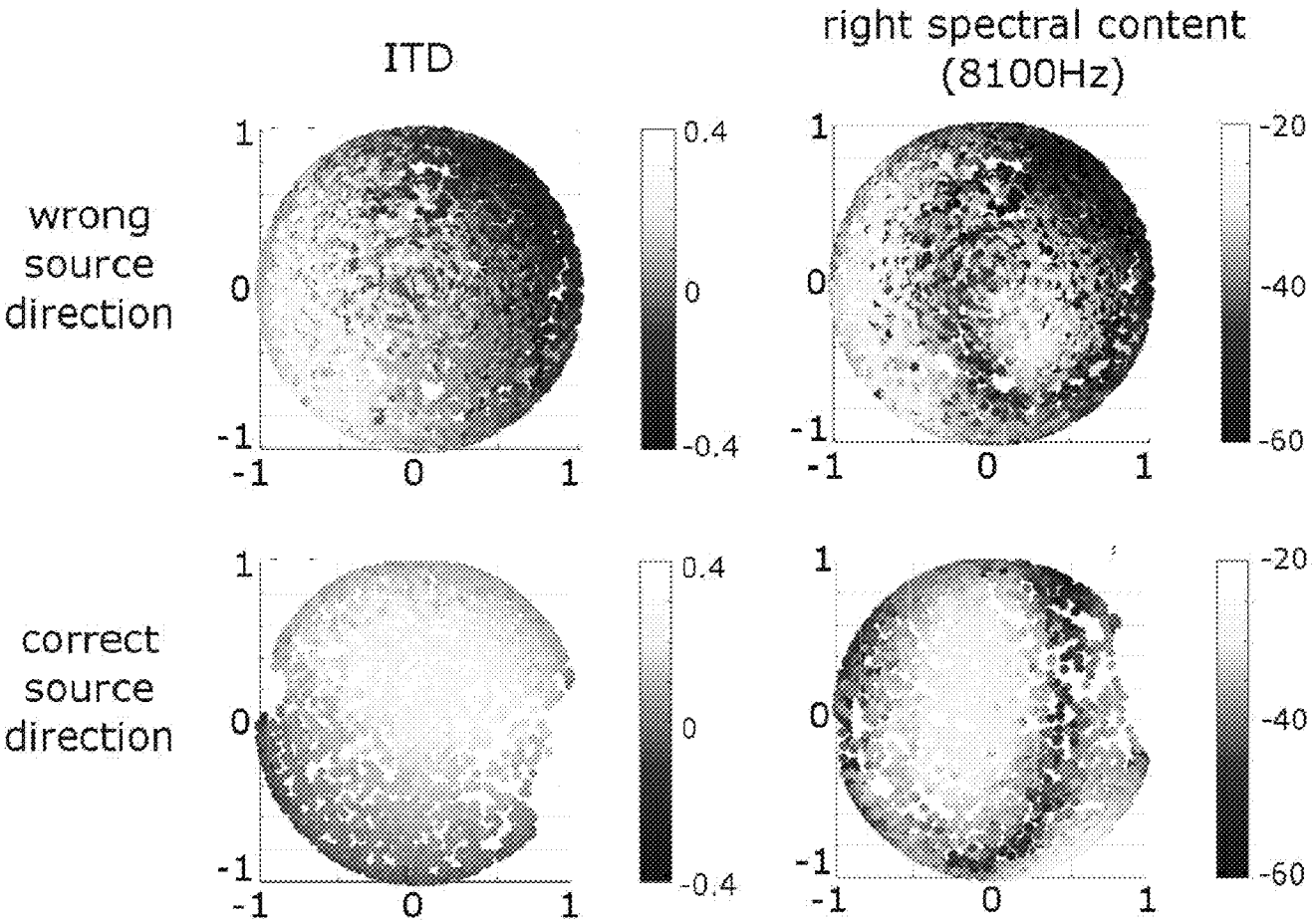
FIG. 25(*a*) shows a mapping of the ITD data of the four thousand chirps of FIG. 23 onto a spherical surface, using a random (but incorrect) source direction, resulting in a function with a high degree of irregularities or low smoothness.

Referring to FIG. 25 first, FIG. 25(*a*) is an example where the ITD-values of the 4000 chirps (see FIG. 24) are mapped onto a spherical surface, assuming a random (but incorrect) source direction. As can be seen in FIG. 25(*a*), there are a lot of "dark spots" in bright areas and "bright spots" in "dark areas", or in other words, the surface has a high degree of irregularity, discontinuity, does not change gradually, is not smooth. All these expressions are related to "smoothness", but they can be expressed or calculated in different ways.

In contrast, if the mapping is done based on the correct source direction (re. world), as illustrated in FIG. 25(*b*), then a surface is formed, which changes much more continuously, much more smoothly, has less irregularities, changes less abrupt, etc. The reader should ignore the pure white areas, corresponding to directions for which no actual data is available, or in other words, which are not mapped onto the surface.

As explained above, the inventors came to the idea of exploiting this effect to "find" the source direction, by testing the quality, e.g. the degree of continuity, the degree of abrupt changes, the degree of smoothness, for a plurality of candidate source directions, and choosing that candidate source direction yielding the highest quality value.

FIG. 25 shows the detrimental effect of a wrongly assumed source direction on the smoothness of the projected surface of ITD-measurements.

FIG. 25(*a*) shows a mapping of the ITD data of the four thousand chirps of FIG. 23 onto a spherical surface, using a random (but incorrect) source direction, resulting in a function with a high degree of irregularities or low smoothness.

FIG. 25(*b*) shows a mapping of the ITD data of the four thousand chirps of FIG. 23 onto a spherical surface, using the correct source direction, resulting in a function with a high degree of regularities or high smoothness.

FIG. 25(*c*) and FIG. 25(*d*) show the effect a wrongly assumed source direction on the smoothness of the spectral data obtained from the chirps. In the example spectral information was used at 8100 Hz, but another frequency can also be chosen. As can be seen, "the surface of FIG. 25(*c*) is highly irregular, whereas the surface of FIG. 25(*d*) is much "smoother". It is contemplated that many different ways can be used to express the degree of continuity or smoothness, herein referred to as "quality value".

In preferred embodiments of the present invention, the smoothness is determined by calculating a "total distance" between the mapped ITD or spectral values and a spatially filtered low-pass version of the mapped data, which can be considered as "reference surface". It is contemplated that known filtering techniques can be used for this purpose. It is important to note that the "reference surface" so obtained is not predetermined, and is not derived from an IDT or HRTF database, but is derived from the captured data itself, in other words, also the reference surface is personalized.

Figure 26A:
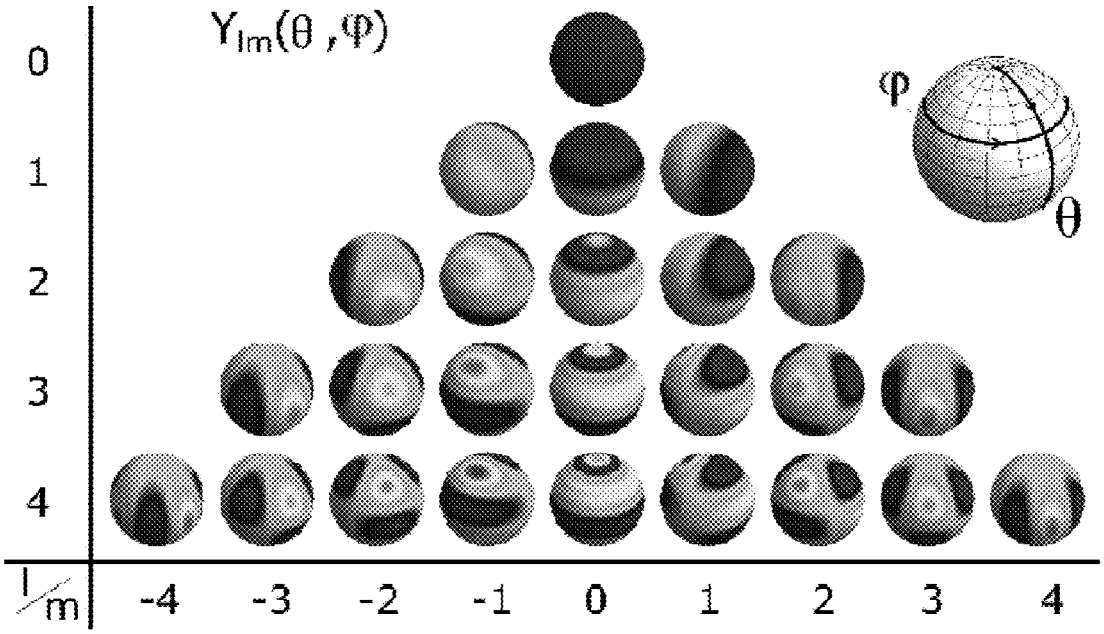
FIG. 26(*a*) shows a set of low order real spherical harmonic basis function, which can be used to generate or define functions having only slowly varying spatial variations. Such functions can be used to define "smooth" surfaces.
Figure 26B:
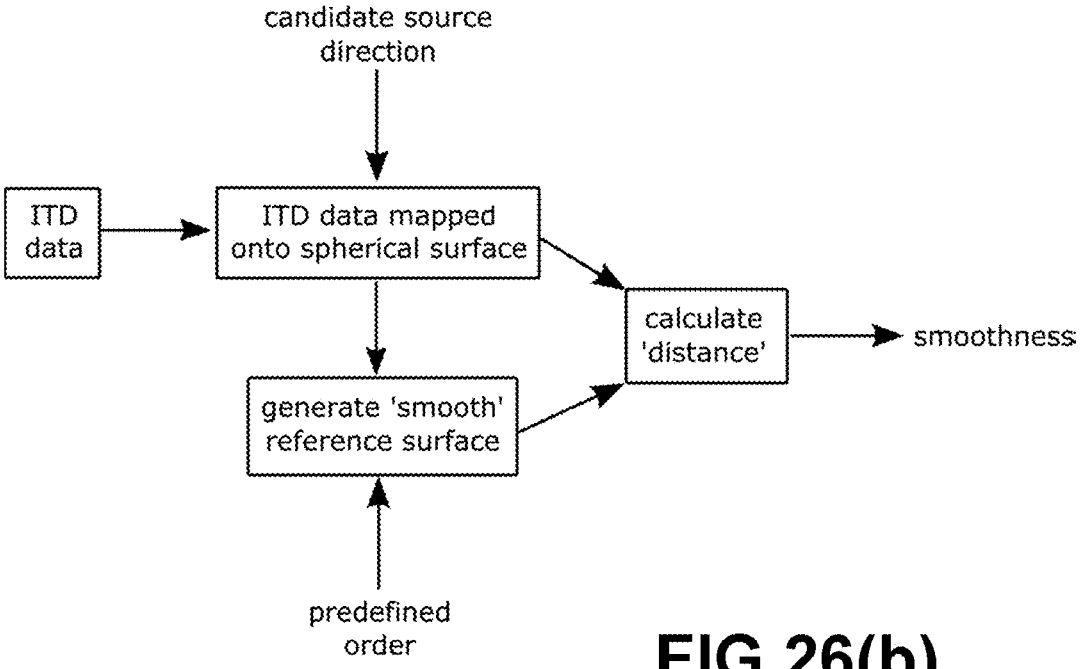

FIG. 26 illustrates one particular way for determining a "reference surface", based on approximating the surface by a series of a limited number of orthogonal base functions, in particular by limiting the maximum order of the series.

In preferred embodiments, the orthogonal base functions are "spherical harmonic functions".

FIG. 26(*a*) shows a graphical representation of these basis functions, to give an idea of what spherical harmonic functions look like. Readers familiar with image processing techniques will recognize similarities with Fourier series, but now the basis functions are defined on the sphere. Good results were found for orders in the range from 5 to 15, for example 10. The value of the order does not seem to be critical.

Referring to FIG. 26(*b*), when determining the "quality factor" or "smoothness value" of the 'candidate source direction' giving rise to this surface, first "a reference surface" is determined for this surface, for example by approximating the surface with a series of spherical harmonic functions with order=10.

Next, a "total distance" is calculated between the mapped measurement data and the (smooth) reference surface, as the squared sum of the differences for all the measurements (thus for each chirp). Any suitable "distance criterion" or "distance metric" can be used, for example:

d1=absolute value of difference between actual data and reference data, or d2=square of difference between actual data and reference data, or any other suitable distance criterion. We refer to the Appendix for more details.

FIG. 26(*b*) shows a technique to quantify smoothness of a function defined on the sphere, e.g. ITDF, which can be used as a smoothness metric.

Figure 27A:
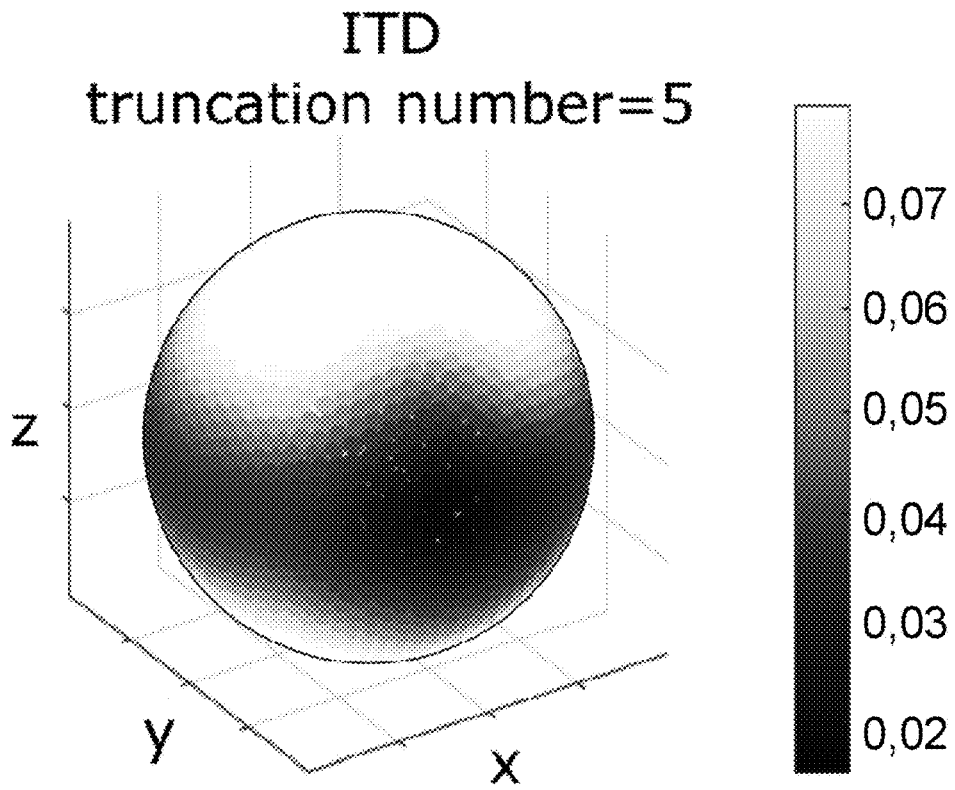
FIG. 27(*a*) shows the smoothness value according to the smoothness metric defined in FIG. 26(*b*) for two thousand candidate "source directions" displayed on a sphere, when applied to the ITD-values, with the order of the spherical harmonics set to 5. The grayscale is adjusted in FIG. 27(*b*).
Figure 27B:
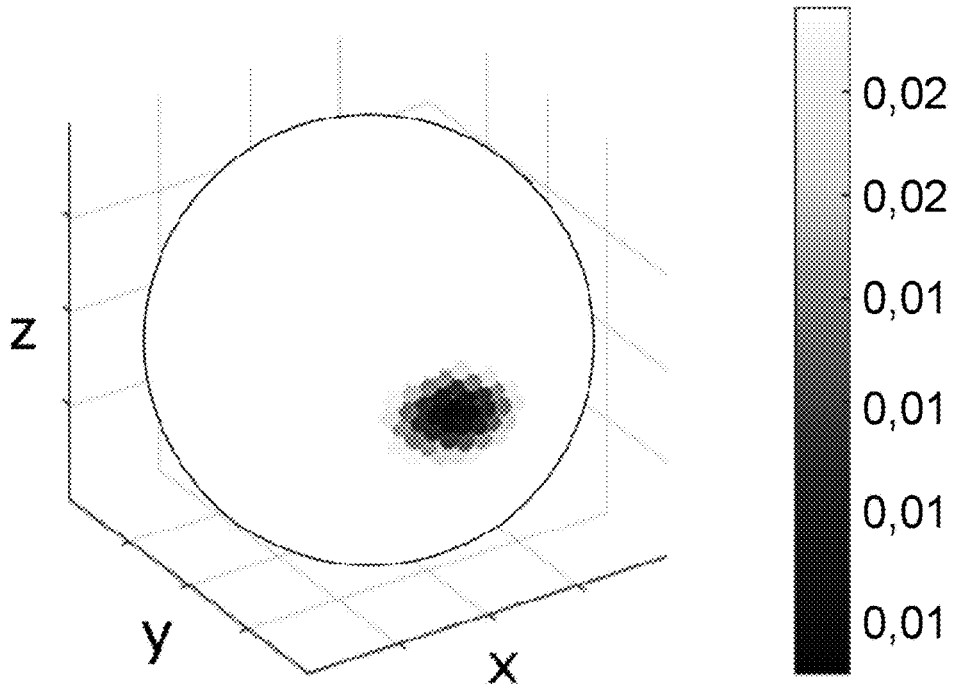

FIG. 27(*a*) shows the smoothness value (indicated in gray shades) according to the smoothness metric defined in FIG. 26(*b*) for two thousand candidate "source directions" displayed on a sphere, when applied to the ITD-values, with the order of the spherical harmonics set to 5. The grayscale is adjusted in FIG. 27(*b*). It is clear from this figure that the smoothness values on the sphere attain a clear minimum, and as a result the source direction with respect to the world can be localized at this direction (or point on the sphere). It is not visible on this figure, but the surface representing the smoothness values exhibits mirror symmetry and a local minimum is also positioned at the opposite side of the sphere. This explains why one can only estimate the direction if the source in 1002 and 1300, and not the sign. Note also that, at least in this particular example, the surface representing the smoothness values does not have other local minima, simplifying the search considerably.

Figure 28A:
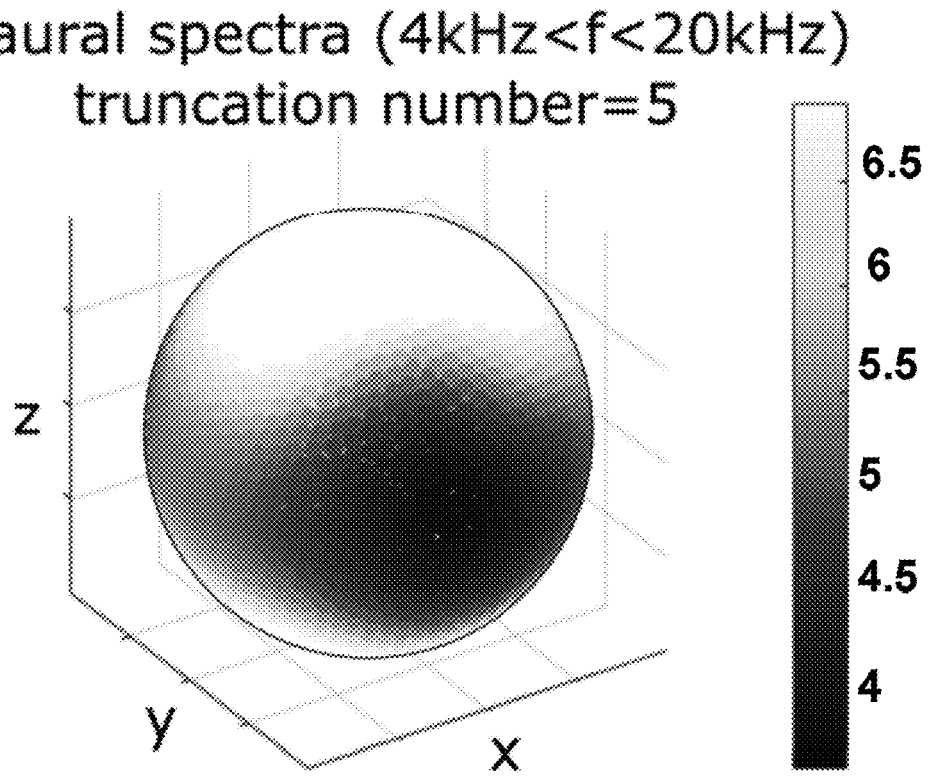
FIG. 28(*a*) shows the smoothness values, when applying the smoothness criterion to binaural spectra, with the order of the spherical harmonics set to 5, the smoothness value for each coordinate shown on the sphere being the sum of the smoothness value for each of the frequencies in the range from 4 kHz to 20 kHz, in steps of 300 Hz. The grayscale is adjusted in FIG. 28(*b*).
Figure 28B:
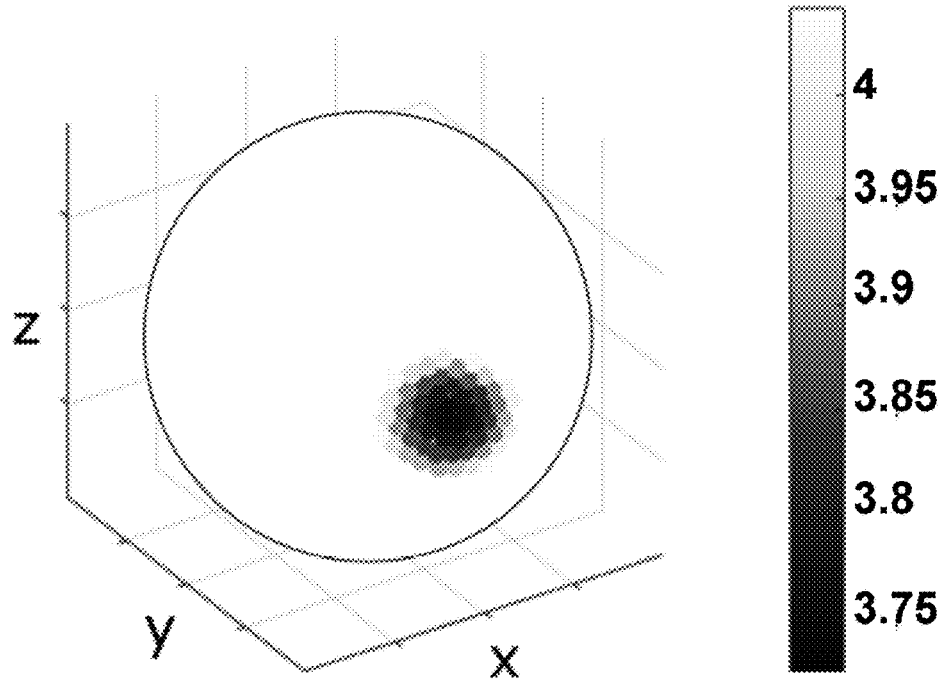

FIG. 28(*a*) shows the smoothness values indicated when applying the smoothness criterion to binaural spectra, with the order of the spherical harmonics set to 5, the smoothness value for each coordinate shown on the sphere being the sum of the smoothness value for each of the frequencies in the range from 4 kHz to 20 kHz, in steps of 300 Hz. The grayscale is adjusted in FIG. 28(*b*). Similar conclusions can be drawn as in FIG. 27(*a*).

Figure 29A:
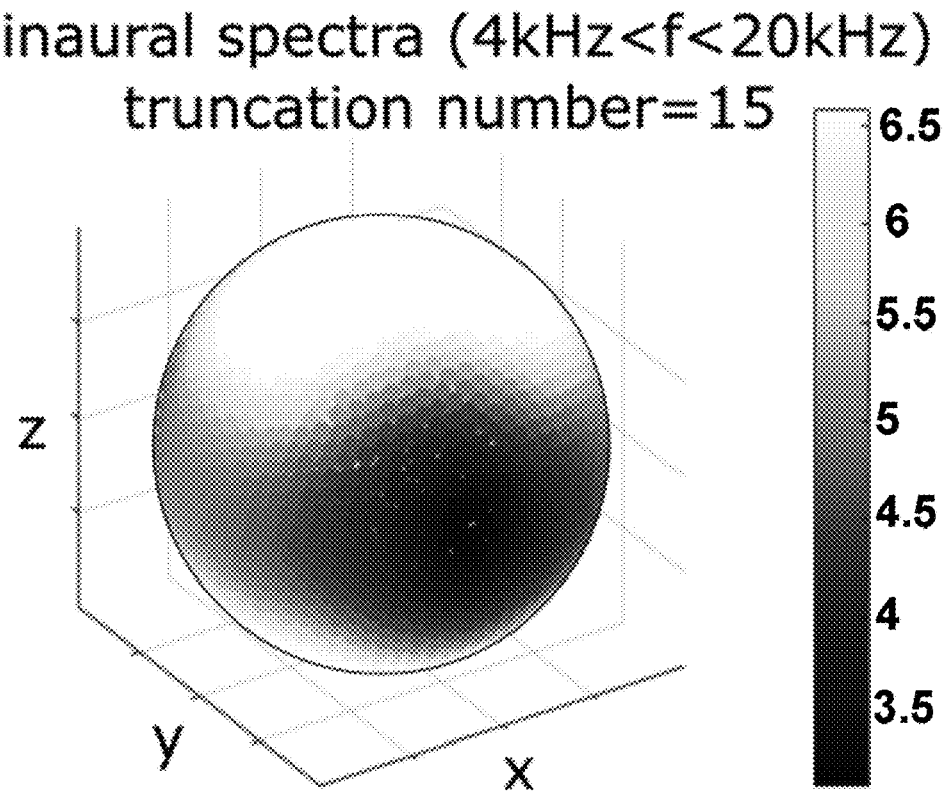
FIG. 29(*a*) shows the smoothness values, when applying the smoothness criterion to binaural spectra, with the order of the spherical harmonics set to 15. The grayscale is adjusted in FIG. 29(*b*).
Figure 29B:
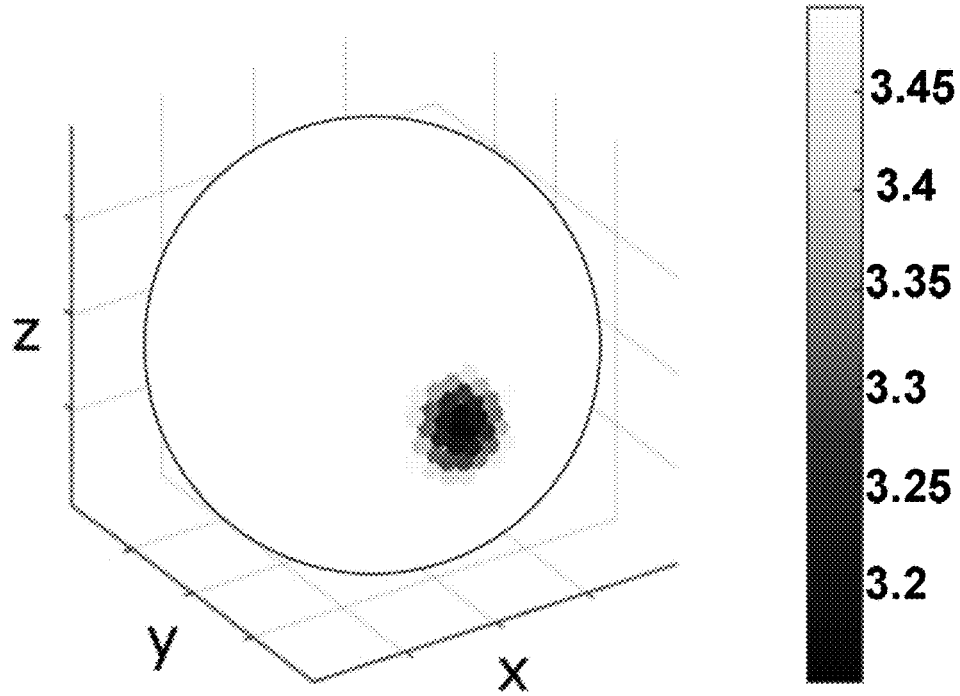

FIG. 29(*a*) shows the smoothness values, when applying the smoothness criterion to binaural spectra, with the order of the spherical harmonics set to 15. The grayscale is adjusted in FIG. 29(*b*). Similar conclusions can be drawn as in FIG. 27(*a*).

Figure 30A:
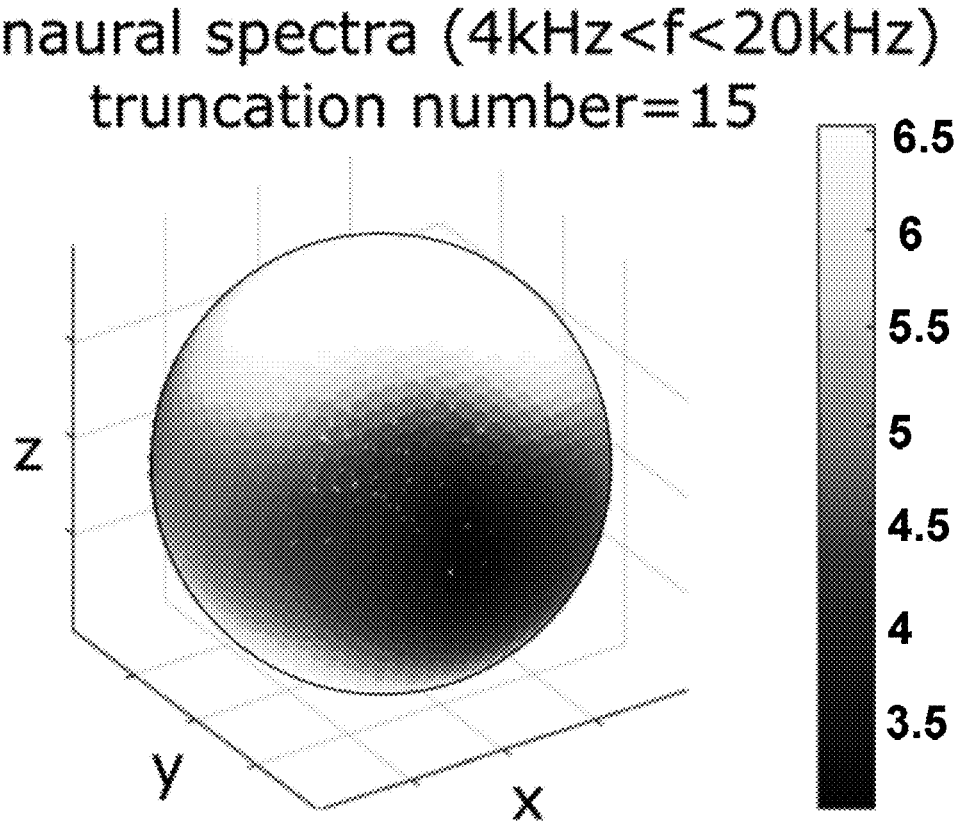
FIG. 30(*a*) shows the smoothness values, when applying the smoothness criterion to monaural spectra, with the order of the spherical harmonics set to 15. The grayscale is adjusted in FIG. 30(*b*).
Figure 30B:
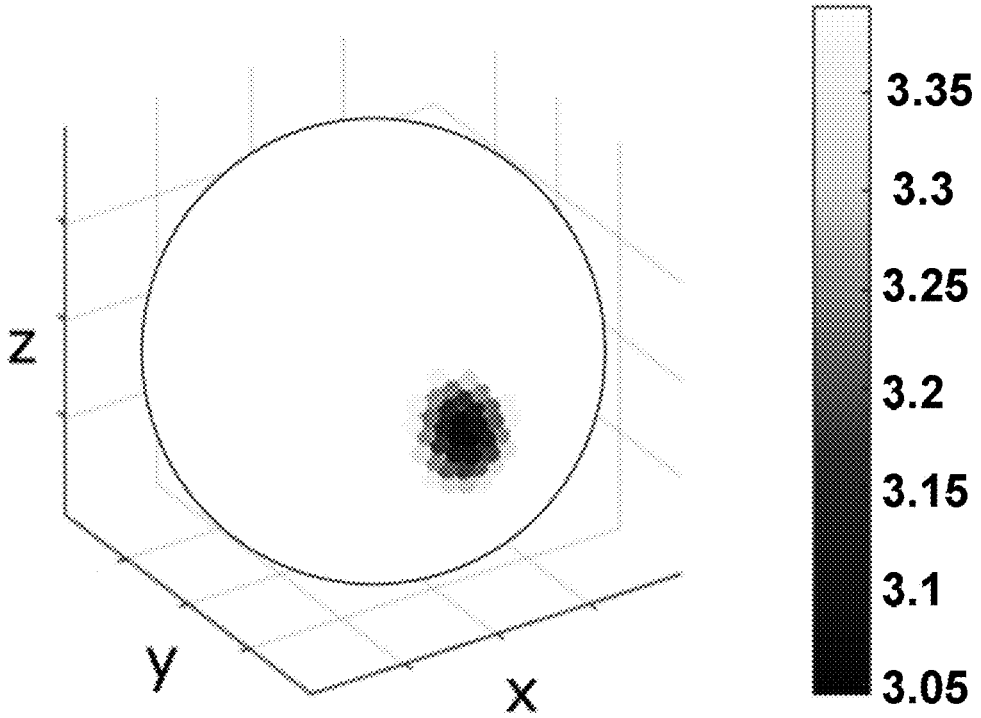

FIG. 30(*a*) shows the smoothness values, when applying the smoothness criterion to monaural spectra, with the order of the spherical harmonics set to 15. The grayscale is adjusted in FIG. 30(*b*). Similar conclusions can be drawn as in FIG. 27(*a*).

The above examples illustrate that the principle of finding the source direction re. world in the way described above, based on minimizing or maximizing a quality value, works and is quite accurate. Moreover, it is quite feasible in terms of computational complexity, does not require huge amounts of memory or processing power. For example, no DSP is required.

FIG. 31 Illustrates the model parameters of an a priori model of the head centre movement, that could be used in 1004, 1104, 1503. When a person is seated on an office chair and is allowed to rotate his/her head freely in all directions, and to rotate freely along with the chair with the body fixed to the chair, then the movement of the head centre can be described using this relatively simple mechanic model. The centre of the head ($\vec{r}_c$) is a distance b from the base of the neck (one rotation point), the base of the neck is a distance a from the rotation centre of the chair.

But other mechanical models of head movement are also contemplated, for example a model like that of FIG. 31, but without the chair motion, thus assuming that the head is mounted on a neck (distance a=0).

In another variant of FIG. 31, somewhat more complex than the model shown in FIG. 31, the model also takes into account that the person can lean forward or backward on the chair, thus there is an additional degree of motion.

It is contemplated that the large amount of data allows to determine the (most likely) model parameters, and once the model parameters are known, the orientation information and/or the acoustical information can be used to determine a particular state of the model at the time of capturing each audio fragment.

Figure 32:
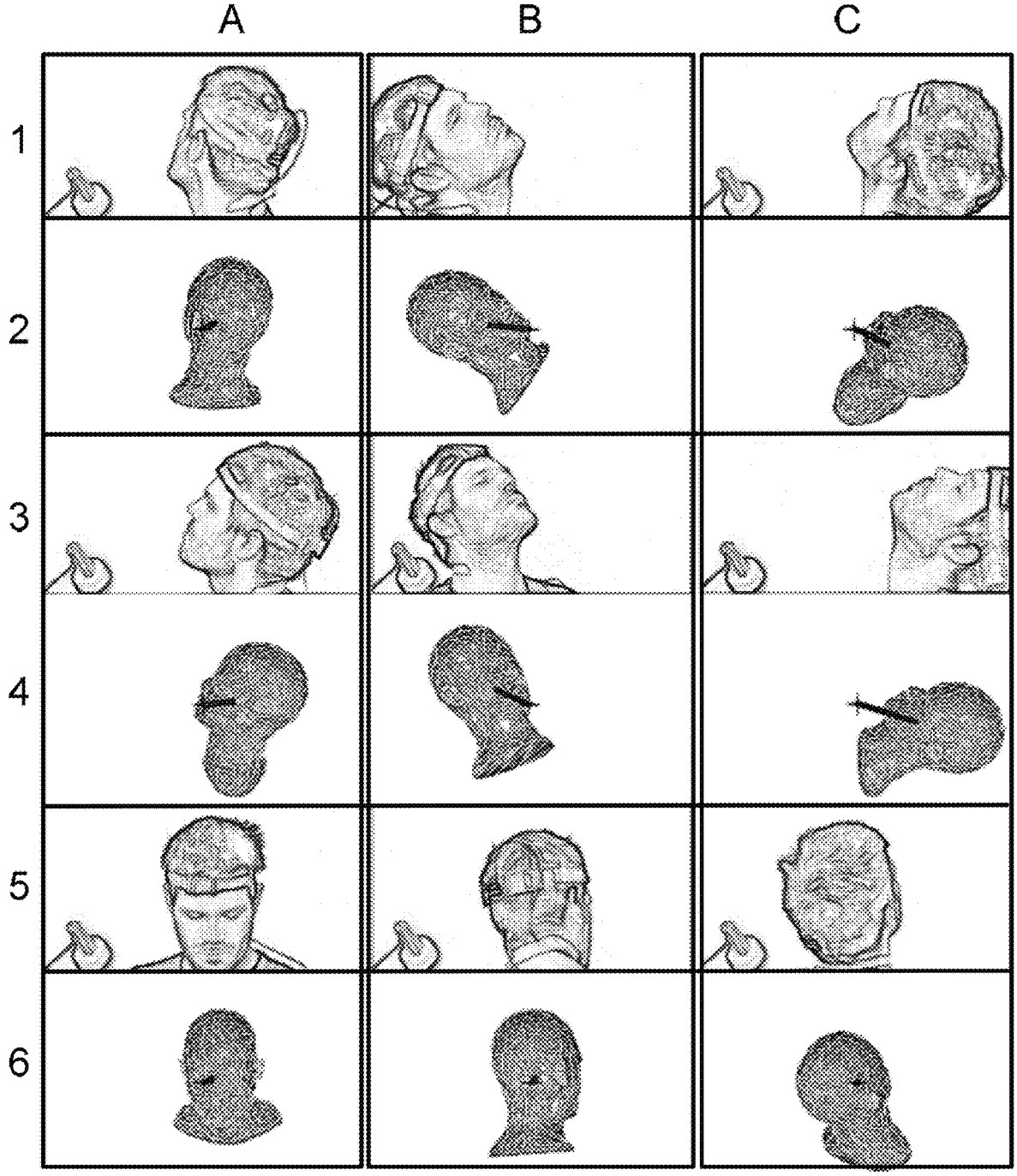
FIG. 32 shows snapshots of a video which captures a subject when performing an HRTF measurement on the freely rotating chair. Using the mechanical model of FIG. 31, information was extracted on the position of the head, (which resulted in better estimates of the direction of the source with respect to the head), as can be seen from the visualizations of the estimated head orientation and position. The black line shows the deviation of the centre of the head.

FIG. 32 shows snapshots of a video which captures a subject when performing an HRTF measurement on the freely rotating chair. Using the mechanical model of FIG. 31, information was extracted on the position of the head, (which resulted in better estimates of the direction of the source with respect to the head), as can be seen from the visualizations of the estimated head orientation and position. The black line shows the deviation of the centre of the head from the average centre of the head. These deviations will have effect on the perceived source direction with respect to the head, especially when the head is moved perpendicular to the source. Hence, including these translation of the head centre will improve the HRTF and ITDF estimate in 1005 and 1105.

Figure 33:
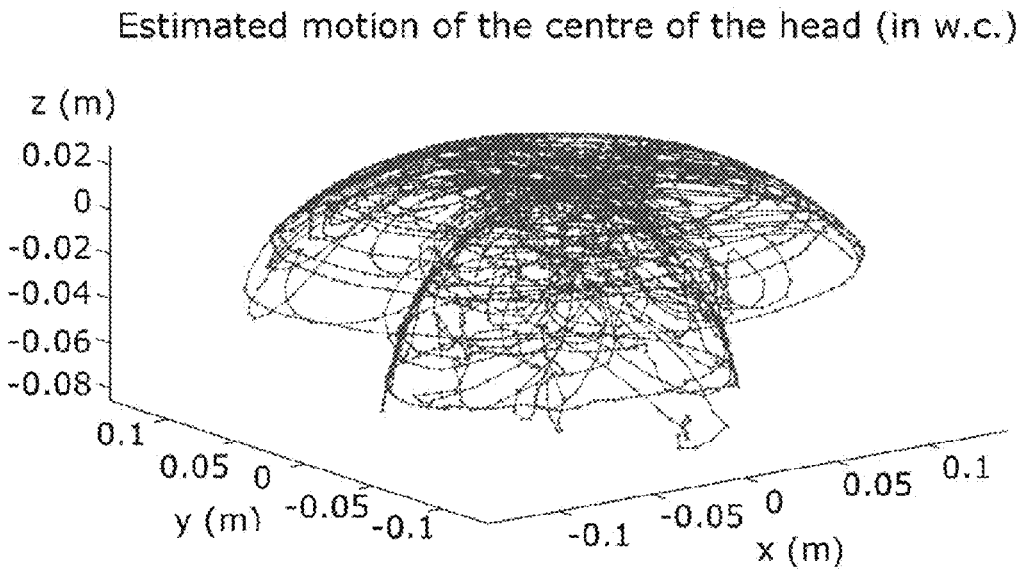
FIG. 33 is a graphical representation of the estimated positions (in world coordinates X,Y,Z) of the centre of the head during an exemplary audio-capturing test, using the mechanical model of FIG. 31.

FIG. 33 is a graphical representation of the estimated positions (in world coordinates X,Y,Z) of the centre of the head during an exemplary audio-capturing test, using the mechanical model of FIG. 31. Every dot corresponds to a head centre position at the time of arrival of one chirp. Note that the estimate centre of the head follows a continuous trajectory (consecutive dots are connected with a line). Every snapshot shown in FIG. 32 corresponds with a particular dot along this trajectory.

Figure 34:
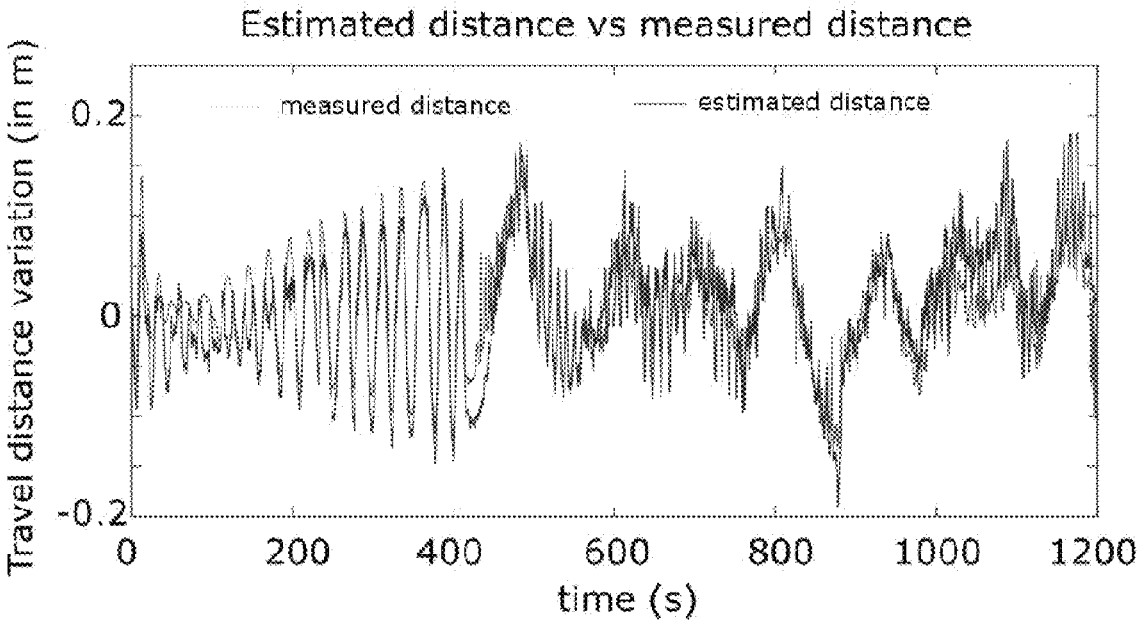
FIG. 34 shows a measurement of the distance between the head center and the sound source over time, as determined from the timing delays between consecutive chirps. The mechanical model of FIG. 31 allows for a good fit with these measured distance variations.

FIG. 34 shows a measurement of the distance between the head center and the sound source over time, as determined from the timing delays between consecutive chirps. Indeed, if the centre of the head would not move, then the time between successive received chirps would be constant. But if the head moves, the chirps will be delayed when the head moves away from the source, or, will arrive sooner when the head moves closer to the source. The differences in arrival times of the chirps can easily be translated in distance differences through multiplication with the speed of sound. These distance variations can then be used as input in 1503, to estimate the model parameters of the mechanistic model in shown in FIG. 31. It is clear from the (originally) red curve that the mechanical model of FIG. 31 allows for a good fit with these measured distance variations (originally blue curve).

FIG. 35 shows a comparison of two HRTFs of the same person: one was measured in a professional facility (in Aachen), the other HRTF was obtained using a method according to the present invention, measured at home. As can be seen, there is very good correspondence between the graphical representation of the HRTF measured in the professional facility and the HRTF measured at home.

OTHER CONSIDERATIONS

A commercial package sold to the user may comprise: a pair of in-ear microphones, and an audio-CD with the acoustic test signal. Optionally the package may also contain a head strap e.g. an elastic head strap, for fixing the portable device or portable device assembly to the persons head, but the latter is not essential. In fact, also the audio-CD is not essential, as the sound-file could also be downloaded from a particular website, or could be provided by other storage means, such as e.g. a DVD-ROM or a memory-card, or the like. The other hardware needed, in particular a device comprising an orientation sensor unit (such as e.g. a suitable smartphone), and a sound reproducing system with a loudspeaker (e.g. a stereo chain, or a computer with a sound-card, or an MP3-player or the like) and an audio capture unit (e.g. said smartphone equipped with a add-on device, or a computer, or the like) is expected to be owned already by the end-user, but could also be offered as part of the package.

The method, computer program and algorithm of the present invention do not aim at providing the most accurate HRTF and ITDF, but rather to approximate it sufficiently close so that at least the main problems of front vs. back misperceptions, and/or up vs. down misperceptions are drastically reduced, and preferably completely eliminated.

The present invention makes use of nowadays widespread technologies (smartphones, microphones, and speakers), combined with a user-friendly procedure that allows the user to execute the procedure him- or herself. Even though smartphones are widespread, using a smartphone to record stereo audio signals in combination with orientation information is not widespread, let alone to use the audio signals to correct the orientation information, relate the unknown orientation of the orientation unit to the reference frame of the head as used in standard HRTF and ITDF measurements, and localize the sound source. This means that the method proposed herein is more flexible (more user-friendly), and that the complexity of the problem is shifted from the data capturing step/set-up towards the post-processing, i.e. the estimation algorithm.

| REFERENCE LIST: | |
|---|---|
| 501, 601, 801: | computer |
| 502, 602, 702, 802: | loudspeaker |
| 503, 603, 703, 803: | person |
| 504, 604, 704, 804: | orientation unit |
| 505, 605, 705, 805: | in-ear microphones |
| 506: | support |
| 507: | chair |
| 608, 708, 808: | sound reproduction equipment |

APPENDIX

As a proof-of-principle, in the following results are shown that were obtained using a method according to one particular embodiment of the present invention.

The Measurement Setup

A single board computer (SBC) Raspberry PI 2 model B was used for capturing and storing audio data. An inertial-measurement unit (IMU) PhidgetSpatial Precision 3/3/3 High Resolution was used as orientation unit. This IMU measures gyroscope, magnetometer and accelerometer data. The SBC is extended with a sound card (Wolfson Audio Card), which allows stereo recording at 44.2 kSamples/sec with 16 bit resolution. The sensing and storage capabilities of this setup are comparable to that of at least some present-day (anno 2016) smartphone devices.

Binaural sound is captured by off-the-shelf binaural microphones (Soundman OKM II Classic) using the blocked ear-canal technique, although the latter is not absolutely required.

The processing of the acquired data was carried out on an laptop (Dell Latitude E5550, Intel Core™ i7 dual core 2.6 GHz, with 8 Gbyte RAM, Windows10, 64 bit). All signal processing was programmed in Matlab R2015b. The total processing time for processing 15 minutes of stereo sound and associated orientation information was about 30 minutes, the code not being optimized for speed.

The stimulus sound signal was played through a single loudspeaker (JBC), making use of an ordinary Hi-Fi system present at home.

All measurements were carried out at home, in an unmodified study room (dimensions about 4 m×3 m×2.5 m height, wooden floor, plastered walls, curtains, desk, cabinets, etc.). The subject was seated on an ordinary office chair located approximately 1.5 m from the loudspeaker, which pointed approximately at the rotation axis of the chair. The subject was instructed to sit upward and bend his head freely in all directions (up-, down-, sidewards). He was instructed to rotate the chair freely but slowly (by using his legs), whilst not moving his torso on the chair. Apart from these instructions the subject's movements were not controlled in any way. The IMU was fixed at an arbitrary location and in an arbitrary orientation to the back of the subject's head. The exact room dimensions, source height, subject position relative to speaker, starting position/orientation, loudspeaker/hi-fi system settings were not a-priori known to nor controlled by the system.

Estimation of the IMU Orientation

The orientation of the IMU was estimated based on the gyroscope, magnetometer and accelerometer sensor data, using the (batch-processing) classical Gauss-Newton method. The orientation of the IMU is represented with quaternions. FIG. 18(*a*)-(*d*) shows an example of such recorded (a) accelerometer, (b) magnetometer and (c) gyroscope data and (d) the estimated quaternion (orientation) dynamics over time.

The Stimulus Signal

An acoustic stimulus signal was designed that presents a reasonable compromise between the different constraints (average room dimensions, limited duration of the experiment) allowing for the extraction of the relevant acoustic information (frequency range from about 1 kHz to about 20 kHz, a frequency resolution of about 300 Hz and sufficient signal-to-noise ratio for a total measurement duration between 10-20 minutes).

In order for the measurement to be able to be carried out at home, one has to deal with the reflections of the sounds bouncing of the floor, walls and ceiling. This is achieved by working with short broadband chirps, interleaved with a sufficiently long intermittent silent period (inter-stimulus time). It is advantageous to isolate only the sound travelling along the direct path, and separate it from the first reflections, see FIG. 20. The time between the arrival of the direct sound and the first reflection at the subject is a property of the measurement setup (positions of the head and loudspeaker in the room). In this measurement, the subject was seated at a distance of approximately d=1.5 meter separated from the loudspeaker, both head and loudspeaker are at a height of approximately $h_e=h_x=h_e/2$=about 1.30 m, which is about half the height of the room. (see FIG. 20 for the definitions of $h_e$, $h_x$ and $h_e$).

The frequency resolution with which the spectral content of the direct sound can be extracted, depends on the time to the first reflection (Δt), the duration (T) and the frequency range (Δf) of the chirp, see FIG. 21. Every combination allows a particular frequency resolution (80, which can be obtained using the following inequality:

$$\frac{T\delta f}{\Delta f}+\frac{1}{\delta f}<\Delta t$$

In the experimental results shown, a chirp sweeping linearly down from f=20 kHz to 1 Hz during T=25 ms was used. This allows for a frequency resolution δf of approximately 300 Hz, which is similar to the frequency resolution used in common HRTF databases (cfr, CIPIC: 223 Hz). But different stimuli can also be used (exponential sweep, different duration, different frequency range, etc.).

Furthermore, the time between chirps should be sufficiently large, such that the recording of a chirp is not significantly influenced by the sound of the previous chirp(s), still reverberating in the room. The reverberation time is a property of the room, which depends on the dimensions and the absorption/reflection properties of the content (e.g. walls, furniture, etc). The reverberation time is often expressed as the time required for the sound intensity to decrease with 60 dB. In the rooms encountered during our tests an inter-chirp time of 275 ms was sufficient to exclude reverberation effects from affecting the quality of the measurements. If the method is applied in highly reverberant rooms this inter-chirp time might need to be increased resulting in a longer measurement duration.

Extracting Timing and Spectral Information

In order to extract the timing and spectral information from the captured audio signals, a spectrogram representation of the microphone signals was used and its squared modulus was plotted, providing spectral information as function of time. In FIG. 22(*a*), the spectrogram is shown for 1.2 sec of recorded sound (in one ear). Next, the spectrogram is 'rectified', by compensating for the known frequency-dependent timing delays in the chirps, see FIG. 22 (*b*). Next the intensity along the frequency axis is summed, as shown in FIG. 22(*c*). The estimated arrival time of a chirp is now the time at which the summed intensity pattern corresponding with this chirp peaks. The spectral content is then obtained by evaluating the spectrum at the corresponding arrival time in the rectified spectrogram shown in FIG. 22 (*b*). The corresponding spectral content for the different chirps are shown in FIG. 23(*a,b*), for the left (a) and right ear (b) respectively on a dB scale. It is noted that this is not the only way to extract timing and spectral information, many other ways exist, e.g. inverse filtering.

Estimation of the Sound Source Direction

In order to estimate the "sound source direction", the IMU orientations (from the orientation sensor data) and the extracted spectral and/or ITD information (from the binaural audio data) is used. The used approach is partially based on the fact that the HRTF and ITDF are spatially smooth functions. The method can be understood as follows.

First the HRTF/ITDF are determined with respect to the IMU (not relative to the head, which is counter-intuitive, because HRTF is always expressed relative to the head). If the exact source direction r would be known relative to the world reference frame, one could relate to every IMU orientation measurement a single sampled source direction $(\theta,\phi_i)=r_i$, which would result in a discretely sampled version of the HRTF ($S^r(r_i)$), as shown in FIG. 25(*d*) for f=8100 Hz. A relatively smooth pattern can be recognized over the sphere. However, if an erroneous source direction relative to the world reference frame is assumed, one arrives at a different, much more chaotic and less smooth, pattern, as shown in FIG. 25(*c*). The inventors came to the insight that, from the perspective of the IMU, different choices for the source direction do not merely result in a rotation of the true HRTF, but instead, as can be understood by comparing FIGS. 25(*c*) and (*d*) give rise to HRTFs that contain large amounts of spurious variation. Hence, the 'smoothness' characteristic of the HRTF and/or ITDF can be used to derive a quality criterion for evaluating candidate source directions. The optimization of this quality criterion then leads to the best sound source direction estimate.

Different criteria can be chosen to quantify 'smoothness'. In this application, the measured HRTF data is expanded in real spherical harmonics (SH), which are basis functions similar to Fourier basis $$S^r_{L/R}(f, r_i) \approx \sum_{l=0}^{L} \sum_{m=-l}^{l} C^{r,L/R}_{l,m}(f) Y_{lm}(r_i)$$

functions, but defined on a sphere. Similar to Fourier basis functions, real SH basis functions $Y_{lm}(\theta,\varphi)$ have the property that lower l-values correspond to more slowly varying basis functions. Hence, this means that if the HRTF is expressed in a truncated basis containing only basis functions up to a chosen or predefined maximum order L (l<L), a low-pass filter is effectively applied that only allows for slow spatial variations. The higher the chosen L value, the more spatial 'detail' the basis expansion includes. Hence, in order to quantify 'smoothness', we first estimate the coefficients)

$$C_{l,m}^{r,L}(f) \text{ and } C_{l,m}^{r,R}(f)$$

which are coefficients of the HRTF expansion $$C_{l,m}^{r,L}(f) \text{ and } C_{l,m}^{r,R}(f)$$

corresponding respectively to the left and right ear HRTF at frequency f for the chosen direction r) in the SH basis truncated at some chosen L. Next, we calculate the squared difference between the measured data points and the obtained HRTF expansion (in which a sum is calculated over all measured directions and all measured frequencies):

This error quantifies to what extent the basis of slowly varying basis functions is adequate in $$\varepsilon^2_{HRTF}(r) = \sum_f \sum_{r_i} \left\{ \begin{array}{l} \left[ S^r_L(f, r_i) - \sum_{l=0}^{L} \sum_{m=-l}^{l} C^{r,L}_{l,m}(f) Y_{lm}(r_i) \right]^2 + \\ \left[ S^r_R(f, r_i) - \sum_{l=0}^{L} \sum_{m=-l}^{l} C^{r,R}_{l,m}(f) Y_{lm}(r_i) \right]^2 \end{array} \right\}$$

describing the spatial pattern present in the measured HRTF over the sphere. The smaller the error, the better the acoustic data was approximated using only slowly varying basis functions, and consequently, the smoother the HRTF pattern. Consequently, this error can be used as a quality criterion. Note that the same procedure can also be applied using monaural HRTF or ITDF measurements.

The Gauss-Newton method was used to estimate the source direction r, through minimization of $\varepsilon_{HRTF}^2(r)$. In the present implementation, L=10 is used for the expansion of the HRTF, but other values larger than 10, for example 15, or smaller than 10 may also apply, for example L=9 or L=8 or L=7 or L=6 or L=5 or L=4. It is noted that binaural HRTF information was used for a frequency range from 5 khz-10 kHz, but ITDF or monaural spectral information could also be used, or a different frequency range could also be chosen. The optimal sound source direction was found to be very close to the actual direction. Examples of this error on the sphere are shown in FIGS. 27, 28, 29 and 30, based on the ITDF and monaural/binaural HRTF information, for different L values.

The resulting $r_i$ with their corresponding values $S^r(f,r_i)$ are shown in FIG. 25(*d*) for the right ear and a frequency of 8100 Hz. Also the resulting ITDF is shown in FIG. 25(*b*). It is noted that this method only allows to estimate the direction except for its sign of the sound source. So there is still uncertainty on the exact direction of the source: two opposite source directions are possible. To resolve this ambiguity, other properties of the HRTF can be exploited.

It is noted that this error may also be used in an iterative procedure to further improve the overall quality of the HRTF/ITDF estimation; to improve the orientation estimation of the IMU (e.g. by optimizing the model parameters of the noise of the IMU); and/or to estimate a timing delay between orientation data and audio data (if data capture was not fully synchronous).

Also other smoothness criteria can be defined. For example the following could also be chosen:

$$\varepsilon^2_{HRTF}(r) = \sum_f \left[ (C^{r,L}_{L,0}(f))^2 + (C^{r,R}_{L,0}(f))^2 \right]$$

-continued or $$\varepsilon^2_{HRTF}(r) = \sum_f \sum_{r_i} \{[\nabla^2 S^r_L(f, r_i)]^2 + [\nabla^2 S^r_R(f, r_i)]^2\}$$

Also other norms than the Euclidean norm can be used such as a general p-norm or an absolute value norm.

Estimation of the Orientation of the Ear-Ear Axis

To estimate the orientation of the ear-ear axis, the symmetry of the ITDF and/or HRTF (left vs right) with respect to the plane perpendicular to the ear-ear axis is exploited. In the following, the symmetry of the ITDF is used.

First a particular value for the direction of the ear-ear axis a is assumed. Then all the directions $r_i$ are mirrored with respect to the plane perpendicular to this ear-ear axis, resulting in the directions $r'_i$. Next, it is assumed that the ITD values for the mirrored directions equal $ITD'_i = -ITD_i$, and the original and the mirrored dataset are merged into a single dataset. Now, if the merged ITD set is plotted, it only results in a smooth pattern in case the assumed a is the true direction of the ear-ear axis. If an erroneous ear-ear axis is assumed, the pattern is again much more chaotic.

Hence, as before, the 'smoothness' criterion is used as a quality factor to estimate the direction of the ear-ear axis, but now by projecting the merged ITD set in a truncated basis of spherical harmonics. Again the Gauss-Newton method is used to arrive at the best estimate of the direction of the ear-ear axis.

Estimation of the Frontal Direction of the Subject

The frontal direction of the person is defined to coincide with the frontal direction in traditional HRTF measurements (cfr. CIPIC database). Stated in simple terms, the forward direction is close to the direction in which the person's nose points as seen from the center of the head.

To estimate the frontal direction of the subject, the HRTF is rotated around the ear-ear axis and the resulting HRTF is compared with a general HRTF (e.g. the average of a database of HRTFs that has been measured under controlled circumstances). Since only the direction of the source except for its sign is known, this procedure is performed for the two candidate (=opposite) source directions. The frontal direction and the sign of the source direction is then estimated by selecting the rotation angle and sign for which the measured HRTF resembles the general HRTF most.

There are different ways to compare two HRTFs, e.g. by calculating the dot product or by calculating the mean squared difference, etc. In this implementation, first the interpolated general HRTF is evaluated in the presumed sampled directions, next both the sampled general HRTF and the measured HRTF are normalized on a per frequency basis and finally both HRTFs are compared, by calculating the mean squared difference. The frontal direction (and sign of the source direction) is then estimated based on the angle (and sign of the source direction) for which the mean squared difference of the rotated general HRTF and the measured HRTF is minimal.

Estimating the Deviation of the Head Centre (Re. World)

So far, it was assumed that the head is rotating around the centre of the head (which is defined as the point in the middle between both ears). Of course in reality this is not the case. The head centre will move back and forth, up and down, and these deviations from its 'average' position will have an effect on the direction that is actually sampled, i.e., it may be different from when the head remains fixed. The direction errors are larger as the head moves further away from this 'average' position, and in particular when it moves perpendicular to the source direction. Including these additional translations of the head center, will improve the estimated direction of the sound source, and as a result will improve also the resulting HRTF and ITDF estimation.

There are different ways to 'track' the movement of the head center. In one implementation, it is done on the basis of a model for the human head movement, and on an analysis of the variation of the timing between subsequent chirps.

The model describes the typical movements of the head. In such implementation, the subject is instructed to sit upright on a rotating office chair, keep his torso fixed to the chair, and only move his head in all possible directions, while slow rotations about a vertical axis are performed using the rotation capabilities offered by the chair. This limits the possible head movements and can be modeled using a relatively simple mechanical model shown schematically in FIG. 31. The centre of the head ($r_e$) is a distance b from the base of the neck (one rotation point), the base of the neck is a distance a from the rotation centre of the chair. The a priori model of the head centre then reads:

$$r_c = \begin{matrix} a\cdot\cos(\theta_1) + b\cdot\cos(\theta_1+\theta_2)\sin(\varphi+\varphi_0) \\ a\cdot\sin(\theta_1) + b\cdot\sin(\theta_1+\theta_2)\sin(\varphi+\varphi_0), \\ b\cdot\cos(\phi+\varphi_0). \end{matrix}$$

The pitch angle $\varphi$ of the neck and yaw angles $\theta_1$ and $\theta_2$, indicated in FIG. 31, are unknowns, but can be estimated based on the orientations of the head. The pitch angle $\varphi$ of the neck is identical to the pitch angle of the head, up to an offset $\varphi_0$ (the neck axis is not necessarily parallel to the z-axis of the head). Moreover, $\theta_1$ and $\theta_2$ can both be estimated from the head yaw angle $\theta$. Indeed, as the test person was instructed to make many head movements in each position of the chair, and only rotate the chair very slowly, one can assume that the yaw angle corresponding to the chair ($\theta_1$) is the slowly varying component of the total yaw angle ($\theta$), while the yaw angle corresponding with the neck is the fast varying component ($\theta_2$).

In order to estimate the remaining model parameters (a, b, $\varphi_0$), use can be made of the fact that the distance to the source varies during the head/chair movement. These movements along the sound source direction can be measured by inspection of the timing between consecutive chirps. Indeed, if the centre of the head would not move, then the time between successive received chirps would be constant. But if the head moves, the chirps will be delayed when the head moves away from the source, or, will arrive sooner when the head moves closer to the source. The differences in arrival times of the chirps can easily be translated in distance differences $\Delta r_{meas}(t)$, through multiplication with the speed of sound.

Mainly a head centre displacement along the source direction will affect the distance to the source, and hence the distance variation according to the model $\Delta r_{mod}(t)$ can be written as $$\Delta r_{mod}(t) = a\cdot\cos(\theta_1(t)-\theta_{source}) + b\cdot\cos(\theta_1(t)+\theta_2(t)-\theta_{source})\sin(\varphi(t)+\varphi_0)$$

Next, these model parameters $\varphi_0$, a and b are estimated using Gauss-Newton estimation method through minimization of $$\sum_i [\Delta r_{mod}(t_i) - \Delta r_{meas}(t_i)]^2$$

In FIG. 34 the distance variation (with offset) during the measurement is shown as function of time. One curve (originally the blue curve) is the estimated distance $\Delta r_{meas}(t)$ based on the measured time between chirps, the other curve (originally the red curve) is the estimated distance $\Delta r_{mod}(t)$ obtained from the optimized model. Both are in relatively good agreement.

In FIG. 33 the trajectory of the deviations of the center of the head (relative to the 'average' center) is shown as obtained by the model. It is noted that (0,0,0) corresponds to the 'average' center position. As can be seen, the position of the true center of the head is indeed not constant.

FIG. 32 shows (odd numbered rows) snapshots of a video which was captured of a subject when performing an HRTF measurement on the freely rotatable chair, juxtaposed (even numbered rows) with visualizations showing the estimated head orientation and position. The black line shows the deviation of the centre of the head.

Estimating Unknown Transfer Characteristic of Loudspeaker and/or Microphones

The exact transfer characteristics of the loudspeaker and the microphones are not known, nor are the spectral characteristics of the sound production system. In order to compensate for this unknown transfer characteristic, the energy of the spectral information is adjusted on a per frequency basis, so that the energy at each frequency substantially equals that of a general HRTF (the average of a database of HRTFs that has been measured under controlled circumstances, like the CIPIC database).

Estimating the HRTF and the ITDF Over the Full Sphere

Preceding steps lead to a sampled version of the HRTF and ITDF. But because of the uncontrolled, irregular movements of the head, some areas will be sampled more densely than others, while others are not sampled at all, due to the limited range of realistic head movements. Note that, so far, the SH-representation was only used to assess the smoothness of the HRTF or ITDF. Therefore the SH representation was only evaluated in the same data points that were used to 'build' the SH representation and hence the SH-representation was never evaluated in areas that were not sampled.

However, in order to allow estimation of the HRTF and the ITD over the full sphere, which is required for an audio rendering system to create the illusion of sound coming from any direction, an interpolation based on real spherical harmonics SH is applied. A limited truncation order of the SH basis is considered to interpolate the HRTF (l<=15) and ITD (l<=5), as this captures sufficient spectral detail. However, because of the limited number of directional samples and the fact that some parts of the sphere have not been sampled at all, regularization problems might appear.

To address these regularization problems when estimating the SH coefficients, Tikhonov regularization as described in Zotkin et al. is applied. Again different criteria are possible, but in this implementation, the norm of the coefficient vector, consisting of coefficients with order l>2, is minimized (in addition to the sum of squared residuals). This way, the solution is 'forced' to make use as much as possible of the slowly varying low order SH basis functions, guaranteeing the HRTF values do not grow too large in areas that have not been sampled.

HRTF Evaluation

The HRTF obtained using the current implementation has been compared to the HRTF measured in a professional, state-of-the-art facility (the anechoic room at the University of Aachen). Both methods clearly produce similar HRTFs, see FIG. 35, FIG. 35(*b*) and FIG. 35(*d*) being measured in Aachen, FIG. 35(*c*) and FIG. 35(*e*) being determined with the method of the present invention, of course for the same subject.

REFERENCES

D. Zotkin, R. Duraiswami, N. Gumerov, "Regularized HRTF fitting using spherical harmonics", Applications of signal processing to audio and acoustics, (WASPAA) 2009 IEEE Workshop on, pp. 257-260, 2009.

The invention claimed is:

1. A method of estimating an individualized head-related transfer function and an individualized interaural time difference function of a particular person in a computing device, the method comprising the steps of:

a) obtaining or retrieving a plurality of data sets, each data set comprising a left audio sample originating from a left in-ear microphone and a right audio sample originating from a right in-ear microphone and orientation information originating from an orientation unit, the left audio sample and the right audio sample and the orientation information of each data set being substantially simultaneously captured in an arrangement wherein:

the left in-ear microphone being inserted in a left ear of the person, and the right in-ear microphone being inserted in a right ear of the person, and the person being located at a distance from a loudspeaker, and the orientation unit being fixedly mounted to the head of the person, and the loudspeaker being arranged for rendering an acoustic test signal comprising a plurality of audio test-fragments, and the person moving his or her head in a plurality of different orientations during the rendering of the acoustic test signal;

b) extracting or calculating a plurality of interaural time difference values and/or a plurality of spectral values, and corresponding orientation values of the orientation unit from the data sets;

c) estimating a direction of the loudspeaker relative to an average position of the center of the head of the person and expressed in the world reference frame, comprising the steps of:

1) assuming a candidate source direction;

2) assigning a direction to each member of at least a subset of the plurality of interaural time difference values and/or each member of at least a subset of the plurality of spectral values, corresponding with the assumed source direction expressed in a reference frame of the orientation unit, thereby obtaining a mapped dataset;

3) calculating a quality value of the mapped dataset based on a predefined quality criterion;

4) repeating steps 1) to 3) at least once for a second and/or further candidate source direction different from previous candidate source directions;

5) choosing the candidate source direction resulting in the highest quality value as the direction of the loudspeaker relative to the average position of the center of the head of the person;

d) estimating an orientation of the orientation unit relative to the head;

e) estimating the individualized ITDF and the individualized HRTF of the person, based on the plurality of data sets and based on the estimated direction of the loudspeaker relative to the average position of the center of the head estimated in step c) and based on the estimated orientation of the orientation unit relative to the head estimated in step d);

wherein the steps a) to step e) are performed by at least one computing device.

2. The method of claim 1, wherein step b) comprises:

locating a plurality of left audio fragments and right audio fragments in the plurality of data sets, each left and right audio fragment corresponding with an audio test fragment rendered by the loudspeaker;

calculating an interaural time difference value for at least a subset of the pairs of corresponding left and right audio fragments;

estimating a momentary orientation of the orientation unit for each pair of corresponding left and right audio fragments.

3. The method of claim 1, wherein step b) comprises or further comprises:

locating a plurality of left audio fragments and/or right audio fragments in the plurality of data sets, each left and/or right audio fragment corresponding with an audio test fragment rendered by the loudspeaker;

calculating a set of left spectral values for each left audio fragment and/or calculating a set of right spectral value for each right audio fragment, each set of spectral values containing at least one spectral value corresponding to one spectral frequency;

estimating a momentary orientation of the orientation unit for at least a subset of the left audio fragments and/or right audio fragments.

4. The method according to claim 1, wherein the predefined quality criterion is a spatial smoothness criterion of the mapped data, or based on a deviation or distance between the mapped data and a reference surface, where the reference surface is calculated as a low-pass variant of said mapped data, or based on a deviation or distance between the mapped data and a reference surface, where the reference surface is based on an approximation of the mapped data, defined by the weighted sum of a limited number of basis functions, or expressing a degree of the mirror anti-symmetry of the mapped ITDi data, or expressing a degree of cylindrical symmetry of the mapped ITDi data.

5. The method according to claim 1, further comprising:

f) estimating model parameters of a mechanical model related to the head movements that were made by the person at the time of capturing the audio samples and the orientation information of step a);

g) estimating a plurality of head positions using the mechanical model and the estimated model parameters; and wherein step c) comprises using the estimated head positions of step g).

6. The method of claim 5, wherein the mechanical model is adapted for modeling at least rotation of the head around a center of the head, and at least one of the following movements:

rotation of the person around a stationary vertical axis, when sitting on a rotatable chair;

moving of the neck of the person relative to the torso of the person.

7. The method according to claim 1, wherein step b) comprises:

estimating a trajectory of the head movements over a plurality of audio fragments;

taking the estimated trajectory into account when estimating the head position and/or head orientation.

8. The method according to claim 1, wherein step e) further comprises estimating a combined filter characteristic of the loudspeaker and the microphones, or comprises adjusting the estimated ITDF such that the energy per frequency band corresponds to that of a general ITDF and comprises adjusting the estimated HRTF such that the energy per frequency band corresponds to that of a general HRTF.

9. The method of claim 8, wherein estimating the combined spectral filter characteristic of the loudspeaker and the microphones comprises:

making use of a priori information about a spectral filter characteristic of the loudspeaker, and/or making use of a priori information about a spectral filter characteristic of the microphones.

10. The method according to claim 1, wherein step b) estimates the orientation of the orientation unit by also taking into account spatial information extracted from the Left and Right audio samples, using at least one transfer function that relates acoustic cues to spatial information, wherein the at least one predefined transfer function that relates acoustic cues to spatial information is a predefined interaural time difference function, or wherein the at least one transfer function that relates acoustic cues to spatial information are two transfer functions including a predefined interaural time difference function and a predefined head-related transfer function; or wherein the method comprises performing steps b) to e) at least twice, wherein step b) of the first iteration does not take into account said spatial information, and wherein step b) of the second and any further iteration takes into account said spatial information, using the interaural time different function and/or the head related transfer function estimated in step e) of the first or further iteration.

11. The method according to claim 1, wherein step e) of estimating the ITDF function comprises making use of a priori information about the personalized ITDF based on statistical analysis of a database containing a plurality of ITDFs of different persons.

12. The method according to claim 1, wherein step e) of estimating the HRTF comprises making use of a priori information about the personalized HRTF based on statistical analysis of a database containing a plurality of HRTFs of different persons.

13. The method according to claim 1, wherein the orientation unit comprises at least one orientation sensor adapted for providing orientation information relative to the earth gravity field and at least one orientation sensor adapted for providing orientation information relative to the earth magnetic field and/or wherein the method comprises fixedly mounting the orientation unit to the head of the person and/or wherein the orientation unit is comprised in a portable device, and wherein the method further comprises the step of fixedly mounting the portable device comprising the orientation unit to the head of the person.

14. The method according claim 1, further comprising the step of:

rendering the acoustic test signal via the loudspeaker;

capturing said left and right audio signals originating from said left and said right in-ear microphone and capturing said orientation information from an orientation unit.

15. The method according to claim 1, wherein the orientation unit is comprised in a portable device, the portable device being mountable to the head of the person; and wherein the portable device further comprises a programmable processor and a memory, and interfacing means electrically connected to the left and right in-ear microphone, and means for storing and/or transmitting said captured data sets; and wherein the portable device captures the plurality of left audio samples and right audio samples and orientation information, and wherein the portable device stores the captured data sets on an exchangeable memory and/or transmits the captured data sets to the computing device; and wherein the computing device reads said exchangeable memory or receives the transmitted captured data sets, and performs steps c) to e) while or after reading or receiving the captured data sets, or wherein the method further comprises the steps of inserting the left in-ear microphone in the left ear of the person and inserting the right in-ear microphone in the right ear of said person;

wherein the computing device is electrically connected to the left and right in-ear microphone, and is operatively connected to the orientation unit; and wherein the computing device captures the plurality of left audio samples and the right audio samples and retrieves or receives or reads or otherwise obtains the orientation information from said orientation unit; and wherein the computing device stores said data in a memory.

16. The method of claim 15, wherein the portable device further comprises a loudspeaker; and wherein the portable device is further adapted for analyzing the orientation information in order to verify whether a 3D space around the head is sufficiently sampled, according to a predefined criterium;

and is further adapted for rendering a first respectively second predefined audio message via the loudspeaker of the portable device depending on the outcome of the analysis whether the 3D space is sufficiently sampled.

17. The method according to claim 1, wherein the audio test signal comprises a plurality of acoustic stimuli, wherein each of the acoustic stimuli has a duration in the range from 25 to 50 ms; and/or wherein a time period between subsequent acoustic stimuli is a period in the range from 250 to 500 ms.

18. The method according to claim 1, further comprising the step of:

selecting, dependent on an analysis of the captured data sets, a predefined audio-message from a group of predefined audio messages, and rendering said selected audio-message via the same loudspeaker as was used for the test-stimuli or via a second loudspeaker different from the first loudspeaker, for providing information or instructions to the person before and/or during and/or after the rendering of the audio test signal.

19. A method of rendering a virtual audio signal for a particular person, comprising:

x) estimating an individualized head-related transfer function and an individualized interaural time difference function of said particular person using a method according to claim 1;

y) generating a virtual audio signal for the particular person, by making use of the individualized head-related transfer function and the individualized interaural time difference function estimated in step x);

z) rendering the virtual audio signal generated in step y) using a stereo headphone and/or a set of in-ear loudspeakers.

20. A non-transitory computer readable medium having computer-executable instructions stored thereon for estimating an individualized head-related transfer function and an interaural time difference function of a particular person, which computer-executable instructions, when executed on at least one computing device comprising a programmable processor and a memory, at least the steps of:

obtaining or retrieving a plurality of data sets, each data set comprising a left audio sample originating from a left in-ear microphone and a right audio sample originating from a right in-ear microphone and orientation information originating from an orientation unit, the left audio sample and the right audio sample and the orientation information of each data set being substantially simultaneously captured in an arrangement wherein:

the left in-ear microphone being inserted in a left ear of the person, and the right in-ear microphone being inserted in a right ear of the person, and the person being located at a distance from a loudspeaker, and the orientation unit being fixedly mounted to the head of the person, and the loudspeaker being arranged for rendering an acoustic test signal comprising a plurality of audio test-fragments, and the person moving his or her head in a plurality of different orientations during the rendering of the acoustic test signal;

extracting or calculating a plurality of interaural time difference values and/or a plurality of spectral values, and corresponding orientation values of the orientation unit from the data sets;

estimating a direction of the loudspeaker relative to an average position of the center of the head of the person and expressed in the world reference frame, comprising the steps of:

1) assuming a candidate source direction;

2) assigning a direction to each member of at least a subset of the plurality of interaural time difference values and/or each member of at least a subset of the plurality of spectral values, corresponding with the assumed source direction expressed in a reference frame of the orientation unit, thereby obtaining a mapped dataset;

3) calculating a quality value of the mapped dataset based on a predefined quality criterion;

4) repeating steps 1) to 3) at least once for a second and/or further candidate source direction different from previous candidate source directions;

5) choosing the candidate source direction resulting in the highest quality value as the direction of the loudspeaker relative to the average position of the center of the head of the person;

estimating an orientation of the orientation unit relative to the head;

estimating the individualized ITDF and the individualized HRTF of the person, based on the plurality of data sets and based on the estimated direction of the loudspeaker relative to the average position of the center of the head estimated and based on the estimated orientation of the orientation unit relative to the head estimated.

* * * * *